United States Patent [19]

Sakuma

[11] Patent Number: 4,903,619

[45] Date of Patent: Feb. 27, 1990

[54] BUTTONHOLE SEWING MACHINE

[75] Inventor: Kouichi Sakuma, Yamagata, Japan

[73] Assignee: Suzuki Manufacturing, Ltd., Japan

[21] Appl. No.: 84,551

[22] Filed: Aug. 12, 1987

Related U.S. Application Data

[62] Division of Ser. No. 775,008, Sep. 11, 1985, Pat. No. 4,727,817.

[51] Int. Cl.[4] ..... D05B 69/00

[52] U.S. Cl. ..... 112/67; 112/220; 112/71; 112/73; 112/68

[58] Field of Search ..... 112/220, 449, 65, 67, 112/70, 71, 73, 87, 68

[56] References Cited

U.S. PATENT DOCUMENTS

| | | | |
|---|---|---|---|
| 1,807,577 | 5/1931 | Allen | 112/68 |
| 1,839,854 | 1/1932 | Allen | 112/65 |
| 1,939,271 | 12/1933 | Miller | 112/67 X |
| 1,941,620 | 1/1934 | Pikul . | |
| 1,981,119 | 11/1934 | Pikul . | |
| 1,988,460 | 1/1935 | Pikul . | |
| 1,991,627 | 2/1935 | Reece . | |
| 2,086,662 | 7/1937 | Collins et al. . | |
| 2,086,663 | 7/1937 | Collins et al. . | |
| 2,149,110 | 2/1939 | Avis . | |
| 2,174,294 | 9/1939 | Spaine . | |
| 2,301,797 | 11/1942 | Spaine . | |
| 2,340,276 | 1/1944 | Spaine et al. . | |
| 2,487,389 | 11/1949 | Smith et al. . | |
| 2,889,790 | 6/1959 | Smith et al. | 112/65 |
| 3,254,616 | 6/1966 | Pudeluko . | |

FOREIGN PATENT DOCUMENTS

| | | |
|---|---|---|
| 25276 | 1/1914 | Japan . |
| 26968 | 12/1914 | Japan . |
| 36153 | 4/1920 | Japan . |
| 94060 | 9/1931 | Japan . |
| 118369 | 11/1936 | Japan . |
| 118405 | 12/1936 | Japan . |
| 123686 | 2/1938 | Japan . |
| 135034 | 2/1940 | Japan . |
| 25536 | 2/1950 | Japan . |
| 26730 | 2/1951 | Japan . |
| 264886 | 8/1951 | Japan . |
| 272893 | 7/1952 | Japan . |
| 283541 | 7/1953 | Japan . |
| 301125 | 2/1955 | Japan . |
| 301126 | 2/1955 | Japan . |
| 305834 | 8/1955 | Japan . |
| 47-27462 | 7/1972 | Japan . |

*Primary Examiner*—H. Hampton Hunter

*Attorney, Agent, or Firm*—Lorusso & Loud

[57] ABSTRACT

Disclosed is a button-hole sewing machine which includes an electric motor for driving the sewing machine; a machine body including a bed for holding a workpiece in cooperation with a workpiece clamping means; a stitch forming device for working button-holes in the workpiece and including a mechanism for driving a needle bar which supports a needle, a looper-spreader mechanism for driving a looper and a spreader, and a turning mechanism for turning the needle bar, the looper and the spreader. The needle bar driving mechanism includes a vertical reciprocation mechanism and a needle lateral vibrating mechanism; and an arm shaft for driving the up/down moving mechanism. The mechane further includes a bed shaft for driving the looper-spreader mechanism; a cutting mechanism for forming button-holes in the work; a control cam mechanism including a rapid feed mechanism for rapidly feeding the bed and a stitch feeding mechanism; a vertical shaft linked with the arm shaft for driving the needle vibrating mechanism, the lower shaft, and the stitch feeding mechanism; and a clutch means for transmitting torque of the motor to a rapid feed shaft to rapidly feed the bed through the rapid feeding mechanism in a rapid feeding mode and for transmitting the torque to selected one of the arm, vertical, and bed shafts to cause the stitch forming device to perform stitch forming through the stitch feeding mechanism. The motor is directly mounted on the machine body for portability.

21 Claims, 53 Drawing Sheets

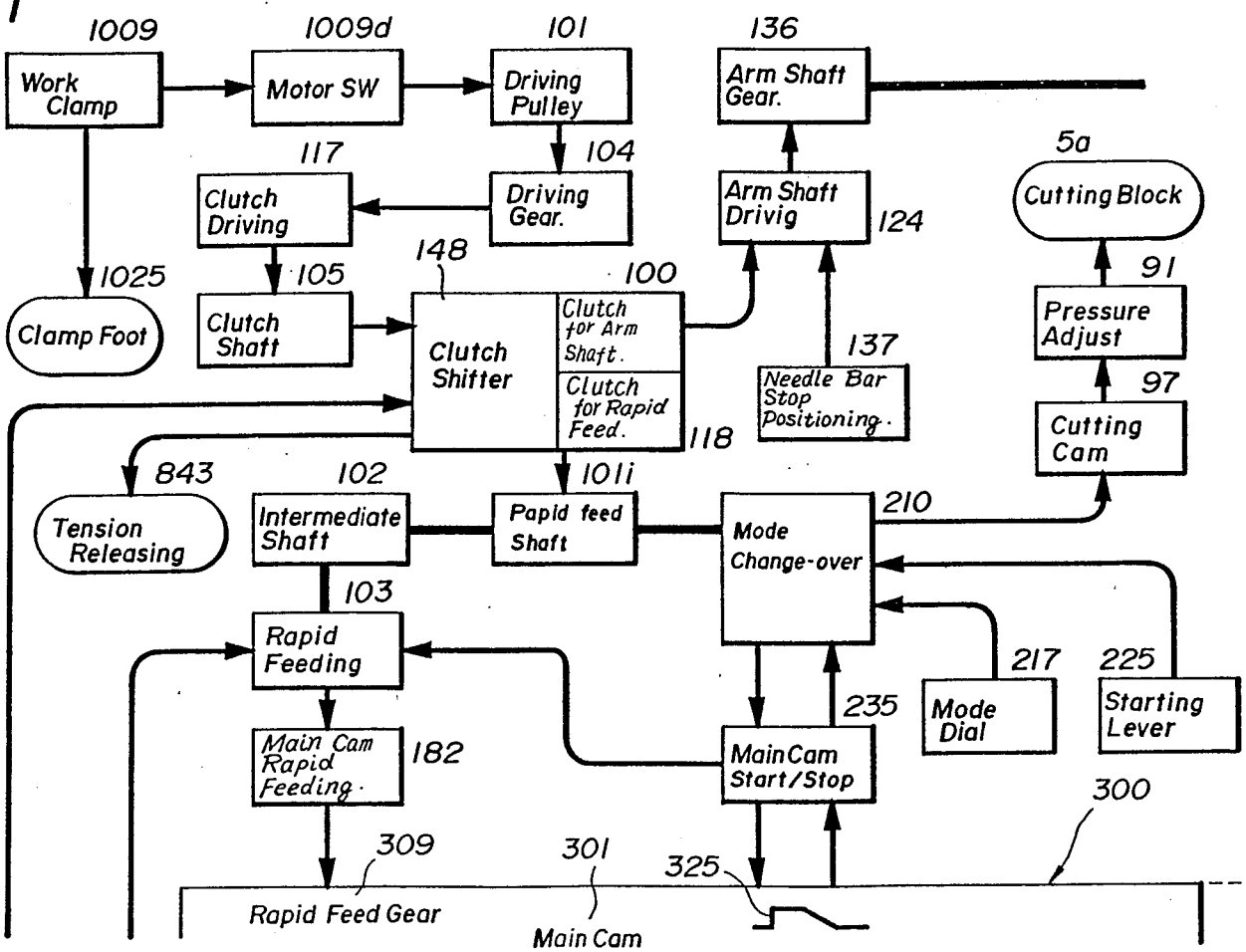
FIG. 7b-1
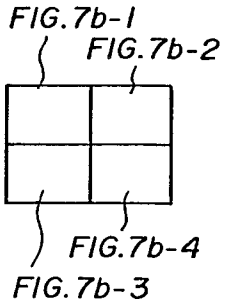

BUTTONHOLE SEWING MACHINE

This is a division of application Ser. No. 775,008 filed Sept. 11, 1987, now U.S. Pat. No. 4,727,817.

BACKGROUND OF THE INVENTION

1. Field of the Invention

The present invention relates to a buttonhole sewing machine, and particularly to a buttonhole sewing machine which is compact in size and improved in operation, and which sews beautifully finished buttonholes with no disorder in the stitches.

2. Description of the Prior Art

The conventional buttonhole sewing technique utilizes an elongated slit s (FIG. 6*a*) which is terminated at its one end with an eyelet hole e, and stitches a and a' are formed in parallel at the opposite sides of the slit s and perpendicular to the slit s, the stitches a and a' being connected with each other by radial stitches b and offset stitches c and c', the eyelet hole being surrounded by these stitches c, c', and b. On the other hand, when no eyelet hole is formed, the stitches a and a' are connected through the radial stitches b (FIG. 6*b*), so as to provide a so-called straight buttonhole sewing.

Such buttonhole sewing machines have a long history of development, and various types have been developed and disclosed, for example, in the following:

| | |
|---|---|
| a - 1 | Japanese Patent No. 25276 |
| 2 | Japanese Patent No. 26968 |
| 3 | Japanese Patent No. 36153 |
| b | Japanese Patent No. 94060 |
| c - 1 | Japanese Patent No. 118369 |
| 2 | Japanese Patent No. 118405 |
| 3 | Japanese Patent No. 123686 |
| 4 | Japanese Patent No. 135034 |
| 5 | Japanese Patent Publication No. 1125/1955 |
| d | Japanese Patent Publication No. 536/1950 |
| e | Japanese Patent Publication No. 3541/1953 |
| f | Japanese Patent Publication No. 27462/1972 |
| g - 1 | Japanese Patent Publication No. 730/1951 |
| 2 | Japanese Patent Publication No. 4886/1951 |
| 3 | Japanese Patent Publication No. 2893/1952 |
| 4 | Japanese Patent Publication No. 1126/1955 |
| 5 | Japanese Patent Publication No. 5834/1955 |
| | U.S. Pat. No. 2,174,294 |
| | U.S. Pat. No. 2,301,797 |
| | U.S. Pat. No. 1,941,620 |
| | U.S. Pat. No. 1,981,119 |
| | U.S. Pat. No. 1,988,460 |
| | U.S. Pat. No. 1,991,627 |

In general, in the prior art buttonhole sewing machines, an electric motor of $\frac{1}{2}$–$\frac{1}{4}$ HP has been employed to transmit power to a cutting operation mechanism and a work clamp feeding mechanism through one belt drive system and to a stitch forming mechanism through another belt drive system, and therefore the sewing machines have been large in size and heavy in weight (about 100 Kg), making them difficult to carry. Further, because of their large size as well as heavy weight, energy consumption has been undesirably high.

Although those sewing machines have been designed as precision machines, their operation was not so good and adjustment required very highly technical special knowledge, and therefore they have been used mainly in sewing or needle-work makers or the like only when the expense and maintenance of the equipment of those sewing machines could be afforded. Accordingly, buttonhole sewing machines could not be afforded in tailor shops, small entity dressmaking workshops, etc.

The prior art encountered difficulties in that different types of buttonhole sewing machines were required stitching for different techniques such as so-called before-cutting (after cutting a buttonhole stitches are formed), after-cutting (after stitches are formed a buttonhole is cut), etc.

SUMMARY OF THE INVENTION

The above-described drawbacks in the prior art buttonhole sewing machines have been successfully eliminated by the present invention.

A first object of the present invention is to provide a buttonhole sewing machine which is sufficiently compact in size to be portable.

A second object of the present invention is to provide a buttonhole sewing machine which has good operation and in which the stitches of the finished buttonholes are attractive with no disorder.

A third object of the present invention is to provide a buttonhole sewing machine which is sufficiently compact in size to be portable, which provides good operation and stitches in the finished buttonholes which are attractive and without disorder.

To attain the foregoing objects, the buttonhole sewing machine of the present invention comprises: an electric motor for driving the sewing machine; a machine body including a bed for holding a workpiece in cooperation with a work clamping means; and a stitch forming device for stitching the buttonholes in the workpiece. The stitch forming device includes a needle bar driving mechanism for driving a needle bar which supports a needle, a looper-spreader mechanism for driving a looper and a spreader, and a turning mechanism for turning the needle bar, the looper and the spreader. The needle bar driving mechanism in turn, includes an up/down mechanism and a needle vibrating mechanism; an arm shaft for driving the up/down mechanism; a bed shaft for driving the looper-spreader mechanism; a cutting mechanism for forming buttonholes in the work; a control cam mechanism including a rapid beed mechanism for rapidly feeding the bed and a stitch feeding mechanism; a vertical shaft linked with the arm shaft for driving the needle vibrating mechanism, the bed shaft, and the stitch feeding mechanism; the improvement comprising: a clutch means for transmitting torque of the motor to an intermediate shaft to rapidly feed the bed through the rapid feeding mechanism in a rapid feeding mode and for transmitting the torque to a selected one of the arm, vertical, and bed shafts to cause the stitch forming device to operate and the motor being directly mounted on the machine body to make the sewing machine portable.

The buttonhole sewing machine is provided with an intermittent brake means for releasing to brake the control cam mechanism for stitch feeding in the stitch feeding mode by the stitch feeding mechanism and for braking the control cam mechanism over the period where the needle is made engaged with the work by the up/-down mechanism.

The button-hole sewing machine is provided with a mode change-over mechanism including a driving section linked with the intermediate shaft of the rapid feeding mechanism, a driven section for operating the cutting mechanism, and a changing mechanism for causing the driving section to engage and disengage the driven section and for adjusting the timing for the engagement and disengagement of the driving and driven section in response to a command from the control cam mechanism.

The control cam mechanism includes a disc-like main cam, the vertical shaft extending through the center of the main cam, the rapid feeding mechanism includes a power transmission system for driving an outer periphery of the main cam from a rapid feed intermediate shaft of the rapid feeding mechanism, and the stitch feeding mechanism includes a stepping driving section and another power transmission system for transmitting power from the vertical shaft to the main cam to cause the main cam to step through the stepping driving section.

The stepping driving portion includes a stitch number adjusting mechanism for varying the number of stitch over the whole of stitches surrounding a buttonhole, the stitch number adjusting mechanism including a stitch number increasing/decreasing portion for increasing-/decreasing the number of stitch at a part of stitches surrounding a buttonhole.

The main cam includes a stitch number increasing-/decreasing outer-peripheral cam for controlling the stitch number increasing/decreasing portion.

The stitch number increasing/decreasing portion is linked, in stitch forming, through a connecting or coupling means, with an eyelet-straight change-over mechanism for changing over the operation between an eyelet-hole working mode while making the bed feed across and a straight-hole working mode without making the bed feed across.

The connecting means includes an adjusting portion for adjusting an amount of increase/decrease in the number of stitches.

The main cam includes a stop cam for controlling a mode change-over mechanism which performs contact-/removal between a driving section linked with an intermediate shaft of the rapid feeding mechanism and a driven section which operates the cutting mechanism, and for cutting off the power transmission system of the rapid feeding mechanism.

The main cam includes a cam portion of an equal diameter for stopping feeding of the bed over a predetermined range including the stop position of the bed by the stop cam.

The buttonhole sewing machine is provided with a recovery means including a lever adapted to be in slidable-contact with the stop cam of the main cam and connected to the mode change-over mechanism as well as said power transmission system of the rapid feeding mechanism, the lever being arranged such that after the lever is engaged/stopped by the stop cam to cut off the mode change-over operation of the mode change-over mechanism and the power transmission of the rapid feeding mechanism, the lever is separated from the stop cam in response to rotation of the main cam.

The buttonhole sewing machine is provided with a clutch driving device for driving the clutch means within one pitch stitch in accordance with buttonhole length detection by a buttonhole length adjusting mechanism in changing-over the mode between the rapid feeding and stitch feeding operations by using a bias driving force stored from the control cam mechanism within a period of at least one of the rapid feeding and stitch feeding operations.

The buttonhole sewing machine is provided with a device for slipping a needle bar at a predetermined position by using a clutch for performing contact-removal between a driving shaft and an arm shaft for driving the needle bar, the clutch comprising a change-over shifter slidably connected to the driving shaft, an engagement/locking portion engageable with the shifter, a driving portion for driving the arm shaft, and a release cam coupled with the engagement/locking portion for radially outward releasing an arm shaft brake cam roller, a stop cam for radially inward moving the arm shaft brake cam roller, a rotation limit portion for allowing the engagement/locking portion and the release cam to rotate relative to the driving portion within a predetermined range, a spring provided between the driving portion and the engagement/locking portion and the release cam, and a one-way clutch provided between the driving shaft and the driving portion.

The buttonhole sewing machine according to one preferred embodiment is provided with a clutch means for transmitting torque of the motor to an intermediate shaft to rapidly feed the fed through the rapid feeding mechanism in a rapid feeding mode while driving a cutting mechanism before and after the torque transmission operation, and for transmitting the torque to a selected one of the arm, vertical, and bed shafts to cause the stitch forming device to perform stitch forming through the stitch feeding mechanism. The clutch means includes: a change-over shifter slidably connected to a driving shaft connected to the motor; a rapid feed engagement/locking portion engageable with the change-over shifter; a rapid feed driving portion coupled with the rapid feed engagement/stopping portion, for driving the rapid feed shaft; a stitch feed engagement/locking portion egageable with the change-over shifter; a stitch feed driving portion for driving one of the arm, vertical, and bed shafts, for radially outward releasing an arm shaft brake cam roller and a release cam coupled with the stitch feed engagement/locking portion; a stop cam for radially inward moving the arm shaft brake cam roller; a rotation limit portion for allowing the stitch feed engagement/locking portion and the release cam to rotate relative to the stitch feed driving portion within a predetermined range; a spring provided between the stitch feed driving portion and the stitch feed engagement/locking portion and the release cam; one-way clutch provided between the driving shaft and the stitch feed driving portion; a timing device for providing a timing at which the change-over shifter is separated from the stitch feed engagement/locking portion in accordance with buttonhole length detection by a buttonhole length adjusting mechanism so as to cause the needle bar driven by the arm shaft to stop at the predetermined position; a buffer device provided in the stop cam for absorbing shocks in stopping the needle bar; and another buffer device disposed between the motor and the driving shaft for absorbing shocks in changing-over operation of the change-over shifter.

The timing device includes a control cam provided in the stitch feed driving portion, a clutch control arm engageable with the control cam, a clutch control link actuated in response to the buttonhole detection by the buttonhole length adjusting mechanism, and a spring provided between the clutch control arm and the clutch control link.

The buttonhole sewing machine according to another embodiment is provided with: a mode change-over means including a driving section linked with an intermediate shaft of the rapid feed mechanism; a driven section for operating the cutting mechanism, a clutch means provided between the driving section and the driven section for connecting/separating the driving section to/from the driven section, and a mode change-over unit capable of variably selecting a relative position relative to the driven section for alternatively selectively forming one of various modes with respect to operations and operational sequences of the cutting mechanism and/or the rapid feed mechanism corresponding to the selected relative position, so that the clutch, the cutting mechanism and/or the rapid feed mechanism are actuated in accordance with one mode corresponding to a selected one of the relative positions of the unit.

The buttonhole sewing machine according to a further embodiment is provided with: a driving section linked with an intermediate shaft of the rapid feed mechanism; a driven section for operating the cutting mechanism; a clutch casing coupled with the driven section; a cutting actuation rotary plate mounted on the casing rotatably within a predetermined range; a first spring provided between the casing and the cutting actuation rotary plate; a clutch for connecting/separating the clutch casing to/from the driven section through an actuator arm from the cutting actuation rotary plate; a second spring for urging the clutch to the connected state between the clutch casing and the driven section; a cutting actuation lever for actuating the cutting actuation rotary plate; a mode change-over cam; an projecting pin engaged with the mode change-over cam; a protrusion for actuating the cutting actuation lever; a third spring urging the cutting actuation rotary plate to a state where the protrusion is being separated from the cutting actuation lever; a before-cutting cam caused to advance/retreat by the mode change-over cam; a mode change-over knob for selecting the relative position of the mode change-over cam relative to the driven section; and a after-cutting actuation arm for connecting the cutting actuation lever to the control cam mechanism.

The driving section and the clutch are constituted by a ratchet and a hook respectively, the hook being pivotally attached on the clutch casing.

The mode change-over cam has a shape that in a before-cutting mode, a projecting pin of the cutting actuation rotary plate is allowed to abut on a start lever actuating arm, the before-cutting cam is radially outward advanced, and the after-cutting actuation arm is separated from the cutting actuation lever, while the mode change-over cam has another shape that in an after-cutting mode, the start lever actuating arm is separated from the projecting pin of the cutting actuation rotary plate, the start lever actuating arm is allowed to abut on the after-cutting actuation arm, the after-cutting actuation arm is allowed to engage with the cutting actuation lever; and the before-cutting cam is radially inward retreated.

The mode change-over cam has a shape that in an only cutting mode, a projecting pin of the cutting actuation rotary plate is allowed to abut on a start lever actuating arm, the before-cutting cam is radially inward retreated, and the after-cutting actuation arm is separated from the cutting actuation lever.

The change-over cam has a shape that in a non-cutting mode a start lever actuating arm is separated from a projecting pin of the cutting actuation rotary plate, the after-cutting actuation arm is separated from the cutting actuation lever, and the before-cutting cam is radially inward retreated.

The buttonhole sewing machine according to a still other embodiment is provided with: a driving section linked with an intermediate shaft of the rapid feed mechanism; a clutch means provided between the driving section and a driven section for performing connection/separation therebetween; and a mode change-over means having various relative positions relative to the driven section and having a plurality of mode change-over units respectively forming various modes corresponding to the relative positions with respect to respective operations and operational sequences of the cutting mechanism and/or the rapid feed mechanism, the mode change-over units being replaceable in accordance with the various modes so that the cutting mechanism and/or the rapid feed mechanism are actuated in accordance with the mode corresponding to the position of the replaced one of the mode change-over units.

The buttonhole sewing machine is provided with: the cutting mechanism including a cutting shaft, a cutting cam fixed on the cutting shaft, a lever caused to pivotally move by a cam follower engaged with the cutting cam, and an arm pivoted by the lever for removably mounting one of a block and a chiding knife; and a pressure adjusting means disposed between the lever and the arm for engageably and removably attaching the other of the cutting block and the cutting knife being to the one of the cutting block and the cutting knife.

The cutting cam is a disc cam continuously formed with a first curved surface portion where one of the cutting block and the cutting knife mounted on the arm rapidly comes close to the other, a second curved surface portion where the one of the cutting block and the cutting knife gradually comes close to the other, a third curved surface portion where the cutting block and the cutting knife comes in contact with each other while cutting the work, and a fourth curved surface portion where the cutting block and the cutting knife are gradually separated from each other, and a fifth curved surface portion where the cutting block and the cutting knife are rapidly separated from each other.

The needle bar up/down moving mechanism is provided with a crank provided on the arm shaft, a link pivoted on the crank, and a ball-and-socket joint for connecting the link to the needle bar.

The looper-spreader mechanism is provided with looper and spreader cams fixed on the bed shaft, looper and spreader arm followers engaged with the looper and spreader cams respectively, and connection rods for pivotally connecting the looper and the spreader to the looper and spreader cam followers respectively.

The buttonhole sewing machine according to a still further embodiment is provided with: a driving section provided on an intermediate shaft of the rapid feed mechanism through a one-way clutch; a driven section for transmitting the driving section to the control cam mechanism through a change-over clutch; a braking section capable of rubbing on the driving section; a braking cam fixed on the bed shaft; a cam follower slidably contacting with the braking cam for urging the driving portion against the braking section; whereby in rapid feeding, the change-over clutch is connected to the driving section to thereby constitute a rapid feed transmission system through the intermediate shaft, the one-way clutch, the driving section, the change-over clutch, the driven section, and the control cam mechanism, while in stitch forming, the change-over clutch is connected to the driving section to constitute an intermittent braking system through the bed shaft, the braking cam, the cam follower, the braking section, the driving section, the change-over clutch, the driven section, and the control cam mechanism when the needle is being engaged with the work.

In the buttonhole sewing machine the control cam mechanism includes a main cam; and the button-hole sewing machine is provided with an eyelet-straight change-over mechanism including a driving lever having a cam follower controlled by the main cam, a driven lever caused by the driving lever through a clutch to make the bed feed across, and a manually operated lever for actuating the clutch.

The stitch feeding mechanism includes a power transmission system in which the main cam is driven by the vertical shaft through a stepping driving section, the stepping driving section including a stitch number increasing/decreasing section responsive to the manually operated lever for increasing/decreasing the number of stitch in a part of stitches surrounding a buttonhole.

The control cam mechanism includes a disc-like main cam, the vertical shaft extending through the center of the main cam; and the stitch feeding mechanism includes a feeding cam fixed on the vertical shaft, a driving lever adapted to be swung by the feeding cam with a slidably mounted slider as a pivot of swinging, a driven lever pivoted on the driving lever for driving the main cam to step through a one-way clutch, and an adjuster for varying the position of the slider.

The control cam mechanism includes a disc-like main cam, the vertical shaft extending through the center of the main cam; and the stitch feeding mechanism includes a feeding cam fixed on the vertical shaft, a driving lever adapted to be swung by the feeding cam with a slidably mounted slider as a pivot of swinging, and a driven lever pivoted on the driving lever for driving the main cam to step through a one-way clutch, the slider being coupled with a cam follower slidably contacting with an outer peripheral cam of the main cam for increasing/decreasing the number of stitch in a part of stitches surrounding a button-hole.

The buttonhole sewing machine is provided with a buttonhole length adjusting mechanism including a movable member provided on the bed or work clamping means to be movable within a position-adjustable range and having a control cam for controlling the respective timings of starting and ending the stitch forming, an adjuster for adjusting the range, and a cam follower for actuating a clutch mechanism engageable with the control cam for changing over the mode between rapid feeding and stitch forming.

The turning mechanism is provided with a turning shaft caused to pivot by a cam follower controlled by a main cam constituting the control cam mechanism, and a parallel quadric crank link for turning the looper and the spreader synchronously with each other.

The cam follower is connected to the turning shaft through a sector wheel.

The buttonhole sewing machine is provided with: a clutch means for transmitting the torque of the motor to an intermediate shaft to cause the rapid feeding mechanism to feed the bed rapidly in a rapid feeding mode while to a given one of the arm shaft, the vertical shaft, and the bed shaft to cause the stitch forming device to perform stitch forming through the stitch feeding mechanism; and a clutch driving device including a bidirectionally urging spring for storing elastic forces in the direction from the rapid feeding to the stitch feeding and vice versa alternatively changed-over by the control cam mechanism, and a release means responsive to the detection of buttonhole length for releasing a selected directional one of the stored elastic forces to drive the clutch means in the direction of one of the rapid feeding and the stitch feeding.

The buttonhole sewing machine is provided with a manually operated clutch device disposed between the clutch driving device and the clutch means for urgently changing over the clutch means.

The needle vibrating mechanism is provided with a bell crank pivoted by the vertical shaft, a lever caused by the bell crank to give vibrating movement to the needle bar and to cause the turning mechanism to give turning movement to the needle bar, and a coupler disposed between the crank and the lever so as to transmit the swinging movement from the former to the latter but so as not to transmit the vibrating movement from the latter to the former.

The arm is provided with a needle vibration width adjuster for varying an amount of swinging applied to the lever to thereby adjust the vibrating width of the needle.

The bell crank is provided with a needle point adjuster for varying the pivotal point of the crank on the machine body to thereby adjust the falling point of the needle.

In the buttonhole sewing machine, the work clamping means is provided with a work clamp base plate horizontally slidably provided on said work clamping means and elastically inward urged by a spring means, and a work clamp arm and a work clamp foot for clamping the work in cooperation with the work clamp base plate; and the buttonhole sewing machine is provided with: a fittingly connecting section for horizontally slidably fitting at least the rear end opposite sides of the work clamp base plate into the work clamping means; and an adjuster for adjusting the amount of horizontal spread of the work clamp base plane while keeping the fitting connection.

The adjuster is provided with a spring for elastically outward urging the adjuster when the amount of horizontal spread is adjusted.

The work clamping means is provided with a pair of horizontally separated work clamp base plates provided on the work clamping means, a pair of work clamp arm and foot pivoted on each of the work clamp base plates for clamping the work in cooperation with the work clamp base plates, and an elastic work clamp frame pivotally mounted on the base at its one end while connected to the pair of work clamp base plates at its other end and operated by a manually operated lever for holding a non-clamping state kept by an elastic force by a spring and a clamping state against the elastic force of the spring, the manually operated lever being connected to the work clamp frame at the pivotal point thereof through an elastic bar.

The buttonhole sewing machine is provided with a switching means responsive to the manually operated lever to turn a switch of the motor on or off when the non-clamping state or the clamping state is held by the manually operated lever respectively.

In the buttonhole sewing machine, the looper-spreader mechanism is provided with a looper-spreader turning frame turned by the turning mechanism; and the buttonhole sewing machine is provided with a thread path way means provided between a turning thread guide provided on the turning frame at a position other than the center of the turning frame and a fixed thread guide at a predetermined position other than the turning frame so as to make constant the distance between the turning and fixed guides when the looper-spreader turning frame is being turned.

The thread path means includes a plurality of links provided between the turning and fixed guides, and thread guides provided between knots of the links.

These and other objects of the invention will become apparent from the following description of embodiments thereof when taken together with the drawings.

BRIEF DESCRIPTION OF THE DRAWINGS

FIGS. 12 and 12*a*–12*b* are explanatory diagrams showing the base, the bed stand, the bed, the arm, and the main cam of the same sewing machine;

DETAILED DESCRIPTION OF PREFERRED EMBODIMENTS

Figure 1:
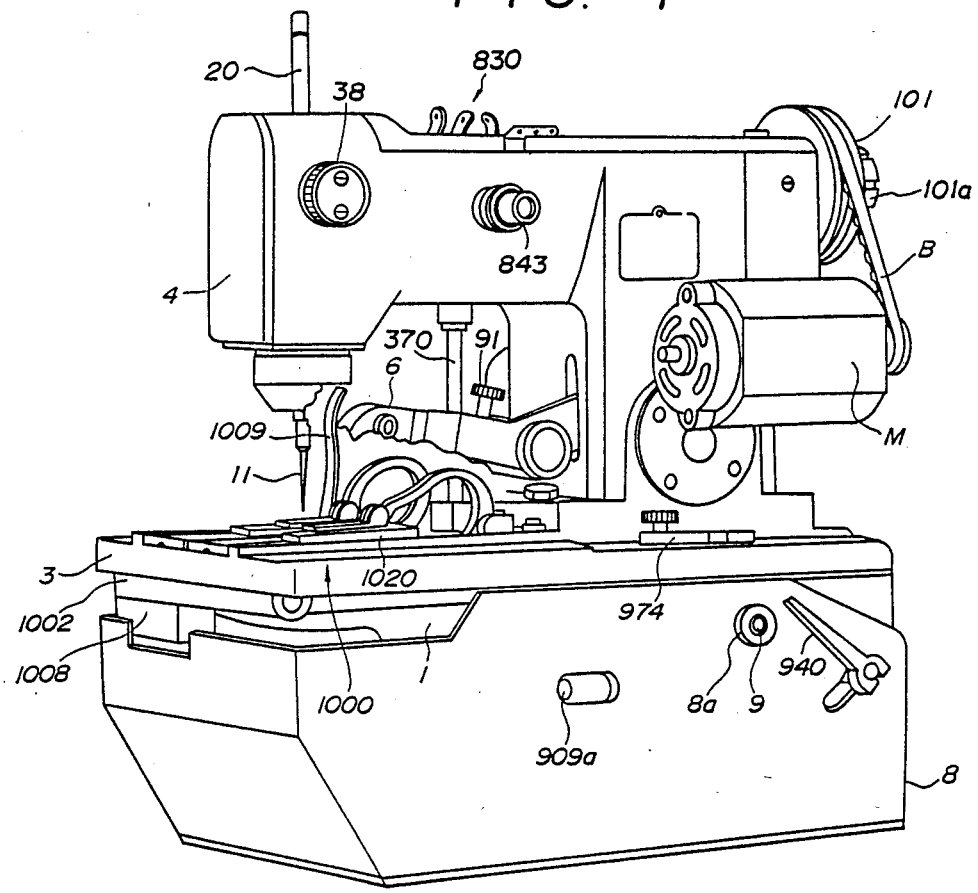
FIG. 1 is a partly cut-away perspective view of the button-hole sewing machine according to the present invention.

Referring to the drawings, preferred embodiments of the present invention will be described in detail.

As shown in FIGS. 1 to 7*a*, a sewing machine according to the present invention includes a bed stand 1, a bed 2 fixed on the bed stand, a workpiece clamp carrier 3 slidably mounted on the bed, and an arm 4 mounted on the bed with the work clamp carrier slidably positioned between the bed and the arm. The bed stand 1 and the arm 4 constitute the machine body. The bed stand 1 is pivotally mounted on a machine base 8, at the rear thereof, through base connection bushings 8*a* fixed on base connection bushing screws 9 projecting from the bed stand 1. A bottom front portion 1*a* of bed stand 1 abuts a protrusion support (not shown) of the machine base 18.

In brief, the bed stand 1 includes a stitch forming device 10 for making stitches around a slit s and an eyelet e and a cutting means 80 for cutting a slit and an eyelet. The sewing machine is provided with various means for transmitting power to the various devices or mechanisms, for controlling the same, and for providing safety of operation.

These will be explained successively.

First, the stitch forming device 10 is provided toward the front of the arm 4 and the bed stand 1. The stitching device 10 comprises needle bar driving mechanism 10*a*, looper and spreader driving mechanism 800, and stitch turning mechanism 370*a*. The needle bar driving mechanism 10*a* gives an up-and-down motion, a rotating motion, and a lateral vibrating motion to a needle bar 20 carrying a needle 11. The looper and spreader driving mechanism 800 cooperates with the needle bar driving mechanism. The stitch turning means 370*a* turns the needle bar and a looper and spreader portion by an angle of 180 degrees.

In the arm 4 an arm shaft 22 is interposed between arm shaft bushings 22*a* and 850*a*.

Figure 10:
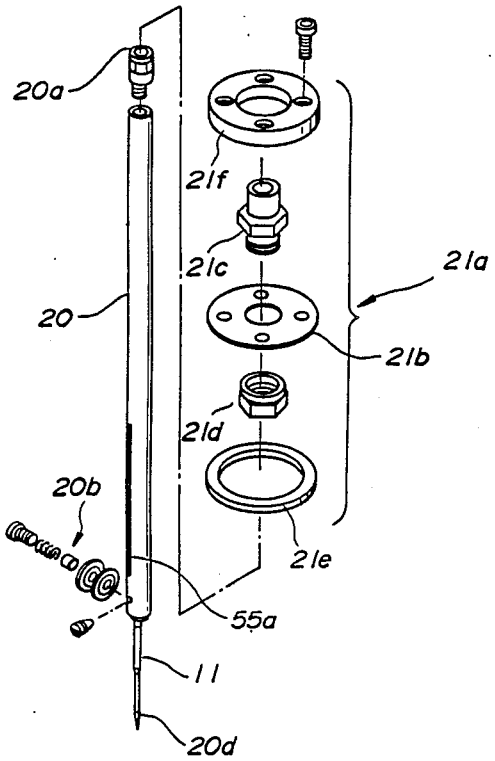
FIG. 10 is an explanatory diagram showing the needle bar portion of the same sewing machine.

The needle bar 20 carrying the needle 11 is swingably supported by a universal bearing 21*a* (see FIGS. 2 and 10) mounted on the arm 4. The needle bar 20 is fitted in a center hole of an elastic plate 21*b* and fastened tightly by needle bar bushings 21*c* and 21*d*. The edge of the plate 21*b* is fixed at its outer peripheral edge by a ring collar 21*e* and a needle bar bushing frame 21*f*. Thus the needle bar 20 is supported so as to be able to laterally vibrate, rotate, and vertically reciprocate.

Figure 10A:
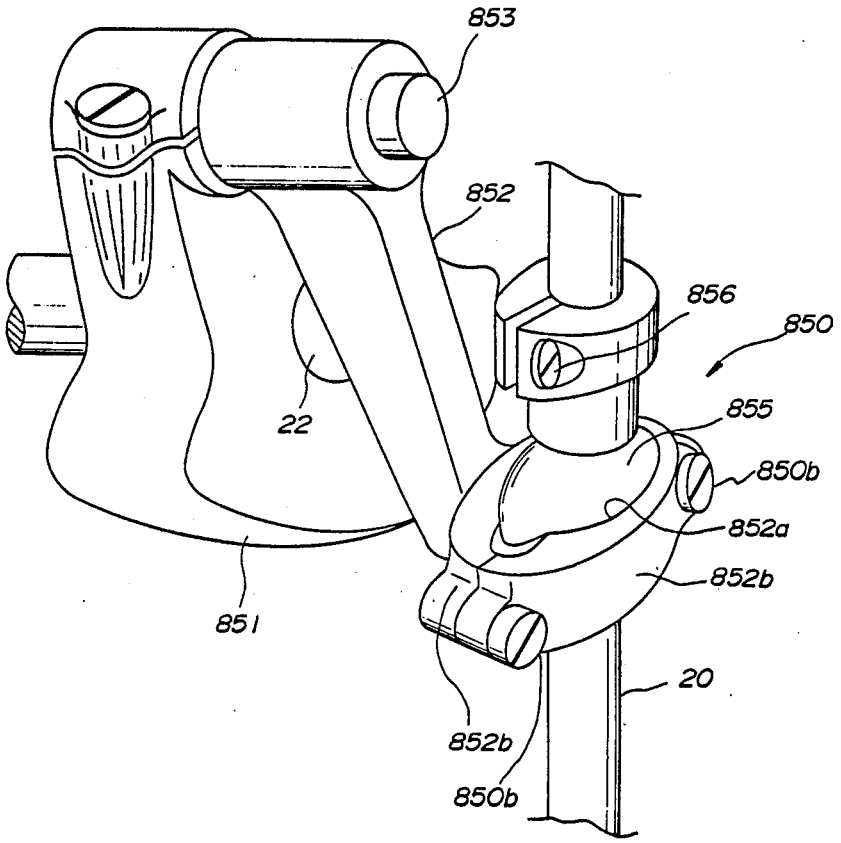
FIGS. 10*a*–10*c* are explanatory diagrams of the needle bar up/down mechanism of the same sewing machine.
Figure 10C:
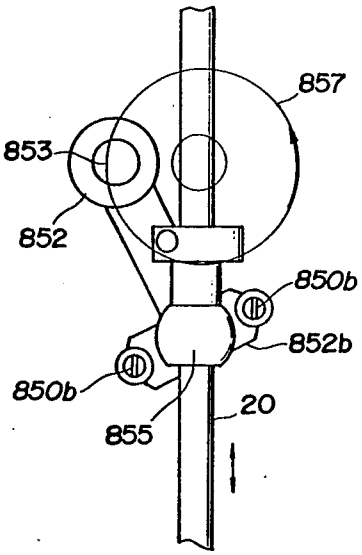
Figure 10B:
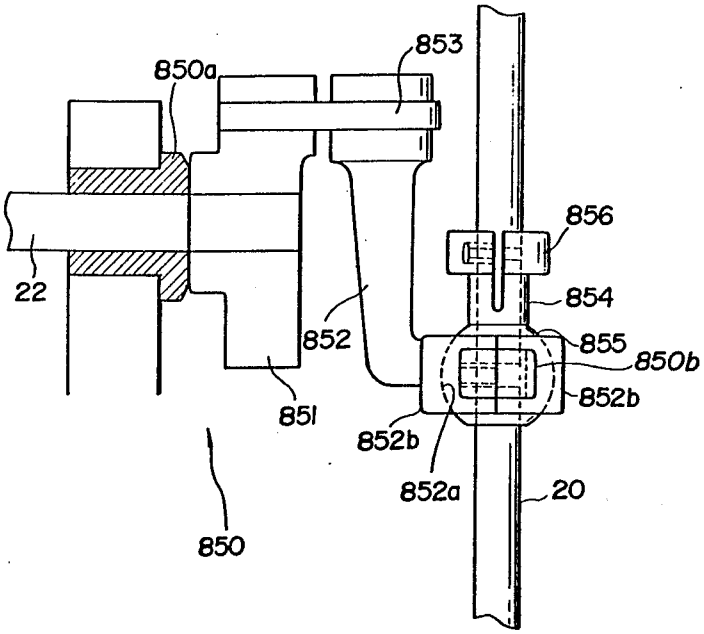

In the needle bar driving mechanism 10*a*, a vertical driving mechanism 850 (see FIGS. 10*a*–10*c*) will be explained.

A needle bar crank 851 is mounted on the arm shaft 22 through the arm shaft bushing 850*a*. The crank 851 is pivoted at one end of a needle bar crank rod 852 through a needle bar crank pin 853. A spherical hollow portion 852*a* at another end 852*b* of the rod 852 is connected by a needle bar crank rod cap screw 850*b* to a ball-and-socket joint 855 which is fixed by a needle bar connection screw 858.

As the arm shaft 22 rotates, the crank 851 rotates and the crank rod 852 follows the tracks of an arc 857, so that the other end 852*b* reciprocates, and the needle bar 22 is moved up/down by the ball-and-socket joint 855.

Next, in the needle lateral bar driving mechanism 10*a*, needle vibrating mechanism 30*a* (see FIGS. 7*a*, 24 and 24*a*–24*b*) will be explained.

A vertical shaft 27 is provided to link the arm shaft 22 to drive the needle lateral vibrating mechanism 30*a* to laterally vibrate the needle bar 20. An arm shaft bevel gear 26 fixed on the arm shaft 22 engages a vertical shaft bevel gear 28 fixed on the vertical shaft 27, so that a needle vibrating eccentric 29 (see FIG. 24) fixed on the vertical shaft 27 is rotated. The needle vibrating eccentric 29 is received in a needle vibrating fork 30. The needle vibrating fork 30 is supported on a needle vibrating fork shaft 31 mounted on the arm 4. A needle vibrating rod 32 has one end pivotally attached to the needle vibrating fork 30 by a pin 33 and the other end pivotally attached to a slide block section of a needle vibrating crank 36 of a bell crank 35 provided with a pivot hole 35*a* which receives an index disc shaft 34. The index disc shaft 34 also passes through an eccentric hole 39 of a needle point adjusting index disc 38 which is rotatably mounted on the arm 4. The mounting means may include index disc set plate screws 40 which are screwed into the arm 4 through arc grooves 41 of the index disc 38. The slide block section 37 and the other end of the rod 32 are screwed through a needle vibrating rod bushing 37*a* by a needle vibrating rod hinge screw 37*b* with a nut 37*c* and a washer 37*d*. The bell crank 35 is connected to one end of a needle vibrating vertical rod 44 by a vertical rod received in hole 42. The other end of the rod 44 is pivotally attached to the top of a needle vibrating sleeve 45 by a needle vibrating sleeve pin 46. A cut ring coupler 47 is loosely fitted in a circumferential groove 48 formed in the lower portion of the sleeve 45. The sleeve 45 with the cut ring coupler 47 is slidably mounted on a needle turning frame 49. The needle turning frame 49 is rotatably mounted on the arm 4 by fitting within turning frame guides 50 (see FIG. 18) on the arm 4. On the needle turning frame 49, a needle vibrating frame or lever 50*c* is pivotally mounted on hinge pins 51 through pivot holes 50*a*. The cut ring coupler 47 is pivoted on a shaft 52 received in holes 50*b* in the needle vibrating frame or lever 50*c*. A needle bar lower bushing 21*g* is connected to the needle vibrating frame 50*c* by means of needle bar lower bushing hinge pins 53 through holes 21*h*. The reference numeral 54 designates a needle bar guide having a protrusion 54*a* engaged with a groove 55*a* (see FIG. 10) of the needle bar 20 so that the needle turning frame 49 and the needle bar rotate together. The needle bar guide 54 is fixed to the needle bar lower bushing 21*g* by needle bar guide screws 54*b*.

The reference numeral 55 designates a vertical rod guide for preventing the rod 44 and the sleeve 45 from rotating. The reference numeral 56 designates a needle turning frame cover (see FIG. 18).

When the needle vibrating crank 36 is driven to pivot by the vertical shaft 27 through rod 32, the needle vibrating frame 50*c* vibrates laterally to cause needle bar 20 to swing laterally. At the same time, a rotating motion is given to the needle bar 20 by the above-mentioned stitch turning mechanism (detailed description will be made later). At this time, the cut ring coupler 47 and the sleeve 45 interposed between the crank and the frame operate as a coupler so that the laterally reciprocating motion is transmitted from the former to the latter while the rotating motion is not transmitted from the latter to the former. The slide block section 37 of the needle vibrating crank 36 functions as an amplitude adjuster so that the vibrating/jogging movement to the frame 50*c* is adjustable and the amplitude S1 (see FIG. 6*a*) of the needle 11 or the bight of the stitch may be adjusted.

The eccentric hole 39 of the adjusting index disc 38 in the belt crank 35 functions as a needle point adjuster so that the pivotal point with respect to the machine body is adjustable to provide for differences in the width So (see FIG. 6*a*) of the slit, s.

Next, the looper and spreader mechanism 800 (see FIGS. 11 and 11*a*) in the stitch forming device 10 will be explained.

A vertical shaft lower bevel gear 60 mounted on the vertical shaft 27 at its lower portion engages with a bed shaft bevel gear 62 disposed midway along a bed shaft 61 pivoted on metal 61*b*, 61*c*. The bed shaft 61 is provided with a looper timing adjuster 61*a* and has one end to which a looper driving triangular cam 63 and a spreader eccentric cam 64 are fixed (see FIGS. 2 and 11). The looper driving cam 63 engages a cam catching groove 65*a* of a looper cam follower 25 and the spreader eccentric cam 84 engages with a cam catching groove 66*a* of a spreader cam follower 66 which is fitted in a guide 65*b* of the looper cam follower 65. A looper driving fork 68' provided on a mounting plate 67 of cam follower 65 is rotatably connected to a ring groove 69 of a looper connection rod 68. The reference numeral 67*a* designates a looper cam yoke guide to prevent the mounting plate 67 from coming off. The spreader cam follower 66 carries a projection 66*b* which extends through an opening 70 of the plate 67 and is rotatably connected to a ring groove 72 of a spreader connection rod 71.

A spreader driving connection 804 (see FIG. 11*a*) is mounted on the top end of the spreader driving rod 71. A looper thread take-up 805 is fixed to this connection 804 which is in turn connected to a spreader cam plate (not shown) through a link (not shown).

A looper driving connection 806 is mounted on the top end of the looper driving rod 68 and the connection 806 is connected to a looper carrier 808 through a spreader driving link 807. A lower looper 809, a left spreader 810, and a spreader stopper 811 are mounted on this carrier 808. The carrier 808 is combined with a spreader driving plane 810*a*.

The looper and spreader driving mechanism 800 has a looper frame 801 which is rotated by the stitch turning mechanism 370*a*. A turning thread guide 814 is provided on the frame 801 at a portion other than its center. A fixed thread guide 812 is provided on a looper thread guide link bracket 818 fixed on the bed stand 1. A thread pathway is established between the turning thread guide 814 and the fixed thread guide 812 so as to keep a constant distance therebetween when the looper frame 801 rotates. With respect to this thread pathway, a looper thread guide link 819 is pivoted at its one end onto the looper thread guide link bracket 818 and a guide link connection rod 820 is pivoted at its one end onto the looper frame 801, thereby forming the turning thread guide 814. The link 819 and the rod 820 are pivotally connected to form a looper thread guide 813.

A looper thread 817 is drawn from a spool (not shown) to in succession a thread stopper 1021*g* (see FIG. 16*a*) to be fixed thereat through the fixed thread guide 812, the looper thread guide 813, the turning thread guide 814, a tension adjuster 815 mounted on the looper frame 801, the looper thread take-up 805, a looper thread take-up spring 816 attached to the looper frame 801, a looper thread guide pipe 801*a* perpendicular to an upper bearing 801*b* of the looper frame 801, a spreader stopper 811, the looper 809, and a needle plate 821 provided on the uppermost of the looper frame 801. A core thread (not shown) is drawn from a thread hole 821*a* formed in the needle plate 821 to the thread stopper 1021*g* to be fixed thereat similarly.

Next, the stitch turning mechanism 370*a* of the stitch forming device 10 will be explained (see FIGS. 2, 7*a* and 18).

Figure 8:
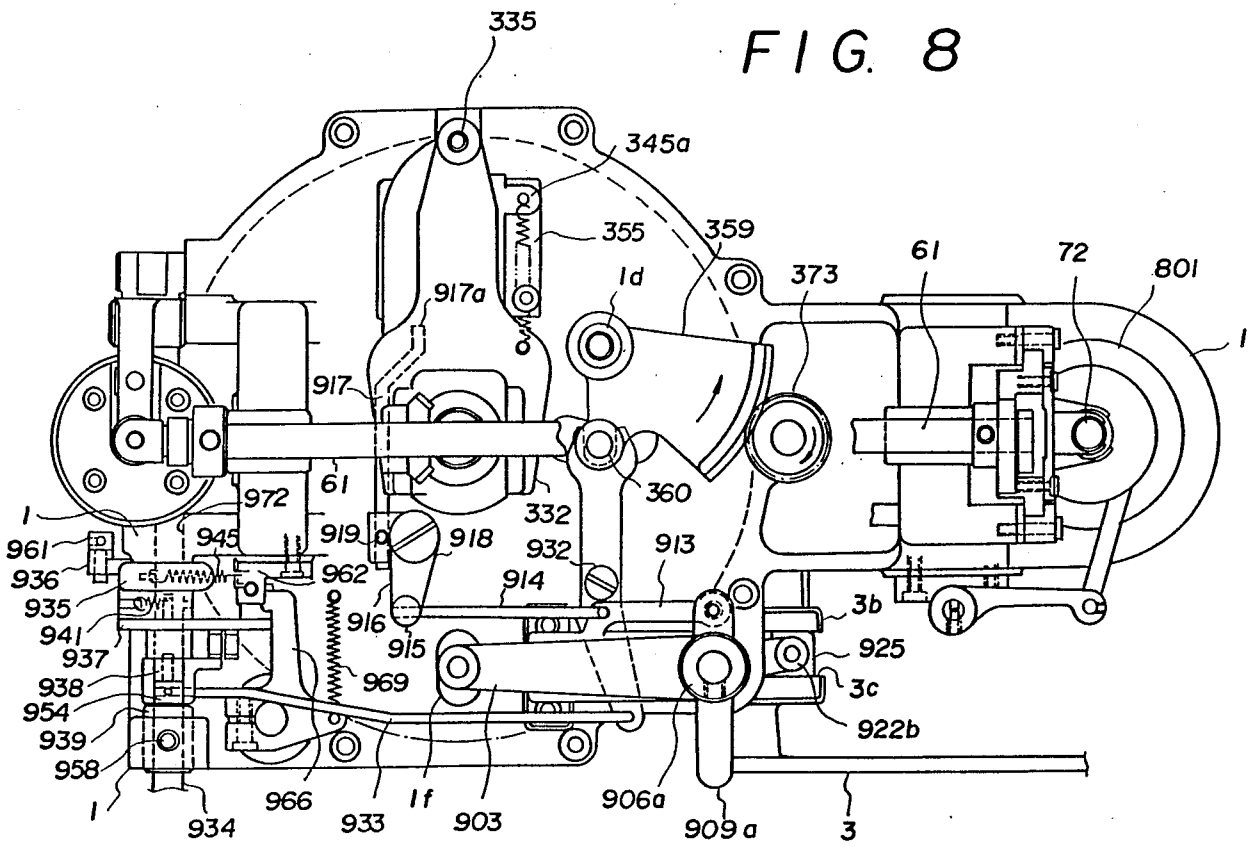
FIG. 8 is a bottom view of a main mechanism of the same sewing machine.
Figure 12B:
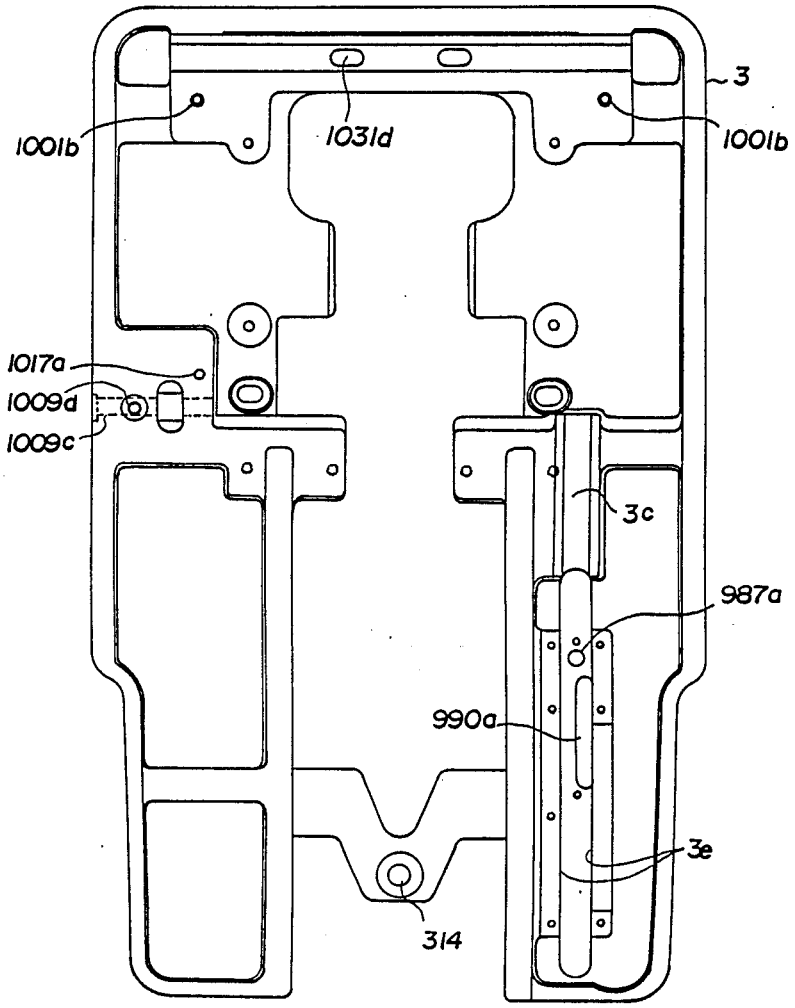

A sector gear driving cam follower 358 (see FIGS. 18 and 2) is fitted with an inner groove cam 323 of a main cam 301 which constitutes a controlling cam mechanism 300. The sector gear driving cam follower 358 is controlled by the main cam 301 and rotatably supported by a sector gear driving roller stud 362 extending through an arc-shaped long hole 1*e* (see FIG. 12) of the bed stand 1. The stud 362 has a threaded portion which is inserted into a mounting hole 360 formed at one side of a cam follower or sector gear wheel 359 and fastened by a nut 361. The sector gear wheel 359 has a support hole 359*a* into which a section gear eccentric bushing 363 is inserted. The sector gear wheel 359 is rotatably supported on the bed stand 1 by a section gear screw 364 provided in a hole 1*d* (see FIGS. 12 and 8) of the bed stand 1. A stitch turning shaft 370 (see FIGS. 18 and 2) driven by the sector gear driving cam follower 358 through the sector gear wheel 359 is pivoted by a turning shaft upper bushing 371 provided on the arm 4 and by a turning shaft lower bushing 372 provided on the bed stand 1. A stitch turning shaft gear 373 is fixed on the shaft 370 at a stopper portion 370*b* by turning shaft gear screw 373*a*. The stitch turning shaft gear 373 engages with a tooth portion 360*a* of the sector gear 359. Back lash is prevented from occurring between the gears 373 and 359 by adjusting the rotation of the sector gear eccentric bushing 363. At the upper and lower portions of the stitch turning shaft 370, a needle turning arm 374*a* and a looper turning arm 374*b* are fixed by associated looper turning arm screws 374*m*, respectively.

In pivot holes 374*c* and 374*d* of the arm 374*a* and pivot holes 49*a* and 49*b* of the needle turning frame 49, parallel quadric crank links 375*a* and 375*b* are respective pivoted by pins 376*a*–376*d*, 377*a*–377*d*, etc., so that the needle bar is turned through the stitch turning shaft 370.

On the other hand, in pivot holes 374*e*–*f* of the arm 374*b* and pivot holes 374*h*–374*i* of a looper turning frame lever 374*g* fixed to the looper frame 801 of the looper and spreader driving means 800, parallel quadric crank links 374*j*–374*k* are pivoted by parallel link hinge screws 378 respectively, so that the looper and spreader are turned synchronously together with the needle turning frame 49 through the stitch turning shaft 370. The frame lever 374*g* is fixed to a lower shaft 802, which is provided on the looper frame 801 of the looper and spreader driving means 800, by a turning frame lever screw 803*a* (see FIGS. 18 and 2).

Figure 25:
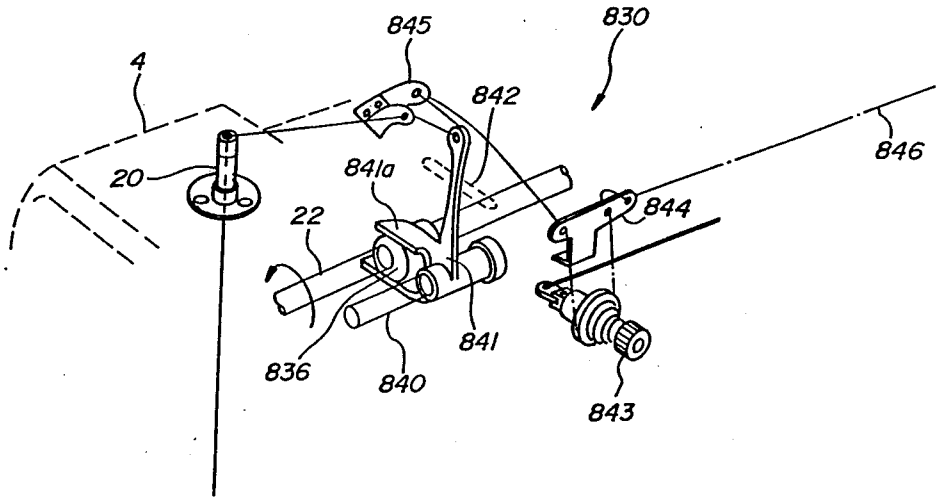
FIG. 25 is a perspective view of the needle bar thread take-up mechanism in the same sewing machine.

Next, a needle thread take-up mechanism 830 (see FIGS. 7*a* and 25) will be explained.

Figure 2:
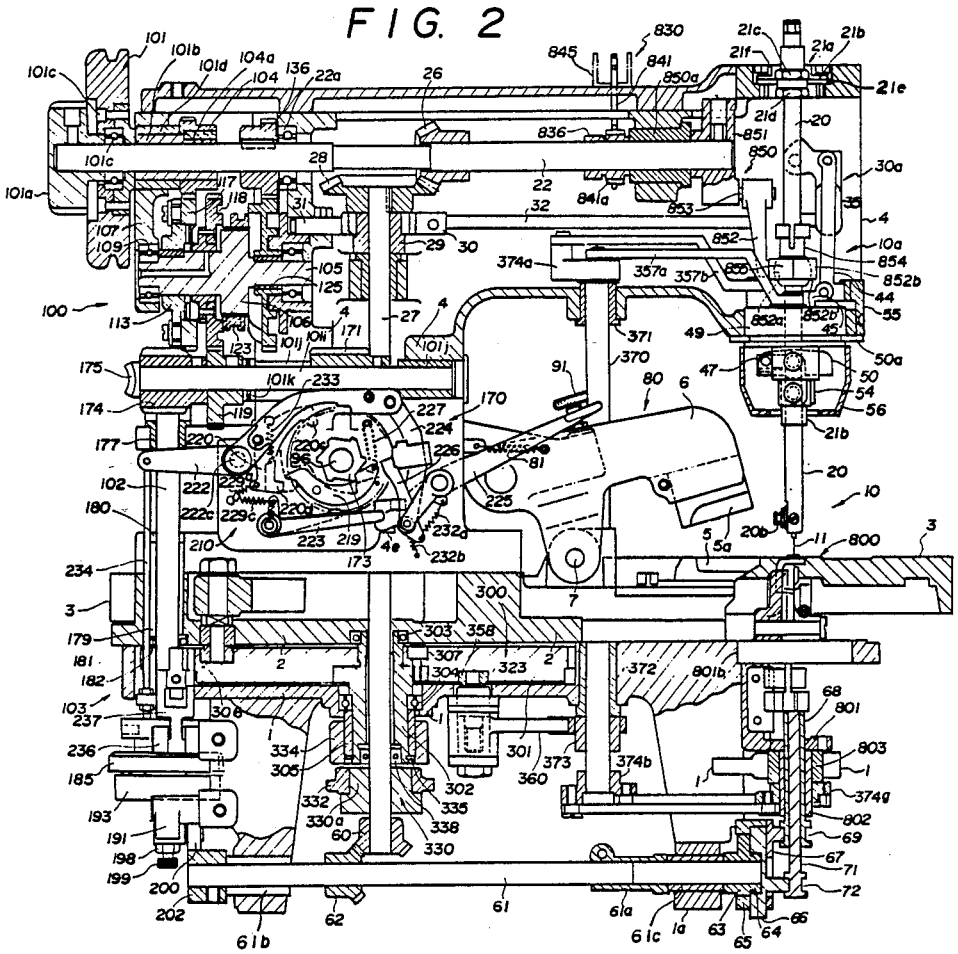
FIG. 2 is a side sectional view of the same sewing machine.
Figure 3:
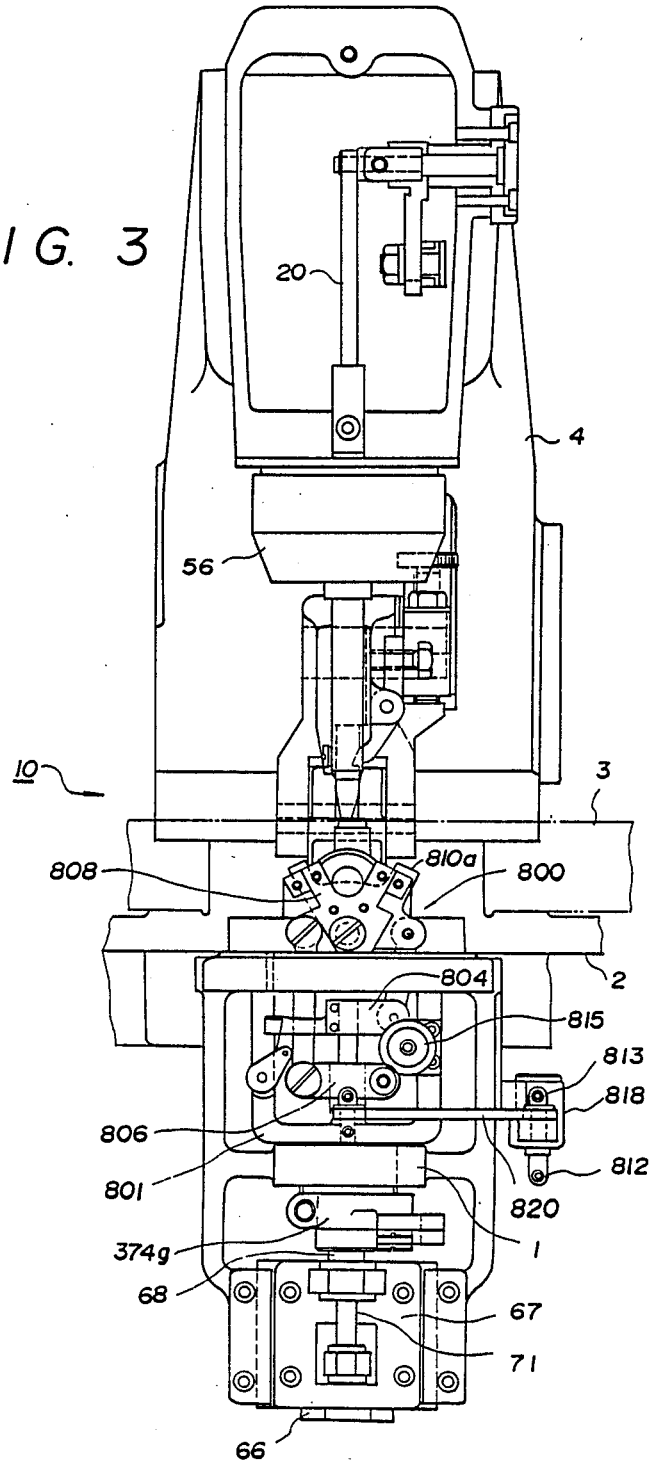
FIG. 3 is a front view of a part of the same sewing machine.

A needle thread take-up eccentric/triangular cam 836 is fixed on the arm shaft 22 (see FIG. 2). A fork 841*a* of a needle thread take-up 841 pivoted on the arm 4 by a thread take-up shaft 840 is engaged with the needle thread take-up eccentric/triangular cam 836, so that the take-up 841 is vibrated in response to the rotation of the arm shaft 22.

A needle thread 846 is drawn from a needle thread guide 844, and returned to the same guide 844 through a tension nut 843, and further drawn to a needle thread hole 22*d* of the needle 11 through a take-up thread guide 845, the needle thread take-up 841, the guide 845 again, a needle bar thread guide cap 20*a* of the needle bar 20 (see FIGS. 5 and 10), and a thread weight 20*b*, successively.

Next, the cutting mechanism 80 (see FIGS. 1, 2, 7*a* and 15) for forming a buttonhole in a work or cloth will be explained.

Figure 6B:
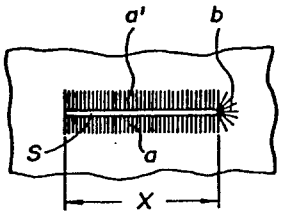
FIGS. 6*a* and 6*b* are explanatory diagrams each showing a buttonhole stitched by the same sewing machine.
Figure 6A:
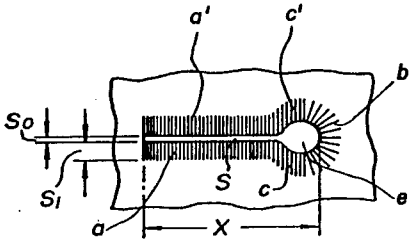

The cutting mechanism is constituted by a cutting knife 5 and a cutting block 5*a* engaged with the former. The cutting knife 5 or 5-1 can be replaced to cut different shapes, that is, eyelet or straight, as shown in FIGS. 6*a* and 6*b*. The cutting knife 5 is removably mounted, by a cutting knife screw 5-2, onto a cutting knife base plate 5*c* fixed on to the bed 2.

A cutting block arm 6 provided with the cutting block 5*a* mounted thereon is pivoted on the bed 2 by a cutting block arm shaft 2.

The arm 6 is elastically urged by a spring 81 in the direction for raising the cutting block 5*a*.

A hook 83 of a cutting block clamp 82 is fitted in a groove 5*a'* and the cutting block clamp 82 is pivoted on a mounting portion of the arm 6 by a cutting block clamp pin 84. The cutting block clamp 82 is fixed to the arm 6 by a cutting block clamp screw 86. A connection pin 90 extends through a hole 87 of the arm 6 and a hole 89 of a cutting block driving lever 88 to provide a pivotal connection between the two. Between the lever 88 and the arm 6, a pressure adjusting means is interposed. The pressure adjusting means includes a cutting pressure adjusting screw 91 threaded into one end of the lever 88, and a stop 92 which the screw 91 contacts. The screw 91 may be replaced by an eccentric cam. A buttonhole cutting cam follower 93 employing a needle bearing is pivoted by a cutting cam follower screw pin 95 at the other end of the lever 88 through a cutting cam roller washer 94. The buttonhole cutting cam follower 93 is engaged with a buttonhole cutting cam 97 fixed on a buttonhole cutting shaft 96 (see FIG. 14) so as to pivotally move the lever 88. Although the above-mentioned embodiment shows the case where the cutting block 5*a* is fixed on the arm 6 and the cutting knife is fixed on the cutting knife base plate 5*c*, these components may be fixed inversely.

Figure 15:
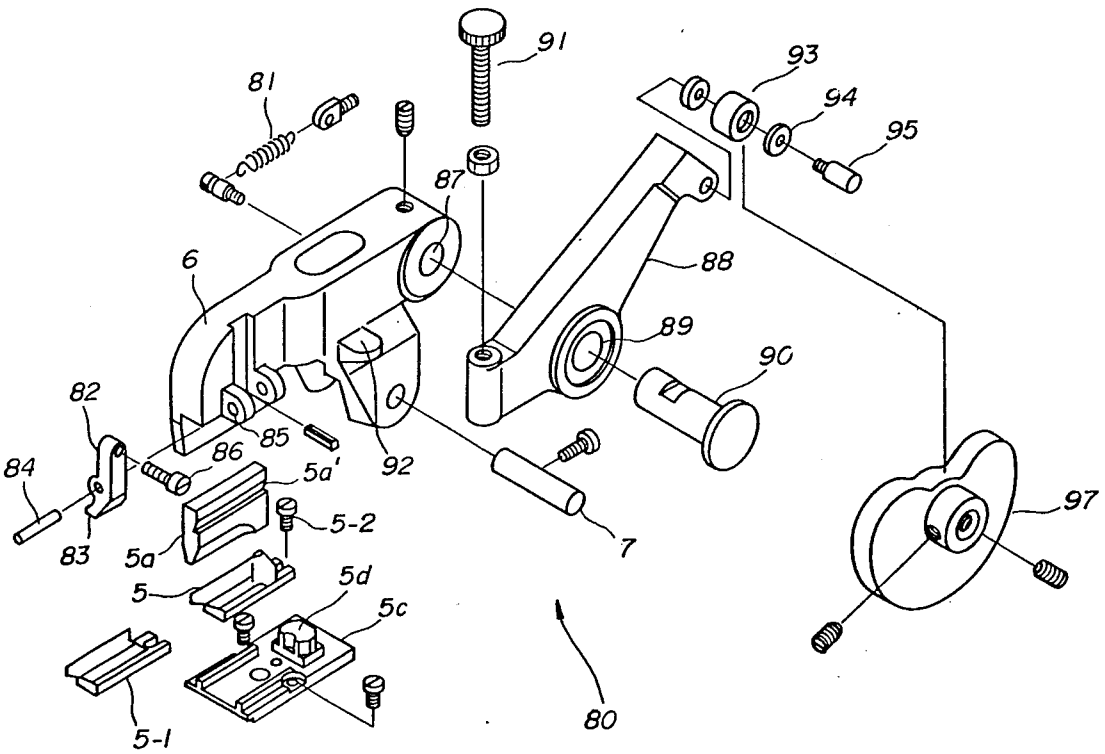
FIGS. 15 and 15*a*–15*b* are explanatory diagrams showing the cutting driving mechanism of the same sewing machine.
Figure 15A:
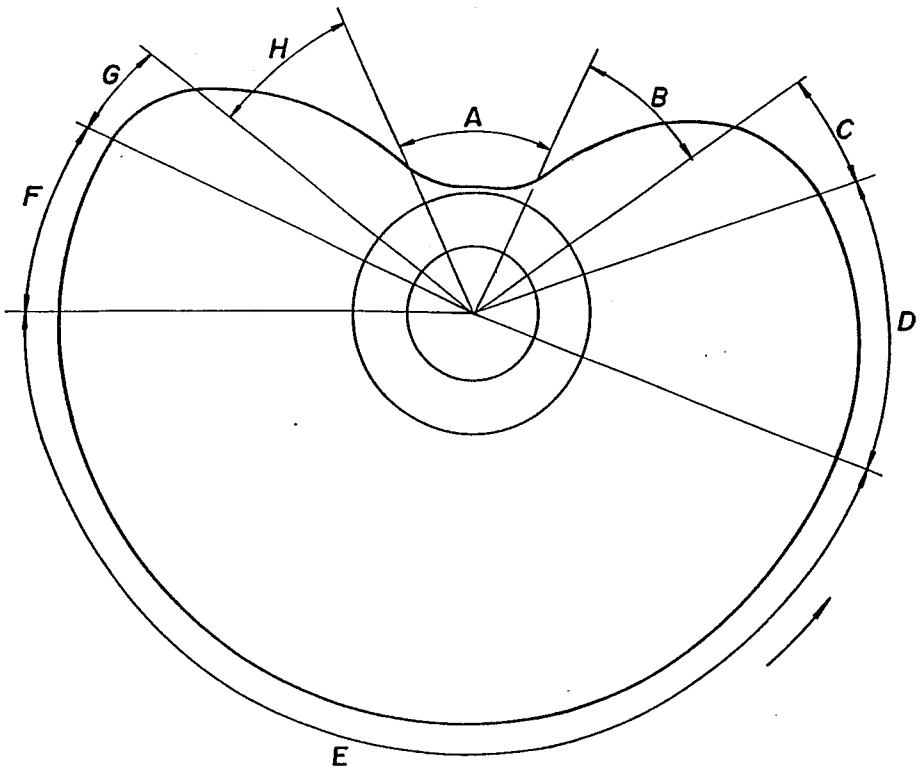

The buttonhole cutting cam 97, as shown in FIG. 15*a*, has a small diameter holdup portion A, a sharply increasing diameter portion B, a sharply decreasing diameter portion H, and a wide-angle portion E. In the wide-angle portion E, the diameter thereof is gradually increased so that a cutter is engaged with a work or cloth to cut it. A transposition portion C and a shift portion D, and a transposition portion G and a shift portion F are continuously interposed between the sharply increasing diameter portion B and the wide-angle portion E, and between the sharply decreasing diameter portion H and the wide-angle portion E, respectively. Thus, a heart-shaped buttonhole cutting cam 97 is formed as shown in FIG. 15*a*.

Figure 15B:
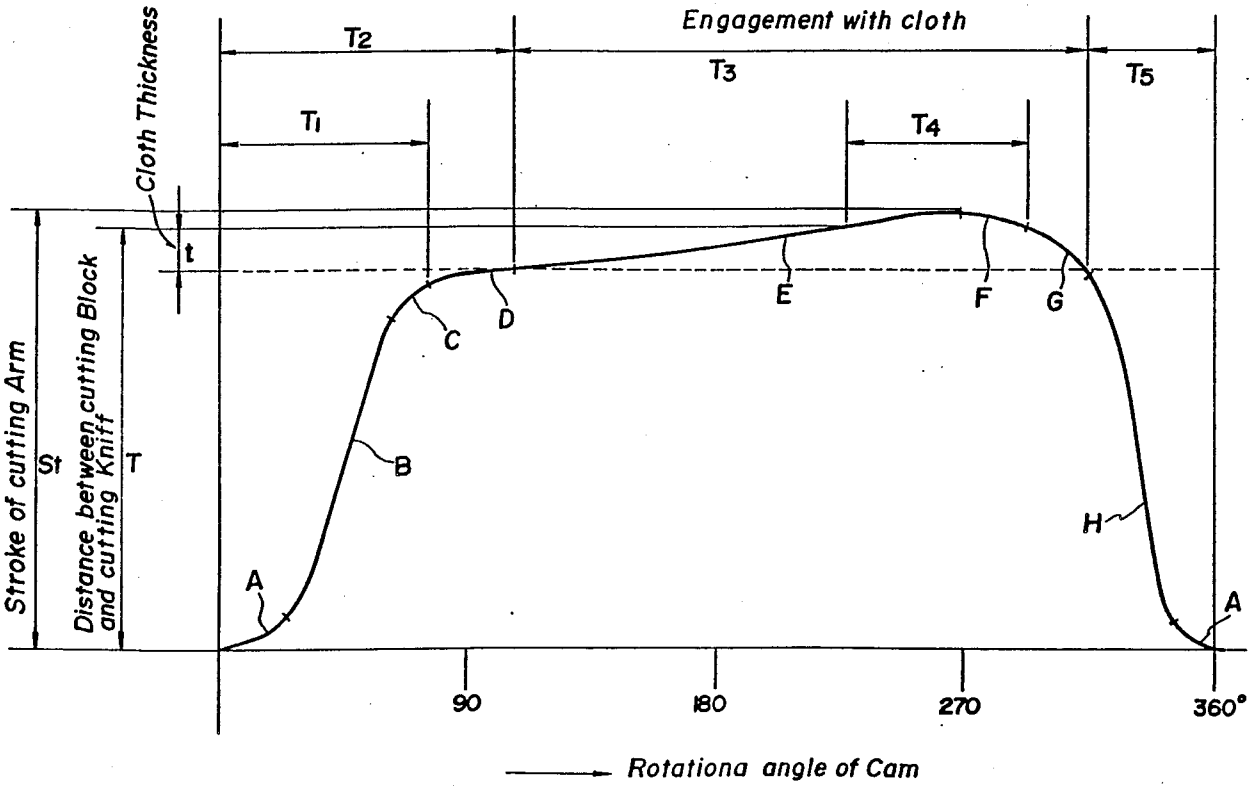

Corresponding to the rotational angle of the cam 97 having these portions A–H, the stroke St of the cutting block arm 6 is as shown in FIG. 15*b*.

Next, power switching clutch mechanism 100 (see FIGS. 2, 4, 7*a*, 13, 13*a* and 13*b*) will be described in detail. In rapid feeding, the clutch mechanism transmits torque, which has been transmitted from a motor M (see FIG. 1) to a driving pulley 101 through a belt B, from the pulley 101 to a rapid feed intermediate shaft 102 so that the work clamp carrier 3 is rapidly fed through rapid feed mechanism 103, and before or after this, the clutch mechanism drives the cutting block 5*a* of the cutting mechanism 80. On the other hand, in stitch feeding, the clutch mechanism transmits the torque to at least one of the arm shaft 22, the vertical shaft 27, and the bed shaft 61, so that the stitch formation is made through the stitch forming device 10. In short, the clutch mechanism transmits/switches torque. Although this description has reference to the case where the torque of the motor is transmitted to the arm shaft 22 in stitch feeding in the illustrated embodiment, the present invention is not limited to this and may be modified so that the torque is transmitted to either the vertical shaft 27 or the bed shaft 61.

Figure 9:
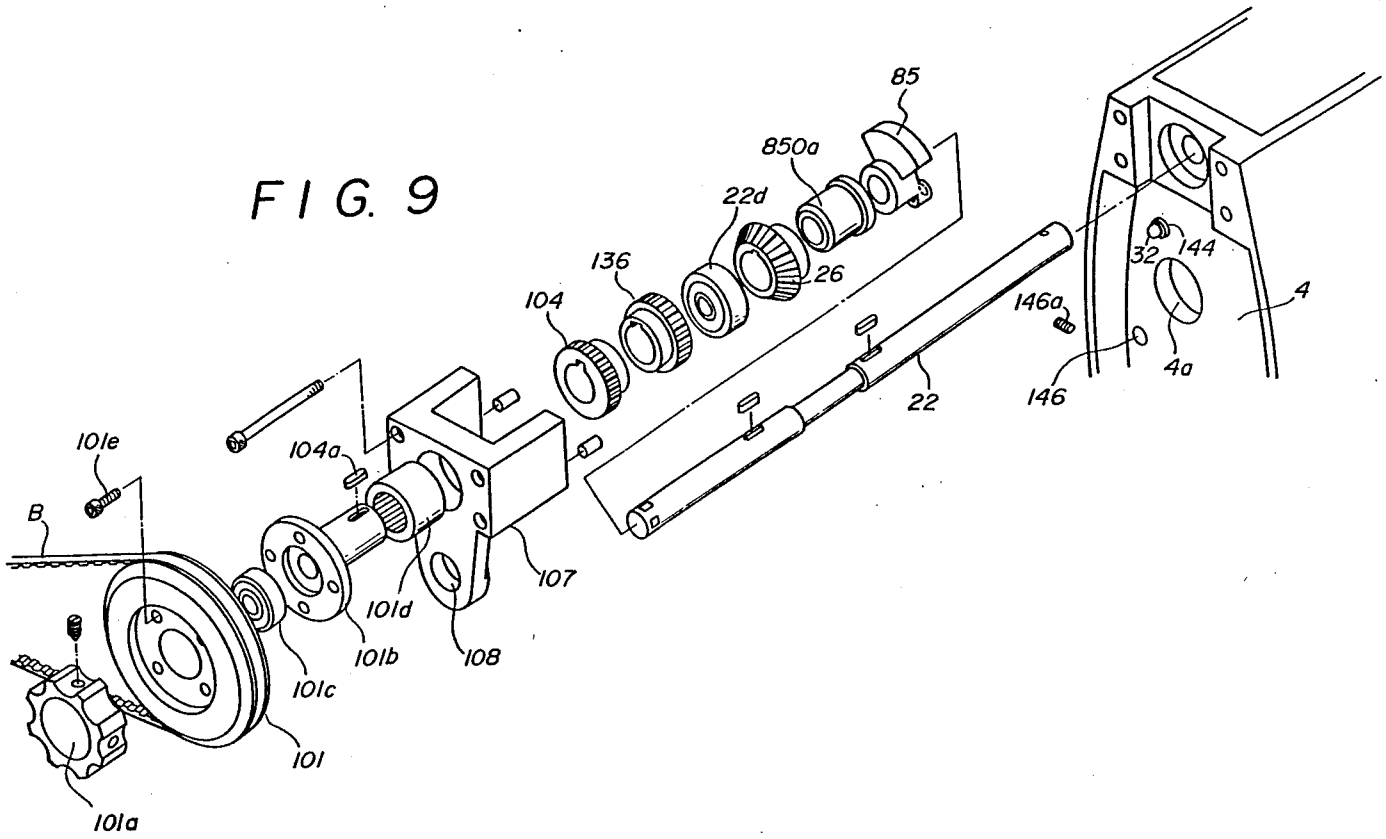
FIG. 9 is an explanatory diagram showing the driving power transmission system of the same sewing machine.

The driving pulley 101 is fixed to a driving pulley connection flange 101*b* by driving pulley screws 101*e* (see FIGS. 2 and 9), and rotates on a bearing 101*c* of the arm shaft 22. The driving pulley connection flange 101*b* is supported on a back frame 107 through a driving shaft bushing 101*d*, and connected to a driving gear 104 by a driving gear key 104*a*.

A clutch shaft 105 having a spline wheel 106 is supported at its one side 105*a* in a hole 108 of the back frame 107 (see FIG. 9) of the arm 4 through a bearing 109, while supported at its other side 105*b* onto a needle bar stop clutch frame 110 fixed on to the arm 4 (see FIGS. 13 and 13*a*) through a bearing 111. A clutch driving gear hub 113 is keyed on the shaft 105*a* by a clutch driving gear hub key 112. The clutch driving gear hub 113 is also fixed to a clutch driving gear 117 through buffer O-rings 114 and buffer O-ring holders 115 by buffer O-ring holder screws 116. By providing the buffer O-rings in such a manner as described above, a buffer device for the motor and the clutch shaft 105 is formed for absorbing shocks when a clutch ring shifter 123 is shifted as described later. Onto a rapid feed engagement/locking portion 118 adapted to be engaged/-locked on the clutch ring shifter 123, a rapid feed clutch gear hub 119*a* is fixed by rapid feed clutch gear screws 120 and interposed between the clutch driving gear 117 and the spline wheel 106. The rapid feed engagement-/locking portion 118 is urged against one side 106*a* of the spline wheel 106 by a thrust bearing 121 and a wave washer 122. Teeth (not shown but similar to teeth shown on the portion 128) are formed on the rapid feed portion 118 at its one side abutting on the clutch ring shifter 123, so as to engage with teeth 123*b* of the clutch ring shifter 123. Thus, driving power is transmitted from the motor M to the clutch shaft 105 through the driving pulley 101, the driving gear 104, and the clutch driving gear 117.

Internal splines of the clutch ring shifter 123 are slidably coupled with the splines 106 of the clutch shaft 105. Teeth 123*b* are formed on the clutch ring shifter 123 at its opposite sides.

Figure 20:
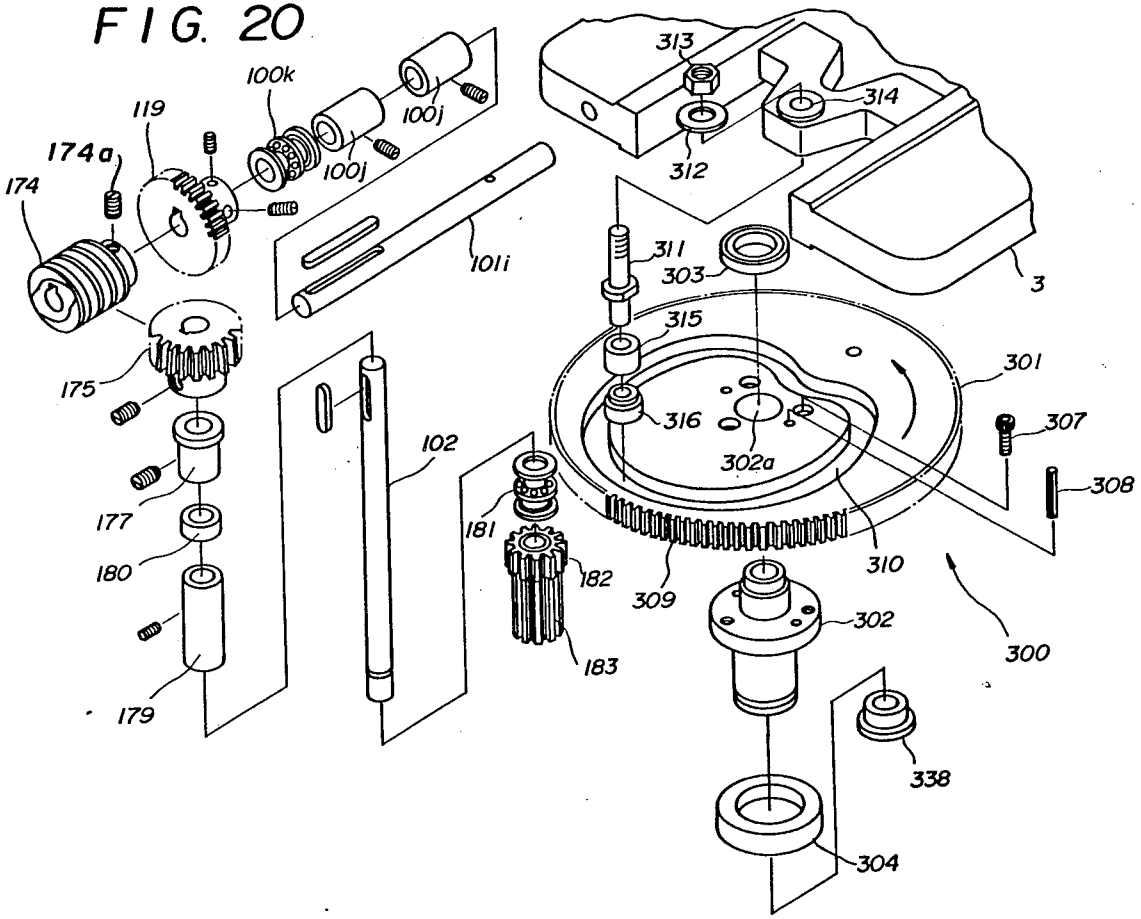
FIG. 20 is an exploded perspective view of the control cam mechanism in the same sewing machine.

The rapid feed engagement/locking portion 118 is engaged with a rapid feed gear 119 (see FIG. 20) functioning as a rapid feed driving portion for driving the rapid feed intermediate shaft 102, so as to drive a rapid feed shaft 101*i*. The shaft 101*i* is fixed to a cutting shaft driving worm 171 (see FIGS. 4 and 14) by a driving worm socket screw 171*a*. The cutting shaft driving worm 171 is engaged with a cutting shaft worm wheel 172 (see FIGS. 4 and 14). The cutting shaft worm wheel 172 is fixed onto a cutting shaft driving ratchet 173 by driving ratchet screws 173*a* (see FIG. 14).

The rapid feed shaft 101*i* is supported on the arm 4 by a pair of intermediate shaft bushings 100*j* and compensates for thrust received from the worm means 171 and 172 by means of a thrust bearing 100*k*.

The rapid feed drive includes rapid feed shaft driving worm 174 (see FIG. 20) which is fixed onto the shaft 101*i* at its one end by a screw 174*a*. The rapid feed shaft driving worm 174 is engaged with a rapid feed shaft worm wheel 175 fixed on the rapid feed intermediate shaft 102 at the top end thereof.

Returning to FIG. 13, arm shaft driving gear 124 functioning as a stitch feed driving portion (described later) is press-inserted onto the clutch shaft 105 at its end 105*b* through an arm shaft driving one-way clutch 125 which has the same function as a main cam driving one-way clutch 305 shown in FIG. 22. That is, an arm shaft one-way clutch is provided between the clutch shaft 105 and the stitch feed driving portion. Arc-shaped elongated grooves 126 are formed in the arm shaft driving gear 124, and a side control cam 127 is projected from the Kear 124 at the outer periphery thereof. An arm shaft teeth stitch feed engagement-/locking portion 128 is journaled on the shaft 105*b*, so as to be engagement-locked on the clutch ring 123. Protrusions (not shown) are provided on the portion 128 at its side facing the arm shaft driving gear 124, the protrusions corresponding to the respective elongated grooves 126 but being shorter than the depth of the latter. The protrusions are loosely inserted into the respective elongated grooves 126 and attached to a release cam 129 by arm shaft brake cam screws 130. An arm shaft brake cam spring 131 is interposed between each of stopper holes 132 of the portion 128 and a corresponding one of brake cam spring screws 133 provided in screw holes 134 of the arm shaft driving gear 124, so as to elastically urge the arm driving clutch ring 128 in the direction of arrow 135. However, the protrusions loosely inserted into the corresponding respective elongated grooves 126 abut against the respective ends of the grooves 126 so that the portion 128 is prevented from further rotating so as to be at a standstill.

The arm shaft driving gear 124 is engaged with an arm shaft gear 136 (see FIGS. 8 and 13) fixedly mounted on the arm shaft 22.

The stitch feed driving mechanism includes the engagement/locking portion 128 connected to the arm shaft driving gear 124 and the arm shaft gear 138 engaged with the gear 124. The gear ratio of the arm shaft driving gear 124 to the arm shaft gear 136 is 1 to 2. That is, the revolution ratio of the clutch shaft 106 to the arm shaft 22 is 1 to 2.

At the outer circumference of a stop position cam 137 (see FIGS. 13, 13*a* and 13*b*) of the needle bar stop clutch frame 110, there are formed recess portions 140 for radially inward displacing shaft brake cam rollers 139 at top portions 138 of the recess portions respectively, each of the recess portions 140 being continued to the next top point 138 through a gently curved portion 141. The radius of each of the recess portions 140 is substantially equal to the radius of each of the arm shaft brake cam rollers 139. In the inner circumference of the release cam 129 connected to the stitch feed engagement-/locking portion 128, hollows 142 are formed corresponding to the recess portions 140, so as to allow the arm shaft brake cam rollers 139 to escape radially outward. Arc-shaped protrusions 143 for pressing the shaft brake cam rollers 139 are formed on the arm shaft driving gear 124 at its side facing the release cam 129. The elongated grooves 126 and the protrusions loosely inserted into the former constitute a rotation limit means which allows the stitch feed engagement/locking portion 128 and the release cam 129 to rotate within a predetermined range relative to the stitch feed driving mechanism.

The clutch frame 110, in particular, the stop position cam 137 is fixed to the arm 4 by inserting the boss 110*a* thereof into the hole 4*a* of the arm 4 (see FIG. 9) and by inserting the needle vibrating rod 32, which is provided with a buffer O-ring 144 on the arm 4, into the hole 110*b* thereof. In the clutch frame 110, a stop position cam spring 137*a* is provided between the clutch frame 110 and a spring suspension 137*b*, so as to constitute a buffer device for absorbing shocks when the needle bar is stopped, in cooperation with the buffer O-ring 144.

A clutch shifter fork actuator 148 to be fitted in grooves 123*a* of the clutch shifter 123 is supported on a sliding fork shaft 147 mounted in a hole 146 (see FIG. 9) of the arm 4 by a stop screw 146*a*. A clutch driving control 150 and a rapid feed clutch control 151 are successively supported onto the boss 149 of the clutch shifter fork actuator 148, and a C-ring 152 pressed into a ring groove 153 prevents the link 150 and the arm 151 from falling away. The clutch driving link 150 is operated after the setting of buttonhole length by a buttonhole length adjusting mechanism 974 (described later). The rapid feed clutch arm 151 is adapted to be engaged with the control cam 127. A sliding fork spring 155 is interposed between the clutch actuator 148 and a sliding fork spring stopper 154 fixed to the end of the sliding fork shaft 147 by a spring stopper screw 153, so that the clutch actuator 148 is elastically urged toward the stitch feed engagement/locking mechanism 128. A clutch driving link spring 157 is provided (see FIGS. 4 and 13) between a clutch driving link stud pin 156 of the clutch driving link 150 and a bracket 158 of the rapid feed clutch arm 151. A clutch driving rod 159 is connected to the top end of the clutch driving link 150 by a clutch driving rod collar 160. An abutting portion 161 is provided on the clutch driving link 150 so that the portion 161 abuts on the bracket 158 of the rapid feed clutch arm 151 when the link 150 is rotated by the rod 159 clockwise in the drawing, so as to rotate the arm 151 in the same direction. Faces 162, 163 and 164 are formed at the end portion of the rapid feed clutch arm 151, such that the faces 162 and 163 are respectively in slide-contact with a radially extending and an extending 127*a* and 127*b* of the control cam 127 of the arm shaft driving gear 124, and the face 164 is engaged with the clutch actuator 148.

These mechanical elements make up a timing device for providing the timing for the clutch ring shifter 123 disengage from the stitch feed engagement/locking mechanism 128 in response to the setting of buttonhole length by the buttonhole length adjusting mechanism 974 so as to cause the needle bar 20 driven by the arm shaft 22 to stop at a predetermined stop position. The operations of the device will be described later.

A hand wheel 101*a* is fixed on the arm shaft 22 such that when the needle bar 20 is in the stop position and not in the top dead point, the arm shaft 22 may be clockwise rotated together with the driving pulley 101 by the hand wheel 101*a* so as to cause the clutch mechanism 100 to release.

Figure 19:
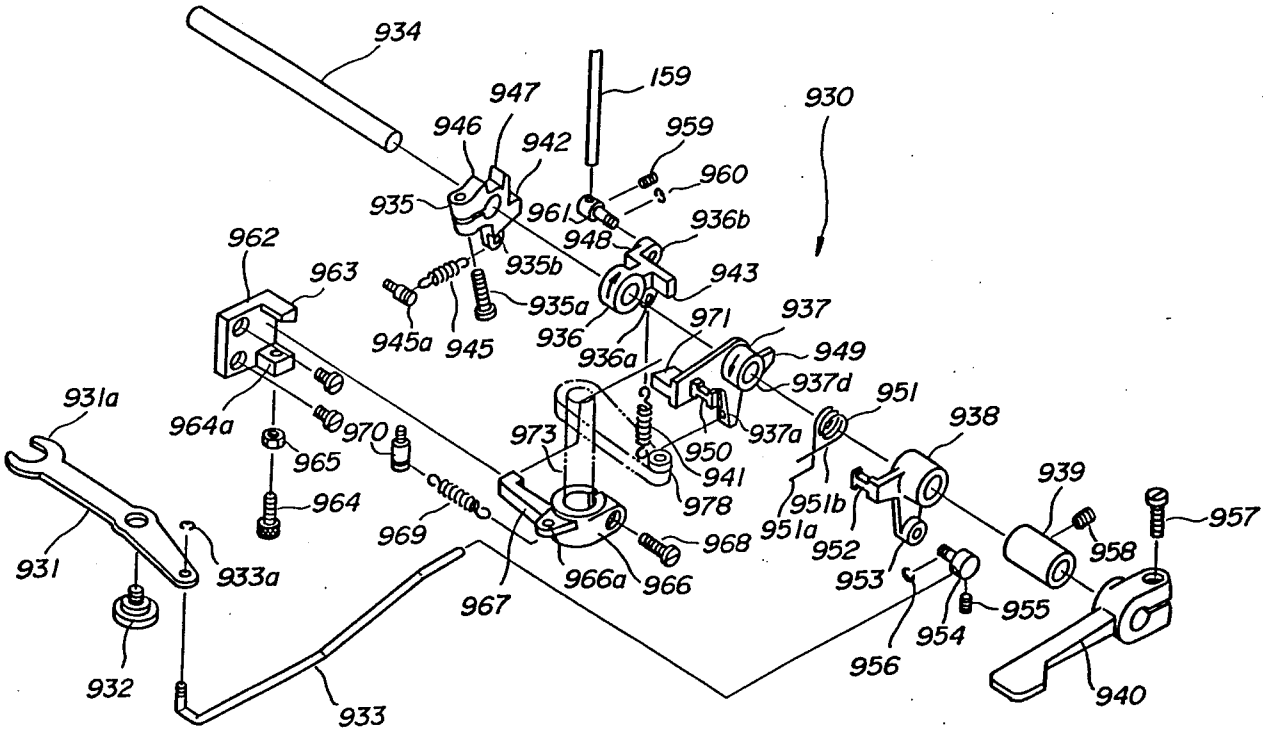
FIG. 19 is an exploded perspective view of the clutch driving device in the same sewing machine.

Next, a clutch driving device 930 (see FIGS. 7*a* and 19) for the clutch mechanism 100 will be described.

The clutch driving device 930 is for driving the clutch mechanism 100 within one pitch stitch feed in response to the setting of buttonhole length by the buttonhole length adjusting mechanism 974 when changeover is made between the rapid feeding and the stitch feeding, by a bias driving force stored in the control cam mechanism 300 during at least one of the respective periods of the rapid feeding and the stitch feeding. This operation will be described in detail hereunder.

A fork 931*a* provided at an end of a spring compress lever 931 pivoted onto the bed stand 1 by a compress lever hinge screw 932 (see FIGS. 8 and 19) is fitted into a ring groove 362*a* (see FIG. 18) of the sector gear driving roller stud 362 in the stitch turning mechanism 370*a*. The spring compress lever 931 is pivotally attached at its other onto a spring compress rod 933 by a snap ring 933*a*.

A control shaft 934 has one end supported by a bearing 972 (see FIG. 8) of the bed stand 1 and the other end supported in a control shaft bushing 939 which is fixed to the bed stand 1 by a control shaft bushing screw 958. A control shaft lever 935 is fixed onto the one end side of the control shaft 934 by a control shaft lever screw 935*a* (see FIG. 19). A control shaft lever spring 945 is stretched between a portion 935*b* of the control shaft lever 935 and a suspension screw 945*a* fitted in the bed stand 1, so that a stopper 946 of the lever 935 abuts onto a pin 946*a* (see FIG. 4) planted in the bed stand 1 so as to prevent further rotation. Returning to FIG. 19, a clutch control lever 936, a control switch arm 937, and an arm 938 shown rotatably mounted onto the control shaft 934 between the control shaft lever 935 and the control shaft bushing 939. A clutch control lever spring 941 is stretched between a portion 936*a* of the clutch control lever 936 and a portion 937*a* of the control switch arm 937, so that the bottom of a bracket 948 of the clutch control lever 936 abuts onto a seated portion 942 of the control shaft lever 935 so as to be prevented from further rotating, and on the other hand, a protrusion 949 of the control switch arm 937 abuts onto a protrusion 943 of the clutch control lever 936 so as to be prevented from further rotating.

A clutch driving rod connection 961 is fitted in another portion 936*b* of the clutch control lever 936 by a snap ring 960, and the bottom of the clutch driving rod 150 (see FIGS. 19 and 13) is fixed to the clutch driving rod connection 961. A control switch arm spring 951 is wound about a hub 937*d* of the control switch arm 937, and the free ends 951*a* and 951*b* of the control switch arm spring 951 are changed between a free condition as shown in FIG. 19*a* and a compressive condition as shown in FIG. 19*b* such that an outward and an inward protrusion 950 and 952 of the arms 937 and 938 respectively are sandwiched between the free ends 951*a* and 951*b* (see FIG. 19*c*).

The spring 951 serves as a bidirectionally biasing spring means in which an elastic force is stored for the control cam mechanism 300 to change-over the mode from the rapid feeding to the stitch feeding, or reversely from the stitch feeding to the rapid feeding, for the respective periods of the rapid feeding and the stitch feeding.

A spring compress rod connection 954 is attached to a portion 953 of the arm 938 by a snap ring 956, and one end of the spring compress rod 933 is attached to the spring compress rod connection 954 by a spring compress rod screw 955.

An arm 967 of a switch trigger lever 966 is engagement-locked onto an abutting portion 971 of the control switch arm 937. A switch trigger lever spring 969 is stretched between a portion 966*a* of the switch trigger lever 966 and a suspension screw 970 fitted in the bed stand 1 so as to bias the switch trigger lever 966 clockwise in FIG. 19. The abutting portion 971 of the control switch arm 937 is inserted between a protrusion 963 of a control limit plate 962 and a screw 964 threaded into a nut 965 and a female screw 964*a*, so that the motion thereof is limited within a predetermined range. These mechanical elements make up a releasing means for releasing the stored elastic force in response to the detection of buttonhole length by the buttonhole length adjusting mechanism 974 so as to drive the clutch mechanism 100 to change-over the mode between rapid feeding and stitch feeding. A quick return lever 940 to be manually operated as a clutch device is fixed at the other end of the control shaft 934 by a quick return lever screw 957 and interposed between the clutch driving device 930 and the clutch mechanism 100. The lever 940 makes up a manually operated clutch driving device for urgent mode change-over of the clutch mechanism 100 in an emergency. Actions of these mechanisms and device will be described later in detail.

The control cam mechanism 300 includes a disc main cam 301 (see FIG. 20) which is mounted in a cam receptacle 1*b* formed in bed stand 1 (see FIG. 12), and covered with the bed 2. The main cam 301 has a main cam shaft 302 fitted into a shaft hole 302*a* thereof and fixed by main cam screws 307 and main cam position pins 308. The shaft 302 is supported by main cam shaft bearings 303 and 304 which are provided on the bed 2 and in a hole 1*c* (see FIG. 12) of the bed stand 1 respectively.

A rapid feed spur gear 309 is formed in the outer circumference of the cam 301 and is engaged with a main cam driving gear 182 (see FIGS. 20 and 26) fitted on the rapid feed shaft 102.

Figure 20A:
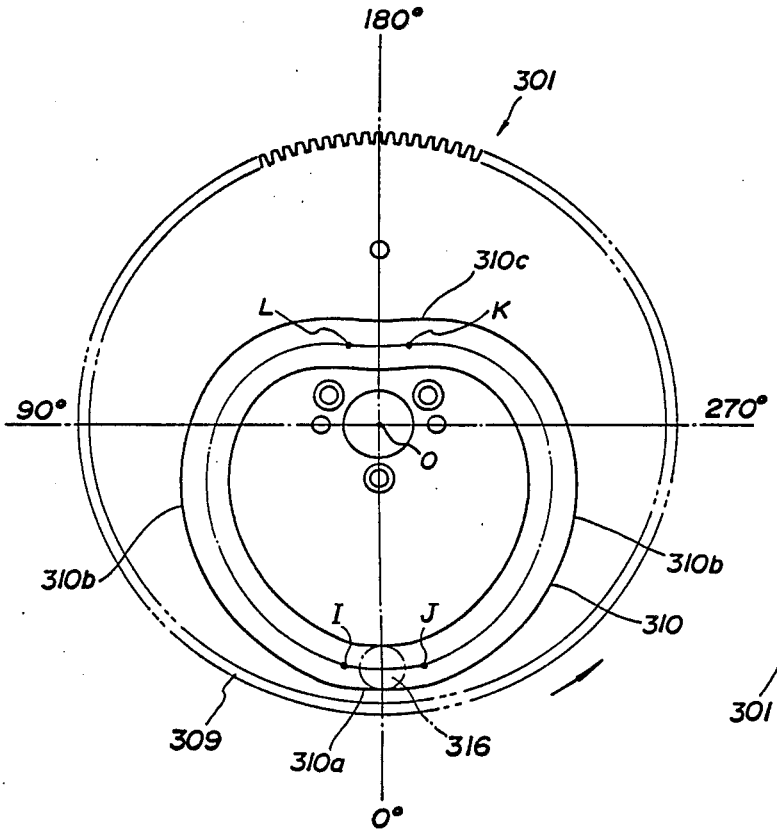
FIGS. 20*a*–20*c* are explanatory diagrams of the main cam used in the same control cam mechanism.

A work clamp carrier groove cam 310 is formed on the upper face of the cam 301 to feed the work clamp carrier 3. In the work clamp carrier S, a work clamp carrier roller shaft 311 is fixed in a mounting hole 314 formed at the rear end portion of the work clamp carrier 3 by a washer 312 and a nut 313. Mounted on the work clamp carrier roller shaft 311 are a work clamp carrier guide cam follower 315 and a work clamp carrier cam follower 316. The work clamp carrier guide cam follower 315 is fitted in a straight guide 317 (see FIG. 12) of the bed 2 to prevent the work clamp carrier 3 from feeding across in a feed motion and to permit its straight motion. On the other hand, the work clamp carrier cam follower 316 is fitted in the work clamp carrier groove cam 310 of the cam 301 to feed the work clamp carrier 3. The groove cam 310 (see FIG. 20*a*) has straight portion (stop position) 310*a* for arresting the feed of the work clamp carrier 3 over a predetermined range, for example as shown in the drawing, including the position where the work clamp carrier 3 is stopped by a stop cam 325; a nonuniform motion zone (feeding of an eyelet portion) 310*c* disposed at the radially opposite the side with respect to the straight cam groove portion and extending from a point K to a point L; and a uniform motion zone (feeding of a slit and offset portion) interposed between the uniform diameter cam portion and the nonuniform motion zone.

Figure 20C:
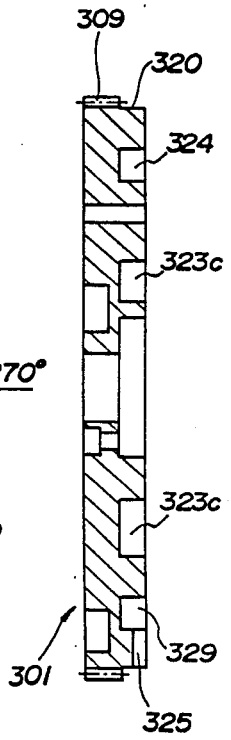
Figure 20B:
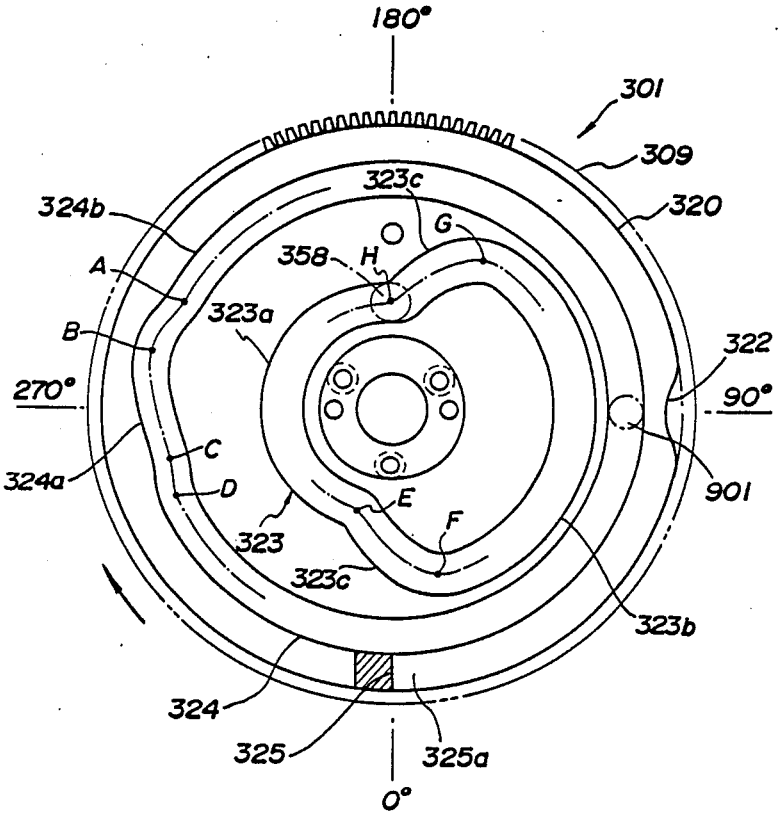

On the lower surface of the cam 301 (see FIG. 20*b*), provided are a stitch length adjusting external cam 322 formed so as to be radially inward recessed in a tooth-absent portion 320 in the outer circumference of the cam 301 and for controlling a stitch length adjusting portion 330*e* in a stepping driving portion 330*b* (described later with reference to FIG. 22), an inner groove cam 323 for turning the needle bar and looper, and an outer groove cam 324 for feeding across the work clamp carrier 3 to thereby form an offset portion of an eyelet. The stop cam 325 (see FIGS. 4, 20*b* and 20*c*) is formed so as to be recessed in the direction of cam thickness in the cam tooth-absent portion 320 of the main cam 301. The stop cam 325 is deep less than the groove cam 324. The stop cam 325 controls a mode change-over mechanism 210 (described later in detail) which performs engagement/disengagement between a driving portion linked with the intermediate shaft 102 of the rapid feed mechanism 103 and a driven portion for operating the cutting means 80 upon completion of one cycle of the stitch forming and the rapid feeding, and the stop cam 325 cuts off a driving power transmission system 103 of the rapid feed mechanism 103. The groove cam 323 is constituted by a small uniform diameter section 323*a* extending from a point H to a point E, a large uniform diameter section 323*b* extending from a point F to a point G, and a displacement section 323*c* for rotation interposed between the sections 323*a* and 323*b*. On the other hand, the groove cam 324 comprises a generally gentle s-shaped displacement section 324*a*, and a uniform diameter section 324*b* succeeding the section 324*a*. Angles 0, 90, 180 and 270 degrees as shown in FIG. 20*b* are taken synchronously corresponding to angles shown in FIG. 20*a*, respectively.

The vertical shaft 27 extends through the center 0 of the main cam 301.

Next, the rapid feeding mechanism 103 for the work clamp carrier 3, the stitch feeding mechanism 330, and an intermittent braking mechanism 187 for stitch feeding will be explained hereunder (see FIGS. 7*a*, 20, 22, 22*a*, 26, 26*a*, 26*b* and 26*c*).

Figure 26:
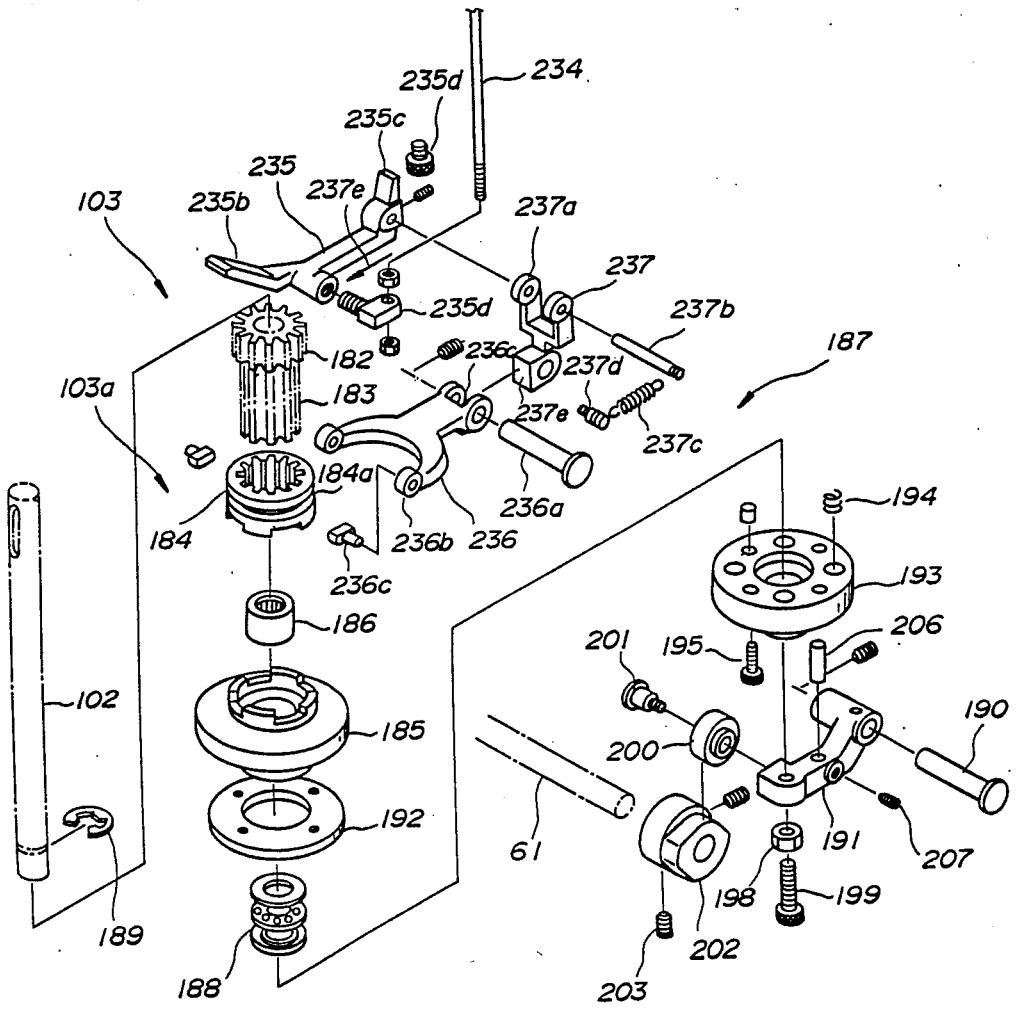
FIG. 26 is an exploded perspective view showing the intermittent braking mechanism for the rapid feeding mechanism and the stitch feeding mechanism in the same sewing machine.

As shown in FIG. 26, sewing machine according to the present invention has a driving section 185 provided on the rapid feed intermediate shaft 102 through a one-way clutch 186, a driven section 182 for transmitting the driving section 185 to the control cam mechanism 300 through a change-over clutch 184, a disc brake section 193 capable of frictionally engaging the driving section 185, a brake control cam 202 fixed to the bed shaft 61, and a brake control cam follower 200 slidable on the brake control cam 202 to urge the disc brake section 193 against the driving section 185.

In rapid feeding, the clutch 184 is connected to the driving section 185 in accordance with the command from a mode changeover mechanism 210, which will be described later, so as to form a rapid feed transmission system 103*a* which leads to the control cam mechanism 300 through the intermediate shaft 102, the rapid feed shaft one-way clutch 186, the driving section 185 the clutch 184, and the main cam driving gear 182. In stitch forming, the clutch 184 is connected to the driving section 185, so as to form an intermittent brake system (mechanism) 187 which leads to the control cam mechanism 300 the the bed shaft 61, the brake control cam 202, the brake control cam follower 200, the main cam brake section 193, the driving section 185, the change-over clutch 184, and the main cam driving gear 182, during the period when the needle 11 is engaged with a workpiece.

In detail, the rapid feed shaft 102 has an upper end supported in a hole 17*b* (see FIG. 12) of the arm 4 by a rapid feed shaft upper bushing 177 and a lower end supported in a hole 178 of the bed 2 by a rapid feed lower bushing 179. The reference numeral 180 designates a rapid feed shaft oil reservoir made of felt (see FIG. 20). A thrust bearing 181 suspended on the bed is fitted onto the lower end of the rapid feed shaft 102. Abutting on the bearing 181, the main cam driving gear 182 is rotatably mounted onto the shaft 102. Splines 183 are integrally formed with the main cam driving gear 182. The splines 183 are coupled with splines of the change-over clutch 184 (see FIG. 26) so as to make the clutch 184 engageable with the driving section 185. The rapid feed shaft one-way clutch 188 having the same function as the main cam driving one-way clutch 305 is pressed into the inside of the driving section 185, so that the clutch 188 rotates as the shaft 102 rotates and races when the shaft 102 does not rotate.

Figures 26A, 26B, 26C:
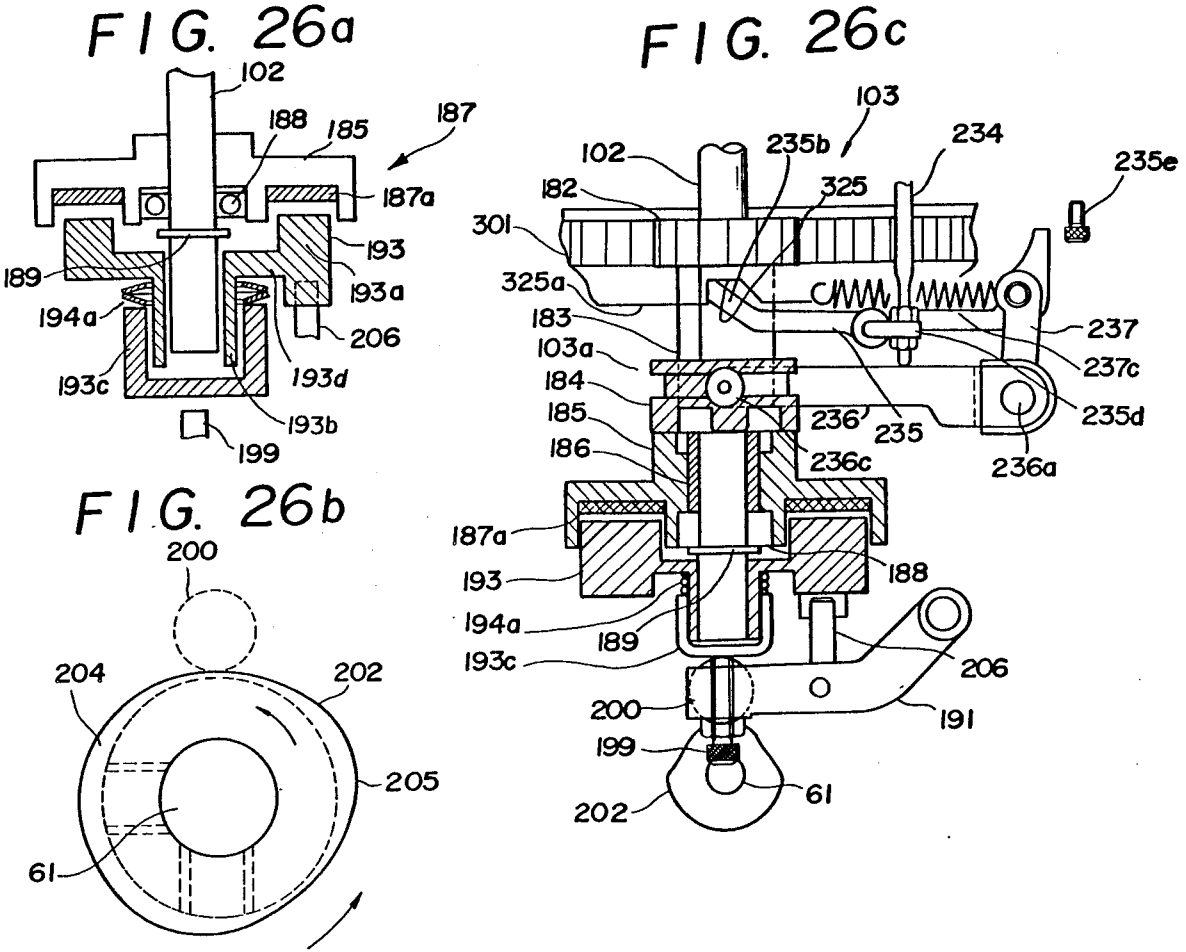
FIGS. 26*a*–26*c* are explanatory diagrams of the same intermittent braking mechanism.

Referring to FIGS. 26 and 26*c*, main cam start/stop lever 235 is connected to the mode change-over mechanism 210 and the rapid feed transmission system 103*a* through a main cam start/stop lever rod 234, so as to be slidable on the stop cam 325 of the main cam 301. A recovery member 235*e* comprising for example a limiting screw is adapted to be in slidable contact with the lever 235 so as to separate the lever from the main cam 301 in response to the rotation of the main cam 301 after the lever is engaged by the stop cam 325 to cut off the driving power transmission for the mode change-over and the rapid feeding. That is, the rod 234 is connected to the lever 235 through the stop lever rod connection 235*d*. One end 235*b* of the lever 235 can be engaged by on the stop cam 325 (see FIG. 20*b*). A rapid feed clutch driving fork 236, together with a main cam stop lever link 237, is pivoted on the bed stand 1 by a driving fork shaft 236*a* and a fork portion 238*b* thereof is fitted into a link groove 184*a* of the rapid feed clutch ring 181 through rapid feed clutch driving blocks 236*c*. The other end 235*c* of the lever 235 and a suspension screw 237*d* of the main cam stop lever link 237 are pivotally connected to each other by a pin 237*a*, and a main cam stop lever shaft 237*b* is elastically urged in the direction of an arrow 237*e* by a main cam stop lever spring 237*c* which is stretched between the pin 237*b* and the suspension screw 237*d* provided on the bed stand 1.

The driving power transmission system 103*a* is combined with the intermittent brake mechanism 187. The intermittent brake mechanism 187 releases the control cam mechanism 300 from braking for every stitch feeding operation by the stitch feeding mechanism 330, and brakes the control cam mechanism 187 during the period when the needle 11 is engaged with a work or cloth by the vertically reciprocating mechanism 850. In detail, a brake lining member 187*a* (see FIG. 4) is stuck onto a ring-like recess portion in the lower surface of the driving section 185. Moreover, a thrust bearing 188 is fittingly mounted on the shaft 102 and prevented from dropping out by an E-shaped snap ring 189.

Figure 4:
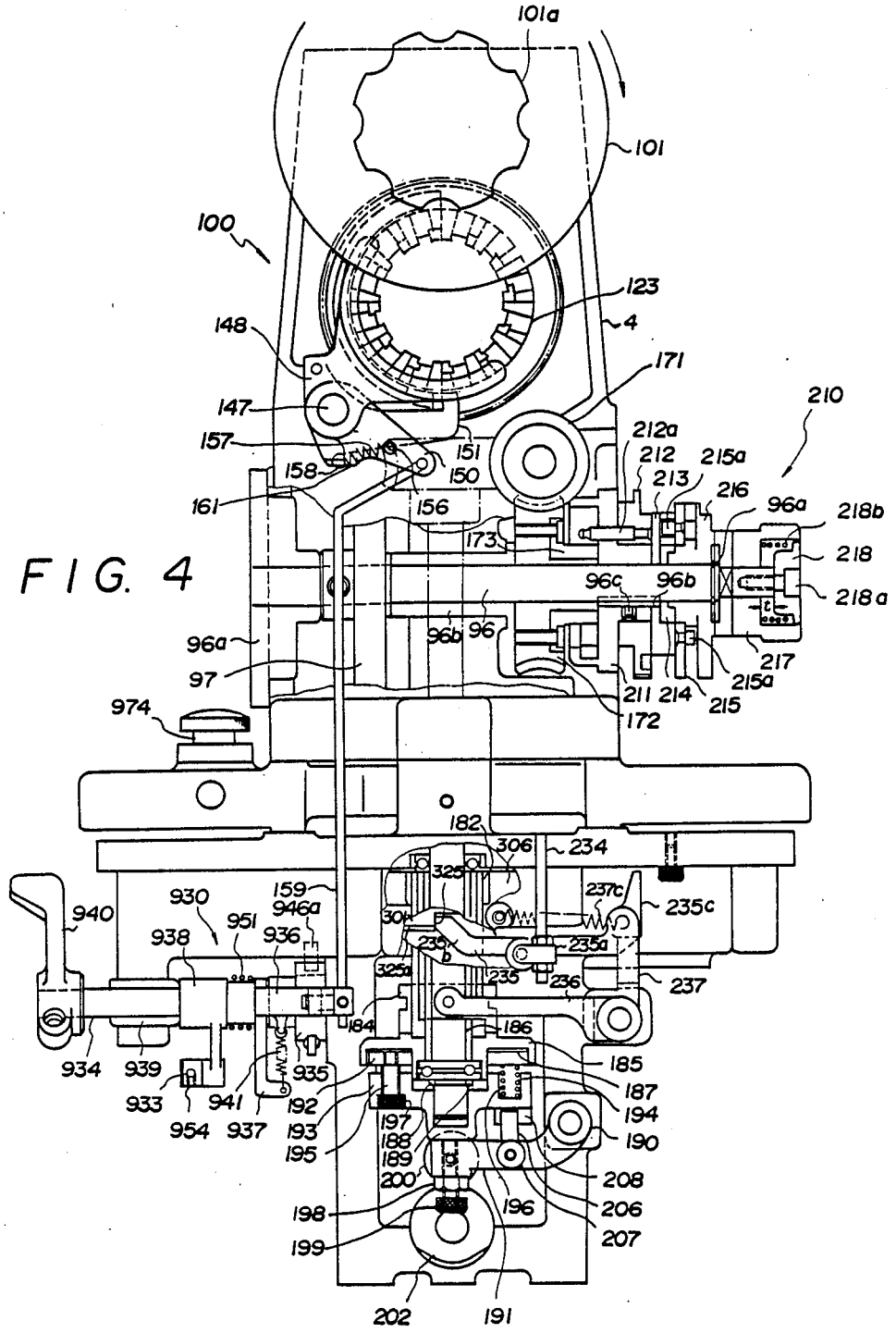
FIG. 4 is a partly cut-away rear view of the same sewing machine.
Figure 5:
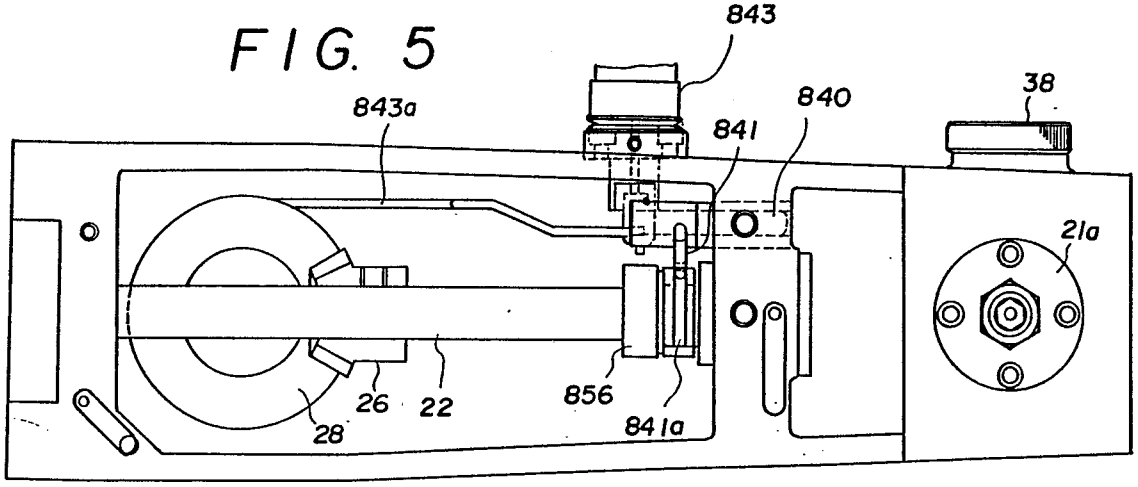
FIG. 5 is a top view of the same sewing machine.

A brake control lever 191 is pivoted at its one end on the bed stand 1 by a brake control lever shaft 190 (see FIGS. 4 and 26). A main cam brake pad 102 is provided to slide on the lining member 187*a* and is elastically urged by brake disc springs 194 each having one end suspended on a spot facing 198 of the main cam disc brake section 193. The main cam brake pad 192 is fixed by a screw 195 with its head fitted into a spot facing 197 of the main cam brake section 193.

A brake adjusting screw 199 is provided at the other end of the lever 191 through a nut 198, such that the screw 199 can abut on the lower portion of the main cam brake disc 193. Moreover, the control cam follower 200 is pivoted on the other end of the lever 191 by a brake cam follower hinge screw 201. On the other hand, the brake control cam 202 engaging with the control cam follower 200 is fixed on the bed shaft 61 (see FIGS. 2, 11 and 26) by brake control cam screws 203. The brake control cam 202 has such a shape as shown in FIG. 26*b* and the cam 202 includes a thrust-up portion 204 having an angle of about 180 degrees and a short thrust-up portion 205 provided radially opposite to the portion 204. A brake disc pin 206 is fixed on the lever 191 by a brake cam disc pin screw 207 (see FIGS. 4 and 26). The pin 206 is inserted into a fork groove 208 of the disc brake section 193.

Alternatively, the brake section 187 may be arranged in such a manner as follows without using the main cam brake pad 192, the brake disc springs 194 or the screw 195 shown in FIGS. 4 and 26. That is, as shown in FIG. 28*a*, the main disc brake section 193 is constituted by an enlarged diameter section 193*a* adapted to abut on the brake lining member 187*a*, a reduced diameter section 193*b* surrounding the shaft 102, and a cover section 193*c* surrounding the reduced diameter section 193*b*; and a pressure-expansion washer 194*a* is interposed between the cover section 193*c* and a radially extending portion 193*d* of the disc brake section 193.

The stitch feeding mechanism 330 has a driving power transmission system 330*c* for causing the main cam 301 to step by transmitting power thereto, through a step driving section 330*b*, from the vertical shaft 27 extending through the center of the disc-like main cam 301 included in the control cam mechanism 300. The step driving section 330*b* is constituted by a feeding cam 830*a* fixedly mounted on the vertical shaft 27, a driving lever 332 swung by the feeding cam 330*a* about a slidably mounted slider 354 as a pivotal point, a driven lever 334 pivoted on the driving lever 332 for driving the main cam 301 to step through the one-way clutch 305, and a stitch length adjuster 349 making the position of the slider 354 changeable. In detail, the feeding cam (triangular mom) 330*a* (see FIGS. 2, 22, 22*a* and 22*b*) is fixedly mounted on the vertical shaft 27 by a cam screw 331. One end of the driving lever 332, that is, a fork portion 333 is fitted onto the cam 330*a*. A swinging power point 334*a* of the driven lever 334 is rotatably pivoted on the feed driving lever 332 at the other end thereof by a main cam driving lever shaft 335 and a nut 336. The main cam driving one-way clutch 305 (see FIGS. 22, 22*a*, 22*b* and 2) is pressed into a hole 334*b* of the main cam driven lever 334, and the main cam shaft 302 is set in the main cam driving one-way clutch 305 with a C-ring for preventing the cam shaft 302 from coming off. The reference numeral designates a vertical shaft bearing for supporting the vertical shaft 27 (see FIGS. 2 and 20) and fixed to the main cam shaft 302 as described above. An adjusting bracket guide 339 is fixed on to the bed stand 1 through adjusting bracket guide plates 340 by guide plate screws 341. A stitch length adjusting bracket 343 is slidably fitted in a guide block 342 constituted by the adjusting bracket guide 339 and the adjusting bracket guide plates 340. A stitch length adjusting block 344 is fitted in a block groove 343*c* of the stitch length adjusting bracket 343, and a block pin 347 of the stitch length adjusting block 344 is loosely fitted in an elongated hole 348 of a stitch length adjusting plate 345. The stitch length adjusting plate 345 is fixed to a salient 343*d* of the bracket 349 by adjusting plate screws 348. A stitch length screw adjuster 349 passes through a U-shaped groove 350 of the plate 345 and is fitted in a female screw 351 of the block 344. A ring groove 349*a* of the stitch length adjusting screw 349 is fitted to the U-groove 350 of the stitch length adjusting plate 345 and thereby unable to move even when rotated. An adjusting screw lock spring 352, fixed on the stitch length adjusting plate 345 by adjusting screw lcck spring screws 353, abuts on an angular portion 349*b* of the screw 350 to prevent the screw 349 from being loosed by vibrations. The block pin 347 is fitted to the slider 354 which is slidably mounted in a groove 332*b* formed by a guide 332*a* provided on the driving lever 332. The spring 355 has one end attached to the stitch length adjusting plate 345 and the other end attached to the bed stand 1 (see FIGS. 22 and 8).

A stitch reduce cam follower 356 is pivoted on the bracket 343 by a stitch reduce roller pin 357 and a stitch reduce roller pin screw 358 is to the slider 354 through the stitch length adjusting block 344. The stitch reduce cam follower 356 abuts the stitch number adjusting outer peripheral cam 322 (see FIGS. 20*b* and 20*c*) of the tooth-absent portion 320 of the cam 301 used its form a portion of stitches surrounding a button-hole. Thus, in the step driving section 330*b*, the stitch length adjusting mechanism 330*d* for changing the number of stitches encircling a button-hole over the whole is constituted by the stitch length adjuster 349, the stitch length adjusting block 344, the slider 354, the driving lever 332, and the groove 332*b*. In the stitch number adjusting mechanism 359*d*, the stitch number adjuster 330*e* for changing the number of stitches in part, for example, in the case of an eyelet e (see FIG. 6*a*), is constituted by the stitch number adjusting outer peripheral cam 322 of the tooth absent portion 320 of the cam 301, the stitch reduce cam follower 356, the adjusting bracket guide 339, and the stitch length adjusting bracket 343.

Next, an eyelet-straight change-over mechanism 900 will be explained (see FIGS. 23 and 7*a*).

This mechanism functions to change over the operation mode between the eyelet stitching mode (see FIG. 6*a*) while feeding across the work clamp carrier 3 and the straight stitching mode see FIG. 6*b*) without feeding across the same.

Generally, the eyelet-straight change-over mechanism 900 has a feed across driving clutch lever 903 having a feed across cam follower 901 controlled by the main cam 901 included in the control cam mechanism 300, a feed across driven arm 922 for causing the feed across driving lever 903 to feed across the work clamp carrier 3 through a feed across connection latch 911, and a manually operated lever 909*a* for actuating the latch 911. The manually operated lever 909*a* is linked with the stitch number adjuster 330*e* in the step driving section 330*b* of the stitch feeding mechanism 330. That is, the eyelet-straight change-over mechanism 900 is linked with the stitch number adjuster 330*e* by the manually operated lever 909*a* through connection means such as a stitch reduce connection rod 914 and a stitch reduce rod 917. The connection means is provided with a stitch reduce adjusting portion 914*c*. These will be described in more detail hereunder.

Figure 8A:
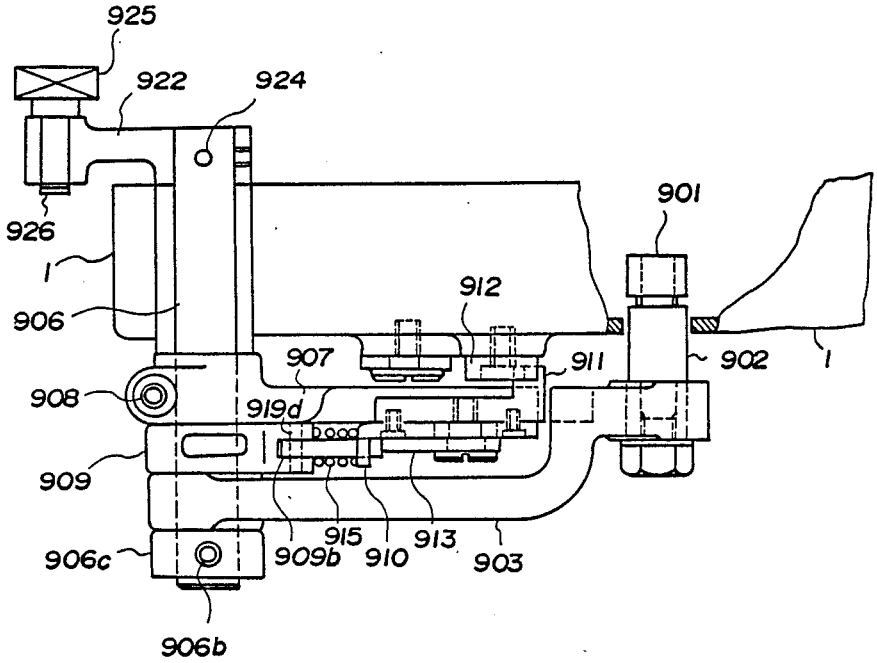
FIG. 8*a* is a schematic side view showing an eyelet-straight change-over mechanism of the same sewing machine.

The feed across cam follower 901 (see FIGS. 23 and 8*a*) is fitted into the groove cam 324 (see FIG. 20*b*) of the cam 301. The feed across cam follower 901 is pivotally attached to a feed across cam follower stud 902 extending through the long hole if (see FIG. 12) of the bed stand 1. The feed across cam follower stud 902 is fixed to a mounting hole 904 in one end of the feed across driving lever 903 by a nut 905. A feed across driving arm shaft 906 is supported on the bed stand 1 through a feed across driving arm bushing 906*a*. Another end hole 903*a* of the feed across driving lever 903 and an eyelet-straight change-over lever 909 having the manually operated lever 909*a* are rotatably mounted on the feed across driving shaft 906. A feed across connection lever 907 and a driving arm shaft collar 906*c* are fixed on the shaft 906 by a connection lever screw 908 and driving arm shaft collar screws 906*b* respectively. An outer hole 909*b* of the eyelet-straight change-over lever 909 is connected to a spring holder 916*c* through a spring holder pin 919*d*, and the spring holder 916*c* is loosely inserted in a hole 10*b* of a connection lever plate 910 with a change-over lever spring 915 coiled on the spring holder 916*c*. The plate 910 is mounted onto the upper portion of the feed across connection lever 907 by connection lever plate screws 910*a*. On the other hand a change-over lever link 913 has one end 913*a* pivotally connected through another outer hole 909*c* of the eyelet-straight change-over lever 909 by a hinge screw 913*a* and another end 913*b* fixed to the feed across connection latch 911 through an elongated hole 910*c* of the connection lever plate 910 by a connection latch hinge screw 913*e*. The feed across connection latch 911 is arranged to be slidable along a guide formed by a latch groove 907*a* of the feed across connection lever 907 and the connection lever plate 910. The feed across connection latch 911 is selectively fitted in a groove 912*a* of a work clamp carrier settle plate 912 fixed to the bed stand 1 and a connection groove 903*b* near the mounting hole 904 of the feed across driving lever 003 in accordance with the sliding of the latch 911. One end of the rod 914 which is a connection means to the stitch number adjusting portion 330*e* in the feed driving portion 330*b* of the feed driving mechanism 330, is pivoted on to a portion 913*c* of the change-over lever link 913 by an E-shaped snap ring 14*a*. The rod 914 is fixed by a connection rod screw 920 of a stitch reduce crank connection 915. The stitch reduce crank connection 915 is fitted in a portion 916*a* of a stitch reduce crank 915 by an E-shaped snap ring 921. The connection means has the stitch number adjusting section 914*c*. That is, the stitch reduce crank 916 is fitted to an eccentric 914*d* and pivoted to the bed stand 1 by a stitch reduce crank hinge pin 918. The reference numeral 914*e* designates a screw which adjusts eccentricity of the eccentric 914*d* together with a stitch reduce adjusting plate 914*f* and thereby adjusts the number of stitches. The stitch reduce rod 917 constituting the connection means is fixed at another portion 916*b* of he stitch reduce crank connection 915 by a stitch reduce rod screw 919. When a free end 917*a* see FIGS. 8 and 23) of the stitch reduce rod 917 is moved in the direction of an arrow 917*b*, it is engages a rear end 343*b* of the stitch length adjusting bracket 843 (see FIG. 22) of the stitch number adjuster 330*e* in the feed driving portion 330*b* of the stitch feeding mechanism 330 pulled in the direction of an arrow 343*a* by the adjusting bracket spring 355 to stop moving. When the free end 917*a* is moved in the direction of an arrow 917*c* is released from the rear end 343*b* and permitted to move in the direction of the arrow 343*a*. The feed across driving arm 922 is pressed into the upper portion of the the feed across driving arm shaft 908, and a driving arm position pin 922*a* is pressed into a hole 924 of the feed across driving arm shaft 906. Thus, the arm 922 is fixed onto the shaft 906. A feed across driving arm block 925 is supported at a portion 922*b* of the arm 922 by a snap ring 926 (see FIGS. 8 and 23). The feed across driving arm block 925 is fitted in a guide groove 3*c* formed by two protrusions 3*b* provided on the rear side of the work clamp carrier 3.

Next, the buttonhole length adjusting mechanism 974 will be explained (see FIGS. 1, 7*a*, 21, 21*a* 21*b* and 21*c*).

The mechanism is provided to adjust the buttonhole length (see FIGS. 6*a* and 6*b*) to a desired value. In short, the buttonhole length adjusting and clutch releasing mechanism 974 has a trigger movable member 980 having a control cam 981 which is disposed on the work clamp carrier 3 to control start and end for the formation of stitches and being able to move within an adjustable range, a first screw adjuster 986 provided to adjust the range, and a trigger cam follower 978 adapted to be fitted to the cam and to operate the clutch mechanism 100 which functions to change-over the mode between the rapid feeding one and the stitch feeding one. This will be described in detail hereunder.

The switch trigger lever 988 in the clutch driving device 930 for driving the clutch mechanism 100 is fixed to a switch trigger lever shaft 973 in the buttonhole length adjusting mechanism 974 by a switch trigger lever screw 968. The shaft 973 is pivoted by a trigger lever shaft bushing 975 supported by the bed stand 1 and the bed 2 through holes 1*d* and 2*d* respectively. The trigger lever shaft bushing 975 is fixed to the bed stand 1 by a trigger lever shaft bushing screw 975*a*. A buttonhole length adjusting block 982, on which a buttonhole length indicator 990 is fixed by a buttonhole length indicator screw 990*a*, is slidably fitted into a guide groove 3*e* of the work clamp carrier 3. The trigger movable member 980 is loosely inserted into a groove 983 formed by two protrusions 982*a* and 982*b* of the button-hole length adjusting block 882, the member 980 being provided with the control cam 981 projecting from the member 980 and controlling the start time and the end time for the stitch forming. The trigger member 980 is movable within a range adjusted by the first stitch screw adjuster 988 in the groove 983. By screwing the first stitch adjusting screw 986 to a protrusion 982*c*, the range in the groove 983 can be changed, that is it is possible to adjust the position of the trigger member 980. A sleeve nut 985 is threaded to the first stitch screw adjuster 988 and prevents the screw from being loosed. A buttonhole length scale plate 988 having a scale 988*a* is stuck on the work clamp carrier 3 by scale plate screws 988*b*. A buttonhole length adjusting nut 987 having its head fitted in the guide groove 3*e* extends through an elongated groove 984 at one end of the buttonhole length adjusting block 982 and a hole 988*c* of the buttonhole length scale plate 988, and it is fitted to a buttonhole length set screw 989. The buttonhole length adjusting block 982, the trigger member 980, the buttonhole length adjusting nut 987 are held by a cover plate 983*a* mounted onto the rear surface of the work clamp carrier 3 by cover plate screws 983*b*. The control cam 981 of the trigger member 980 is adapted to be fitted to the switch trigger cam follower 978 pivoted onto a swing end of a switch trigger cam roller arm 978 by the trigger cam roller hinge screw 979, and it actuates the clutch mechanism 100 which functions to change-over the mode between the rapid feeding and the stitch forming. The fulcrum of the trigger cam follower arm 976 is locked on the switch trigger lever shaft 973 by the switch trigger lever pin 977. The shaft 977 is biased clockwise in FIG. 21 by the elastic force of the switch trigger lever spring 989, so that the trigger cam follower 978 is engages to a side edge 983*c* of the cover plate 983*a* in a normal condition.

Next, the mode change-over mechanism 210 will be explained (see FIGS. 2, 4, 7*a*, 14, and 14*a*–14*q*).

The mode change-over mechanism ls provided for making the cutting mechanism 80 to be operative or inoperative at a proper time in selecting the operation mode among so-called before-cut (cutting a buttonhole in a work or cloth before stitches are formed), after-cut (cutting a buttonhole in a work or cloth after stitches are formed), cut-only cutting a buttonhole in a work or cloth), and no-cut (forming stitches on a work or cloth).

Basically, the mode change-over mechanism 210 is arranged to perform the connection/disconnection between a driving portion, that is, the combination of the cutting shaft worm wheel 172 and the cutting shaft driving ratchet 173 engaged with each other, linked with the rapid feed intermediate shaft 102 through the rapid feed shaft worm wheel 175, the rapid feed shaft driving worm 174, the intermediate shaft 101*i* and the cutting shaft driving worm 171, and a driven portion for actuating the cutting mechanism 80, that is, the buttonhole cutting shaft 96. The mode change-over mechanism 210 includes a change-over mechanism which times the connection/disconnection in accordance with the command from the stop cam 325 of the control cam mechanism 300. The change-over mechanism is provided with: a clutch means interposed between the driving portion and the driven portion for performing the connection/disconnection therebetween, that is, a buttonhole cutting clutch wheel 211, a cutting control cam disc 212, a buttonhole cutting clutch hook 219(pawl), and a cutting clutch cutoff lever 220; a mode change-over control unit, that is, a buttonhole cutting mode cam 216 and a buttonhole cutting mode dial 217, capable of variably selecting one of relative positions with respect to the driven portion and alternatively selectively forming various modes of operations and sequences of the cutting mechanism 80 and/or the rapid feed mechanism 103 corresponding to the relative positions; and a mode change-over means, that is, the cutting control cam disc 212, a main cam control arm 222, and a cutting shaft stop arm 223, for actuating the clutch means, the cutting mechanism 80, and/or the rapid feed mechanism 103 according to the mode corresponding to the selected position in the mode change-over unit.

In detail, the mode change-over mechanism 210, in an embodiment illustrated has the driving portions 172 and 173 linked with the rapid feed shaft 102 of the rapid feed mechanism 103, the driven portion 96 for actuating the cutting mechanism 80, the buttonhole cutting clutch wheel 211 connected to the driven portion, the cutting control cam disc 212 mounted on the buttonhole cutting clutch wheel to be rotatable within a predetermined range, a cutting control cam spring 228 interposed between the buttonhole cutting clutch wheel 211 and the cutting control cam disc, a buttonhole cutting clutch clutch hook 219 for performing connection/disconnection between the buttonhole cutting clutch wheel 211 to the driving portion 96 through the cutting clutch cutoff lever 220 from the cutting control cam disc 212, a clutch hook spring 227 for biasing the buttonhole cutting clutch hook toward the connecting position, the cutting shaft stop arm 223 for actuating the cutting control cam disc, the buttonhole cutting mode cam 216, a control plate driving stud **215*b* and a protrusion 215 *d* engaged with the buttonhole cutting mode cam, a control plate counter spring 230 for biasing the cutting control cam disc to the state wherein the protrusion is spaced apart from the cutting shaft stop arm, a starting cam 214 to be moved by the buttonhole cutting mode cam, the buttonhole cutting mode dial 217 for selecting the relative position of the buttonhole cutting mode cam with respect to the driven portion, and the main cam control arm 222 and a cutting starter lever 224 for connecting the cutting shaft stop arm to the control cam mechanism 300**.

The driving portion and the clutch means are respectively constituted by a ratchet and a hook pivoted on the buttonhole cutting clutch wheel.

In the before-cut mode, the buttonhole cutting mode cam is positioned as to enable the control plate driving stud of the cutting control cam disc to abut on a starting lever plate 226, to enable the starting cam to radially outward advance; and to enable the cutting starter lever 224 to be disjoined from the cutting shaft stop arm 223. On the other hand, in the after-cut mode, the buttonhole cutting mode cam has a shape as to enable the starting lever plate to be disjoined from the control plate driving stud of the cutting control cam disc; to enable the starting lever plate to abut on the cutting starter lever 224; to enable the cutting starter lever 224 to engage with the cutting shaft stop arm 223; and to enable the starting cam to radially inward retreat.

In the cut-only mode, the buttonhole cutting mode cam is positioned as to enable the control plate driving stud of the cutting control cam disc to abut a starting lever plate 226; to enable the starting cam to radially inward retreat; and to enable the cutting starter lever 224 to be disjoined from the cutting shaft stop arm.

In the no-cut mode, the buttonhole cutting mode cam is positioned as to enable the starting lever plate 226 to be disjoined from the control plate driving stud of the cutting control cam disc; to enable the cutting starter lever 224 to be disjoined from the cutting shaft stop arm; and to enable the starting cam to radially inward retreat.

The mode change-over mechanism 210 having such a structure as described above will be described more in detail hereunder.

The buttonhole cutting shaft 98 as the driven portion is supported by a buttonhole cutting shaft frame **96*a* and a buttonhole cutting shaft bushing 98*b* provided on the arm 4**.

In a ring-like portion of the rear side (the left side in FIGS. 4 and 14) of the buttonhole cutting clutch wheel 211 in the clutch means, the buttonhole cutting clutch hook 219 is pivoted in a hole **211*a* by a clutch hook pin screw 219*c* fixed by a clutch hook pin screw 219*d*. The clutch hook spring 227 is stretched between one end of the buttonhole cutting clutch hook and a spring suspension pin 227*a* fitted in a hole 211*b*, and a hook portion 219*a* thereof is engaged with the cutting shaft driving ratchet 173 as the driving portion (see FIG. 2). The cutting shaft driving ratchet 173 and the cutting shaft worm wheel 172 of the driving portion operate with the rapid feed intermediate shaft 102 of the rapid feed mechanism 103 through the cutting shaft driving worm 171. A cutting control cam pin 212*a* extends parallel to the shaft has one end on a fixed surface of the cutting control cam disc 212 in the mode change-over means and is received in an arc-like long groove 211*c* of the buttonhole cutting clutch wheel 211. A hole 212*b* of the cutting control cam disc 212 receives a boss 211*d* of the buttonhole cutting clutch wheel 211, and the cutting control cam spring 228 is stretched between the cutting control cam pin 212*a* and a spring suspension pin 228*a* within a hole 211*e* of the buttonhole cutting clutch wheel 211, so that the cutting control cam disc 212 is elastically urged counterclockwise in the drawing. The buttonhole cutting clutch wheel 211 is fixedly mounted on the buttonhole cutting shaft 96 of the driven portion by a buttonhole cutting shaft key 96*b*-1 and a screw 96*c* (see FIG. 4**).

Figure 14:
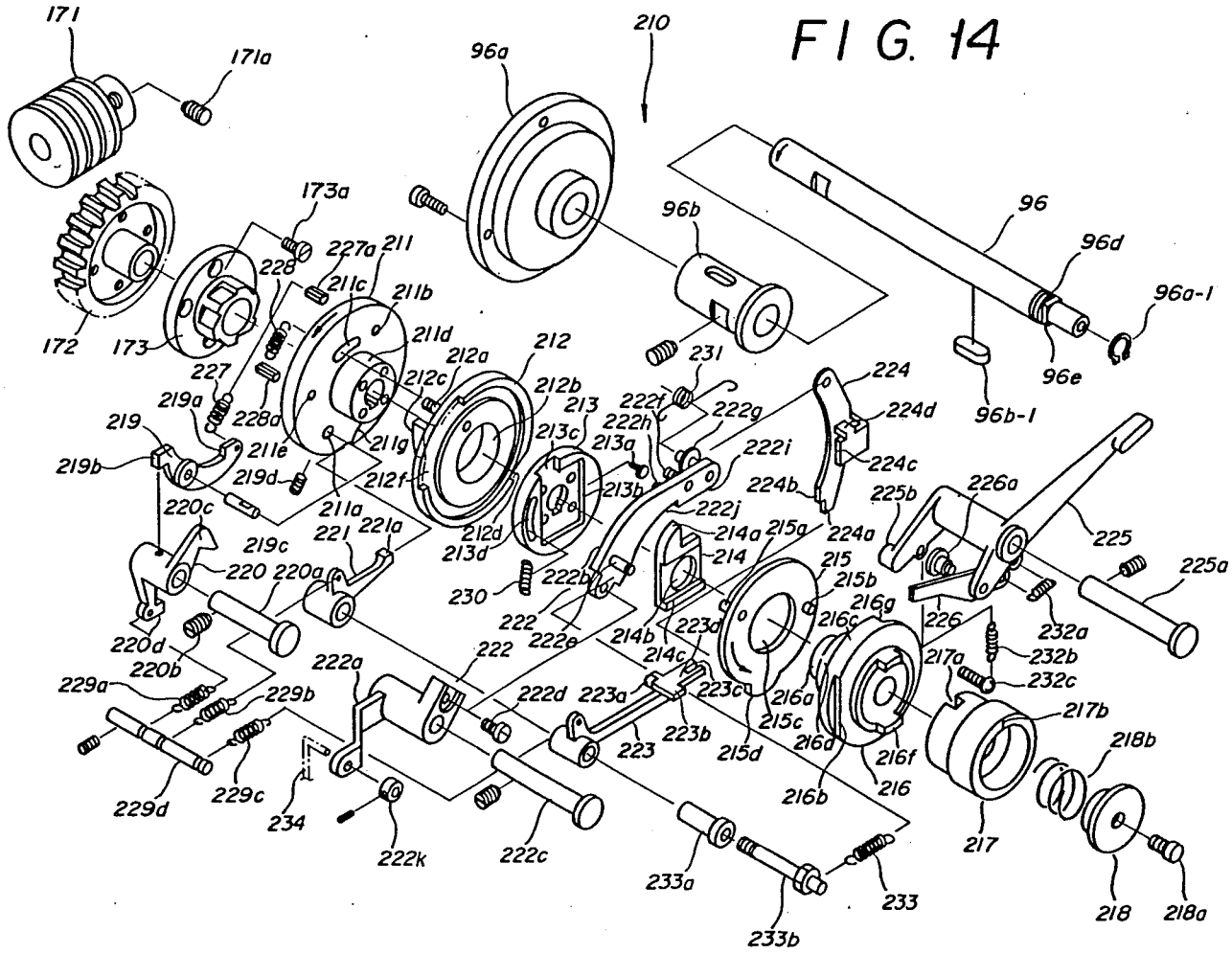
FIGS. 14 and 14*a*–14*p* are explanatory diagrams showing the mode change-over mechanism of the same sewing machine.
Figure 14A:
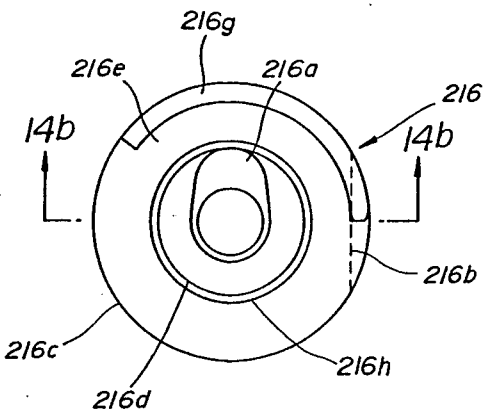
Figure 14C:
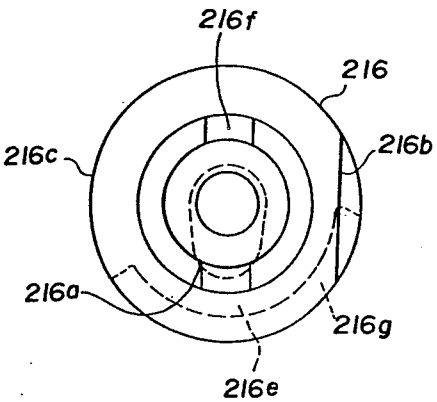

A starting cam case 213 (see FIG. **14*f*) is fixed to the buttonhole cutting clutch wheel 211 by starting cam case screws 213*a*. The starting cam 214 (see FIG. 14*e*) is slidably fitted into a guide groove 213*b* of the starting cam case 213. The starting cam 214 has a cam portion 214*a* and an elongated hole 214*b* loosely fitted onto the shaft 96, and the cam portion 214*a* moves to/from a window 213*c* of the case 213 as the starting cam 214 slides along the groove 213*b* of the case 213**.

Figure 14D:
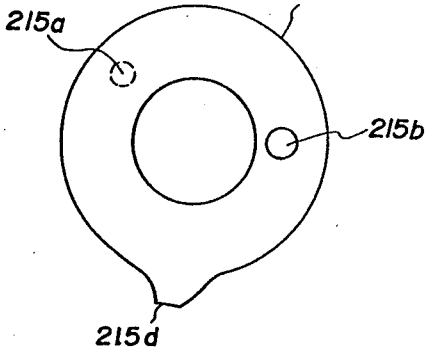

A control plate counter spring pin **215*a* extending along the shaft is fixed on a starting control plate 215 (see FIG. 14*d*). The pin 215*a* is inserted into an arc-like long hole 213*d* of the case 213 and elastically urged clockwise by the control plate counter spring 230. The starting control plate 215 also carries an outwardly projecting control plate driving stud 215*b*** projecting outward.

Figure 14B:
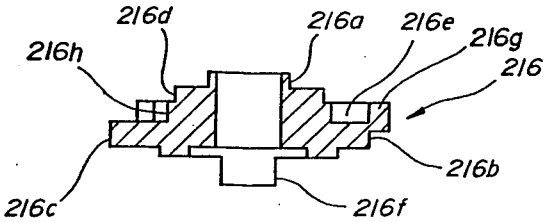
Figure 14E:
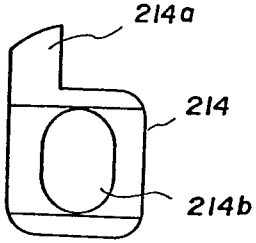
Figure 14F:
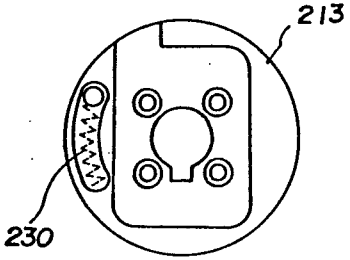

The buttonhole cutting mode cam 216 in the mode change-over unit has an eccentric **216*a* (see FIGS. 14*a* to 14*c*) fitted in a cam groove 214*c* formed at the front side (the right side in FIG. 14) of the starting cam, a boss 216*d* loosely fitted into a center hole 215*c* of the starting control plate 215, a ring-like vacant space 216*e* making the cam rotatable without abutting on the control plate driving stud 215*b* extending along the shaft on the circumference of the starting control plate 215, an external circumference 216*c*, a step 218*b* partly cut therein, and a hook 215*f* engaged with a groove 217*a* of the buttonhole cutting mode dial 217**.

Figure 14G:
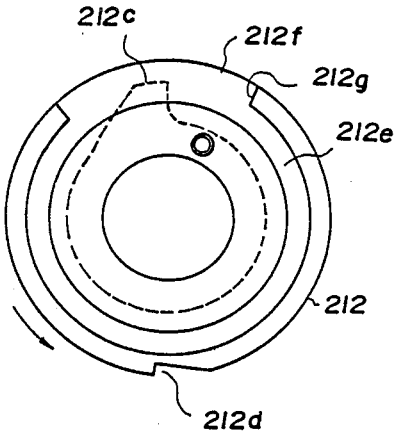
Figure 14H:
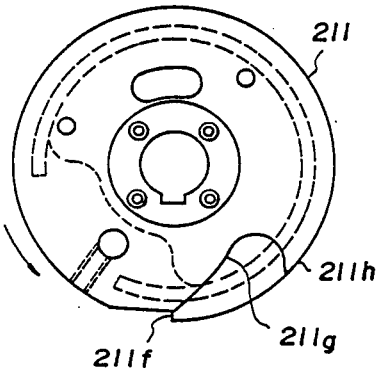
Figure 14I:
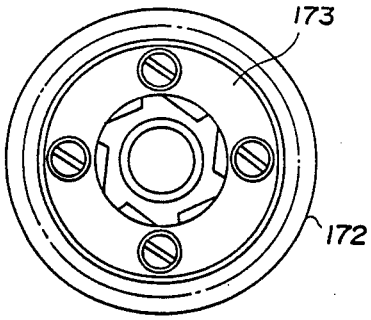
Figure 14J:
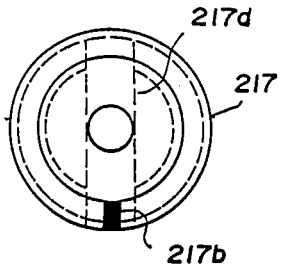

After the above-mentioned mechanical elements of the machine are mounted onto the shaft 98 successively in the wake of the buttonhole cutting clutch wheel 211 fixed on the shaft 96, a C-ring 96a-1 is set to a groove 96d of the shaft 98 in the outer end of the buttonhole cutting mode cam 218 and Prevents the elements from falling off of the shaft 96. Next, the buttonhole cutting mode dial 217, a cutting mode dial spring 218b and a cutting mode dial spring cap 218 are mounted onto the shaft 96 in succession, and the cap 218 is fixed to the shaft by a spring cap screw 218a. The shaft 96 has a straight angle portion 96a engaged with the groove 217a of the dial 217. Compared with the engagement length t1 see FIGS. 4 and 14p) between the hook 216f of the buttonhole cutting mode cam 216 and the groove 217a of the buttonhole cutting mode dial 217, the maximum space t2 between the dial 217 and the cap 218 is short, and compared with the space t2, the engagement length t3 between the straight angle portion 96e of the shaft 96 and the groove 217a of the dial 217 is shorter.

The cutting clutch cutoff lever 220 in the clutch means is pivotally connected to the arm 4 by a cutting clutch cutoff lever shaft 220a. The reference numeral 220h designates a cutoff lever shaft screw provided for the shaft 220a. The lever 220 has a cam follower 220c and a hook 220d, the former being fitted to a cam 212c (see FIG. 14g) of the cutting control cam disc 212 and the latter being fitted to a hook portion 219b of the buttonhole cutting clutch hook 219 engaging the ratchet 173. A cutting shaft stop arm spring 229a stretched between the hook 220d and a spring suspension pin 229d elastically urges the hook 220d in the direction that the hook 220d is separated from the hook portion 219b. A cutting clutch wheel pawl lever 221 and the cutting shaft stop arm 225 of the mode change-over means are pivotally mounted on the arm 4 through a cutting shaft stop arm sleeve 233a and a stopper arm shaft screw 233b and elastically biased toward a position abutting the clutch wheel 211 and the cam disc 212 by a clutch wheel pawl lever spring 228b and a cutoff lever spring 229c respectively.

The main cam control arm 222 of the mode change-over means is pivotally mounted on the arm by a main cam control arm shaft 222c and elastically urged by a spring 233 toward a position of abutting the starting cam case 213. The main cam control arm 222 consists of two members 222a and 222b pivotally linked with each other by a screw 222d, however, alternatively, the members may he integrally formed.

A pawl 221a of the cutting clutch wheel pawl lever 221 abuts on a step 211f provided on the outer circumference of the buttonhole cutting clutch wheel 211, so that the wheel 211 is prevented from rotating in the direction opposite to the arrow.

The cutting shaft stop arm 223 has a hook 223a capable abutting on a step 212d (see FIG. 14g) of the cutting control cam disc 212 in order to prevent the disc 212 from rotating, a cam follower 225b engaged with a cam 215d of the stating control plate 215, a slit portion 223c for the insertion of a guide portion 224a of the the cutting starter lever 224, and an abutting portion 223d engaged with a step 224b of the lever 224.

The lever 224 is pivoted at its other end onto a cutting starter lever hinge screw 222g of the arm 222 and elastically urged to rotate toward the arm 223 by a cutting starter lever spring 231 wound on the screw 222g and suspended between a pin 222f and the lever 224. The lever 224 has an engagement portion 224c sliding on the outer circumference 218c of the buttonhole cutting mode cam 218 including the step 215b and a hit-up portion 224d in which the lever 224 is hit up by the starting lever plate 226. A misoperation-preventing pin 222h provided on the arm 222 is positioned in an outer groove 212e (see FIG. 14g) of the cutting control cam disc 212. The arm 222 has a cam follower 222i engaged with the cam portion 214a of the starting cam 214.

One end of the main cam stop lever rod 234 is inserted into a hole in one end of the arm 222, and retained-therein by a main cam control rod collar 222k.

The connection at the other end of the rod 234 have been already explained with respect to FIGS. 28 and 28c.

Although the starting lever 225 is pivotally mounted on the arm 4 by a starting lever shaft 225a and elastically urged to rotate counterclockwise by a starting lever spring 232b stretched between the lever 25 and a starting lever spring suspension 232c, a stopper portion 225b abuts on an abutting portion 4e (see FIG. 2) of the arm 4 so that the lever 225 is stopped. The lever 225 and the starting lever plate 226 are pivotally attached to each other by a starting lever plate hinge pin 226a, and the plate 228 is brought into contact with the outer circumference 216c of the buttonhole cutting mode cam 216 including a projecting wall 216g (see FIGS. 14a to 14c) by a starting lever plate spring 232a.

The stopper portion 225b of the starting lever 225 is able to abut on an outer circumference 211h (see FIG. 14h) of the buttonhole cutting clutch wheel 211 including a recess portion 211g

Although the mode change-over mechanism in the foregoing embodiment is arranged such that the mode change-over unit and mode change-over means constitute one unit organically, in an alternative modification, several mutually independent units may be made up corresponding to various modes so that the units can be selectively exchanged corresponding to the mode. In this case, a plurality of clutch means for the connection/disconnection between the driving Portion and the driven portion, and a plurality of mode change-over units having different relative positions with respect to the driven portion and forming one of various modes of the operation and operation sequence of the cutting mechanism and/or the rapid feed mechanism corresponding to the foregoing relative positions, are provided such that they are selectively exchanged, so that the clutch means, the cutting means and/or the rapid feed mechanism are selectively actuated in accordance with the mode corresponding to the position of the exchanged units.

Next, a work clamp mechanism 1000 will be explained (see FIGS. 1, 16, 16a, 17, 17a and 17b).

The work clamp mechanism is provided for clamping a work or cloth in which buttonhole stitching is performed, and for spreading a slit s of a buttonhole (see FIG. 6a and 6b) perpendicularly to the slit s after the buttonhole is formed in the case of before-cut, while giving a spreading stretch to the work or cloth in the case of after-cut, when stitches are applied in the work or cloth.

The work clamp mechanism 1000, in brief, has a pair of work clamp base plates 1021 which are laterally, and horizontally slidable on the work clamp carrier 3 and elastically urged together by a base plate pressure spring 1032. The mechanism 1000 further includes a work clamp arm 1023 and a work clamp foot 1025 both pivotally mounted or each work clamp base plate 1021 for clamping the work or cloth in cooperation with the work clamp base plate 1021.

The work clamp mechanism 1000 is further provided with fitting connection sections 1021*c* and 1025-1*d* permitting at leust the opposite sides of the rear end of the work clamp base plate 1021 to be laterally and slidably fitted to the work clamp carrier 3, and an adjuster including a base plate setting bracket 1025-1, base plate setting block screws 1026*a*, a protrusion portion 1026*b*, and a recess portion 1021*d* for adjusting the amount of lateral spreading of the work clamp base plates 1021.

The adjuster unit has base plate setting block springs 1026*c* which urge the adjuster segments 1026 laterally apart to adjust the amount of widening.

The work clamp mechanism 1000 has a work clamp frame 1002 which has one end pivoted to the work clamp carrier 3 and the other end connected to the pair of work clamp arms 1023 and which is operated by a work clamp operating lever 1009 releasing the clamp against the elastic force of a work clamp opening spring 1016 and keeping the clamp against the elastic force. The work clamp operating lever 1009 is connected to the pivot portion of the work clamp frame 1002 through a work clamp tension arm 1008.

A switching means SW is provided to turn a motor M on/off in movement of the work clamp operating lever 1009 between clamps closed and clamps open positions.

These elements will be described in detail successively.

Figure 16:
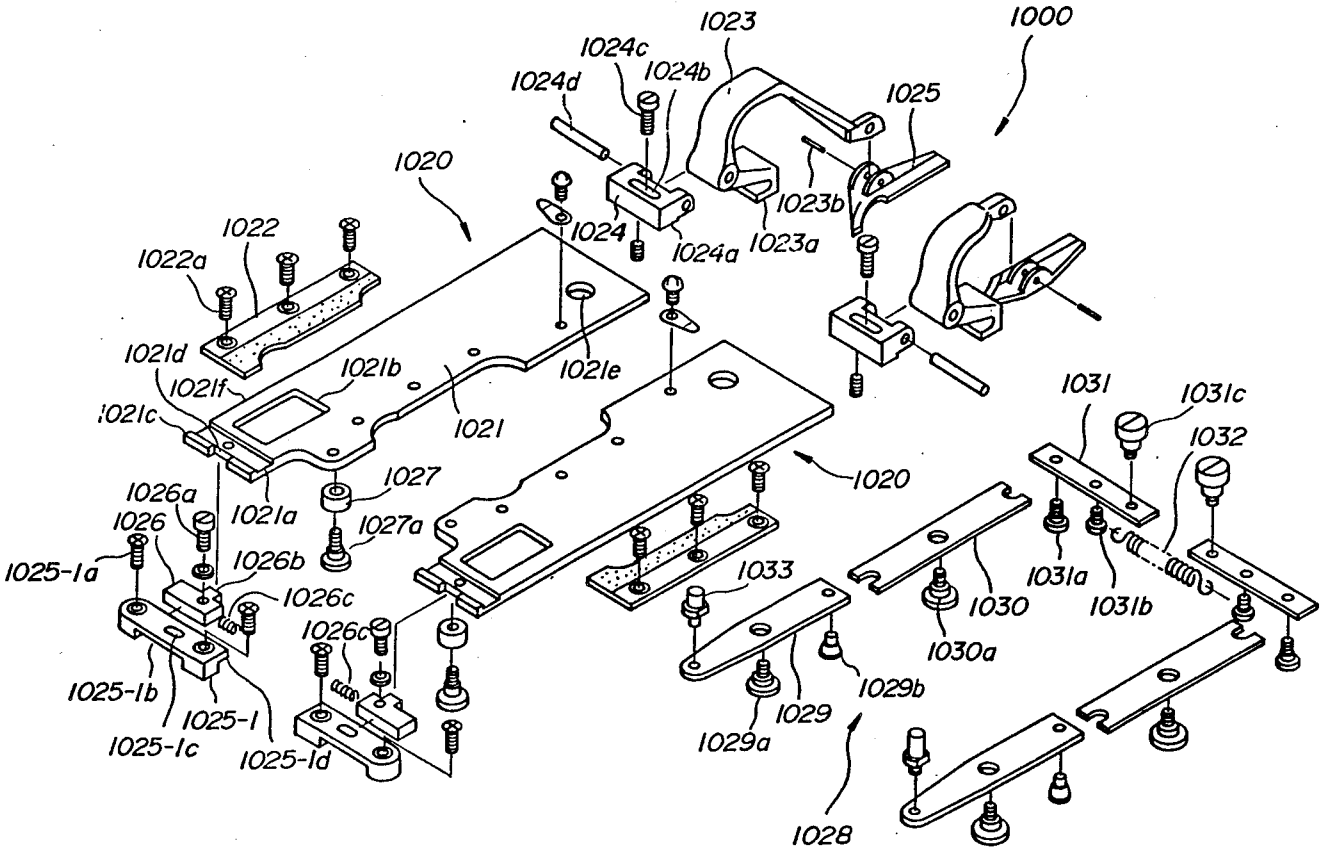
FIGS. 16, 16*a*, 17, and 17*a*–17*b* are explanatory diagrams showing the work clamping mechanism.
Figure 16A:
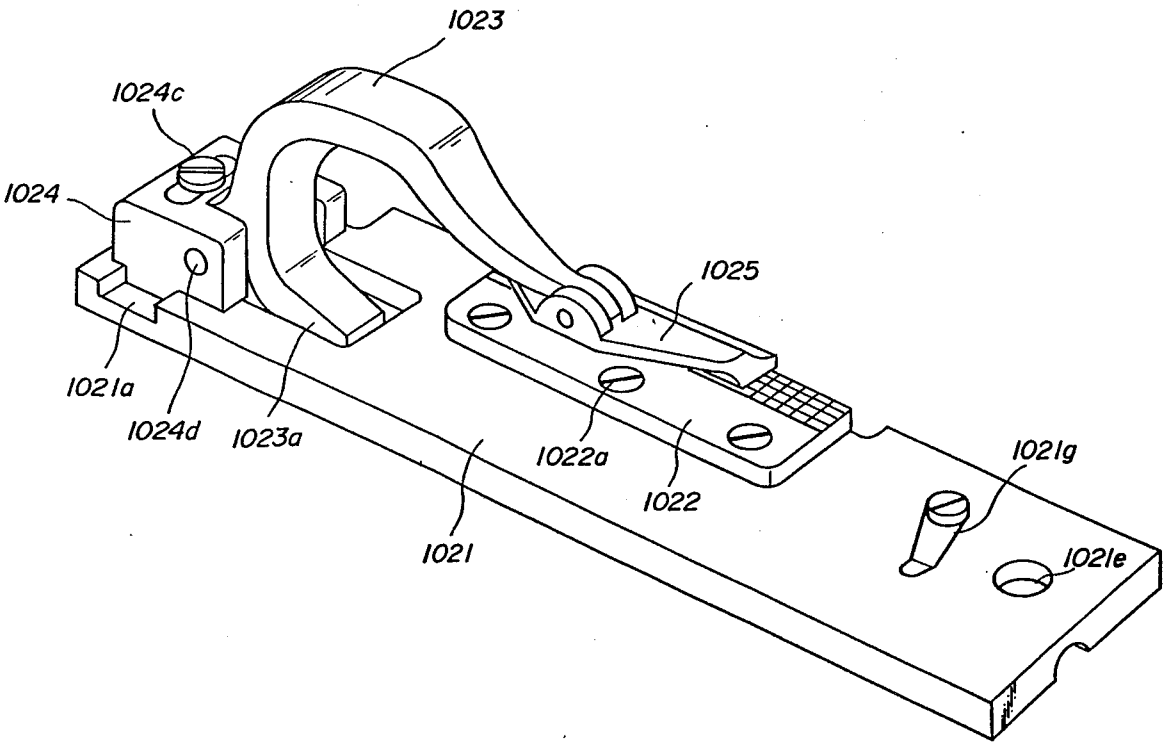

The work clamp mechanism 1000 has a pair of work clamp segments 1020 see FIGS. 16 and 1). The pair of work clamp segment 1020 are fitted in a groove 3*h* formed by channels 3*g* of the work clamp carrier 3 (see FIG. 12) and have an identical structure. Therefore, only one of the sets will be explained hereunder.

Each clamp segment 1020 comprises a work clamp base plate 1021 laterally and slidably mounted provided on the work clamp carrier 3, a work clamp plate 1022, and a work clamp arm 1023 and a work clamp foot 1025 both pivotally mounted on the work clamp base plate 1021 for clamping the work or cloth in cooperation with the work clamp base plate 1021.

The work clamp plate 1022 is fixed onto the the work clamp base plate 1021 by work clamp plate screws 1022*a*. A clamp arm hinge bracket 1024 has a protrusion 1024*a* fitted in a groove 1021*a* of the work clamp base plate 1021, and is attached to the work clamp base plate 1021 through of an elongated hole 1024*b* by means of a clamp arm hinge bracket screw 1024*c* so that the position of the clamp arm hinge bracket 1024 is made adjustable laterally. The clamp arm hinge bracket 1024 is pivoted to the work clamp arm 1023 by a clamp arm hinge pin 1024*d*. The work clamp arm 1023 has one end forming a U-shaped hook 1023*a* connected to a lower clamp arm 1004 (see FIG. 17) and facing an opening 1021*b* of the work clamp base plate 1021 and, at its and the other end, the work clamp foot 1025 is pivotally attached by a work clamp foot hinge pin 1023*b*. The work clamp plate 1022 and the work clamp foot 1025 are provided with rough surfaces by knurl processing so as to be able to easily keep a work or cloth sandwiched therebetween and the fringes. thereof have such shapes as shown in the drawing to clear the needle plate 821 (see FIG. 11*a*).

On the other hand, base plate setting brackets 1025-1 are fixed in the right and left grooves 3*i* (see FIG. 12) extending laterally on the work clamp carrier 3 by base plate setting bracket screws 1025-1*a* respectively, and base plate setting blocks 1026 are laterally adustably fixed in the grooves 1025-1*b* of the base plate setting brackets 1025-1 through long grooves 1025-1*c* by base plate setting block screw adjuster 1026*a*. A recess portion 1025-1*d* of the base plate setting bracket 1025-1 and a protrusion portion 1025*b* of the base plate setting block 1026 is engaged with at least a protrusion portion 1026*c* and a recess portion 1021*d* at the opposite sides of the rear end of the work clamp base plate.

Thus, at least the rear ends of the work clamp base plate 1021 are laterally and slidably fitted to the work clamp carrier 3 by the recess portion 1025-1*d* of the base plate setting bracket 1025-1 and the protrusion portion 1021*c* of the work clamp base plate 1021, so that the work clamp base plate 1021 is prevented from floating up. On the other hand, through the convex portion 1026*b* of the base plate setting block 1025 and the concave portion 1021*d* of the work clamp base plate 1021, the position of the base plate setting block 1025 is changed laterally by the base plate setting block screw 1026*a* so that the amount So (see FIG. 8*a*) of lateral spread in the slit s of a buttonhole by work clamp base plate 1021 is adjusted.

A base plate spreader cam follower 1027 pivots about a spreader roller hinge screw 1027*a*. The cam follower 1027 is engaged with the cam 5*d* of the cutting knife base plate 5*c* (see FIG. 15) corresponding to the feed of the work clamp carrier 3.

A parallel moving mechanism 1028 (see FIG. 18) makes the pair of work clamp base plates 1021 move laterally in parallel toward of apart from each other. The mechanism 1028 is constituted by three kinds of links 1029–1031, that is, spreader pin lever plates 1020, base plate spreader levers 1030 and base plate pressure plate pressure slides 1031, disposed symmetrically. The spreader pin lever plate 1029 and the base plate spreader lever 1030 are pivoted to the rear side of the work clamp carrier by spreader lever hinge screws 1029*a* and 1030*a*. An end of the spreader pin lever plate 1029 and an end of the base plate spreader lever 1030 are linked with each other by a spreader hinge pin 1029*b*. The other end of the base plate spreader lever 1030 and an end of the base plate pressure slide 1031 are linked with each other by a pressure slide hinge screw 1091*a*. A parallel guide pin 1031*c* is threaded to the other end of the base plate pressure slide 1031 and extended through an elongated hole 1031*d* (see FIG. 12) so as to be fitted in a parallel guide hole 1021*e* of the work clamp base plate 1021. A base plate pressure spring 1032 is stretched between spring stud screws 1031*b* attached of the pair of base plate pressure slides 1031, so that the work clamp base plates 1021 are elastically drawn toward each other.

On the other hand a pair of base plate spreader stud screws 1033 are provided in the spreader pin lever plates 1029 and extended into elongated holes 3*j* (see FIG. 12) of the work carrier 3, so that outer sides 1021*f* of the work clamp base plates 1021 of the sets 1020 are pressed inward by the an elastic force of the spring 1032.

A pair of work clamp frame bearing supports 1001 are fixed on the rear side (see FIG. 12*b*) of the work clamp carrier 3 by bearing support screws 1001*a*. The reference numeral 1001*b* designates female screws. One end or a bottom end of the work clamp frame 1002 is pivoted to the work clamp carrier 3 by clamp frame shafts 1003. The reference numeral 1003*a* designates screws for the shaft 1003. Lower clamp arms 1004 are fixed on flexible swingable arms 1002*a* at the other ends of the work clamp frame 1002 by lower clamp arm screws 1004*a* respectively. The other ends the work clamp frame 1002 are connected to the pair of work clamp arms 1023 through the low clamp arms 1004 respectively. A clamp lift adjusting screw 1005 is threaded to a bracket 1005*a* at a side end of one arm 1002*a* and a clamp lift adjusting screw cap 1007 is fitted onto the top end of the clamp lift adjusting screw 1005. The reference numeral 100 designates a nut for the screw 1005. One end of the work clamp tension arm 1008 is fixed to the rear side (see FIGS. 1 and 17) of the frame 1002 by a screw 1008*a*. A work clamp pressure shaft 1011 is fixed to an arc-like elongated hole 1008*a* in the work clamp tension arm 1008 by a washer 1012 and a nut 1011-2. A work clamp adjusting screw 1013 and a nut 1014 prevent the work clamp pressure shaft 1011 from moving in the elongated hole 1008*a*. A work clamp link 1010 is pivotally mounted at its one end onto the work clamp pressure shaft 1011. The work clamp link 1010 is pivotally mounted at its other end on a work clamp operating lever shaft 1009*a* in the work clamp operating lever 1009 by a work clamp link pin 1010*a*. The work clamp operating lever 1009 is biased toward a released position by the elastic force of the work clamp operating spring 1016. The work clamp frame 1002 is operated by the lever 1009. In this case, the lever 1009 is linked with the pivot portion of the frame 1002. The reference numeral 1010*b* designates a snap ring for the work clamp link pin 1010*a*. The work clamp operating lever 1009 (see FIGS. 1 and 17) in a hole 1009*c* (see FIGS. 12*b*) of the work clamp carrier 3. The shaft 1009*a* is fixed by an operating lever shaft screw 1000*g* threading in a hole 1009*d* in the work clamp carrier 3. Between the work clamp spreading spring screw 1015 provided in the work clamp tension arm 1008 and a work clamp spreading spring eyelet 1017 provided in a hole 1017*a* (see FIG. 12*b*) of the work clamp carrier 3, the work clamp spreading spring 1018 is stretched so as to pivotally bias the flexible swingable arm 1002*a* and the work clamp tension arm 1008 toward the work clamp carrier 3. In the clamp released condition where the lever 1009 is turned in the direction of the arrow a, however, the cap 1007 abuts on the work clamp carrier 3 through the screw 1005 to thereby prevent further swinging. In the clamp engaged condition where the lever 100*g* is turned in the direction of the arrow b, a stopper 1009*b* of the lever engages with one side of the link 1010 immediately after the lever shaft 1009*a* and the link pin 1010*a* have slightly passed the position where they were in alignment, thereby preventing further swinging.

A swiiching means SW is provided for turning on/off a motor M in response to movement of the work clamp operation lever 1009 between released and engaged positions.

Figure 17:
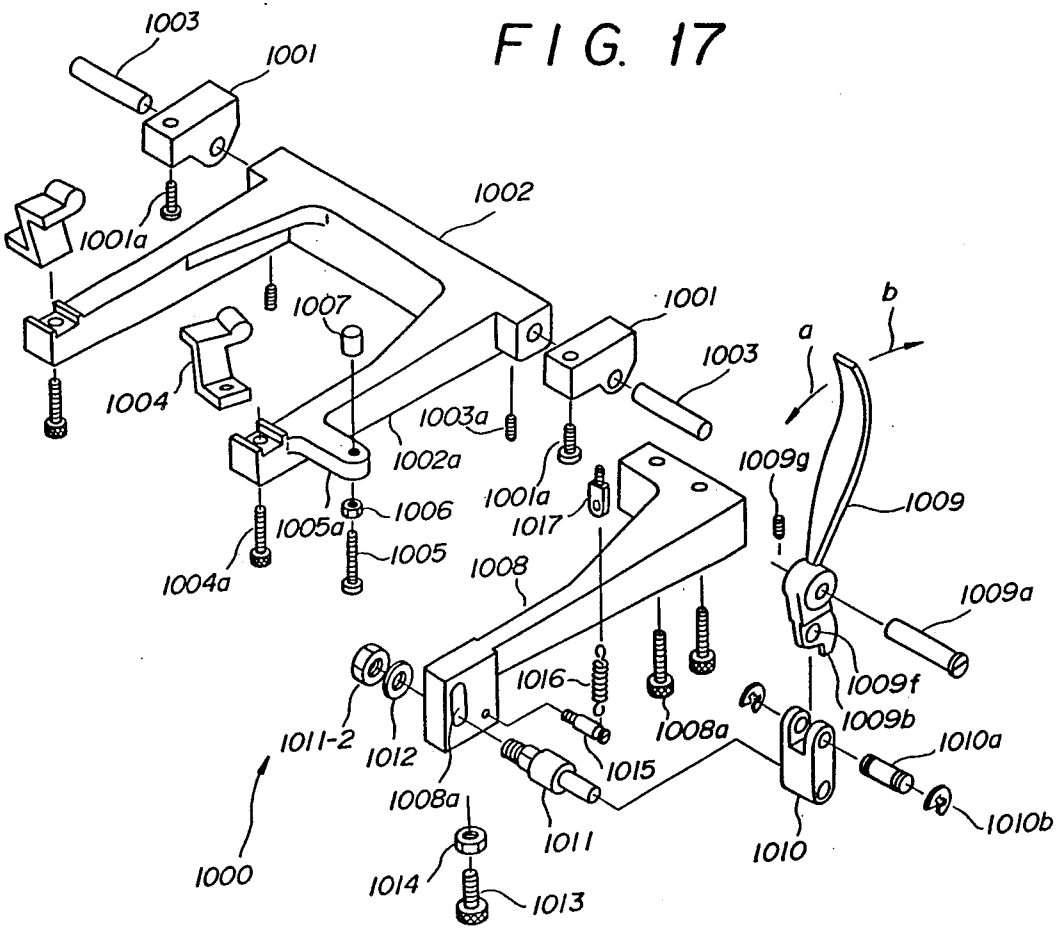
Figure 17A:
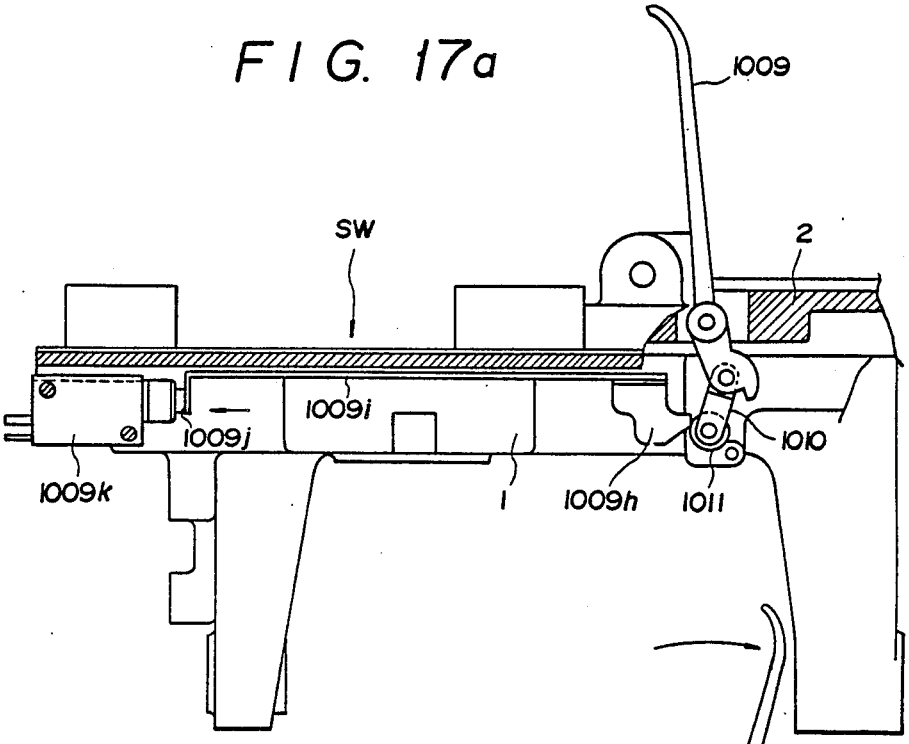
Figure 17B:
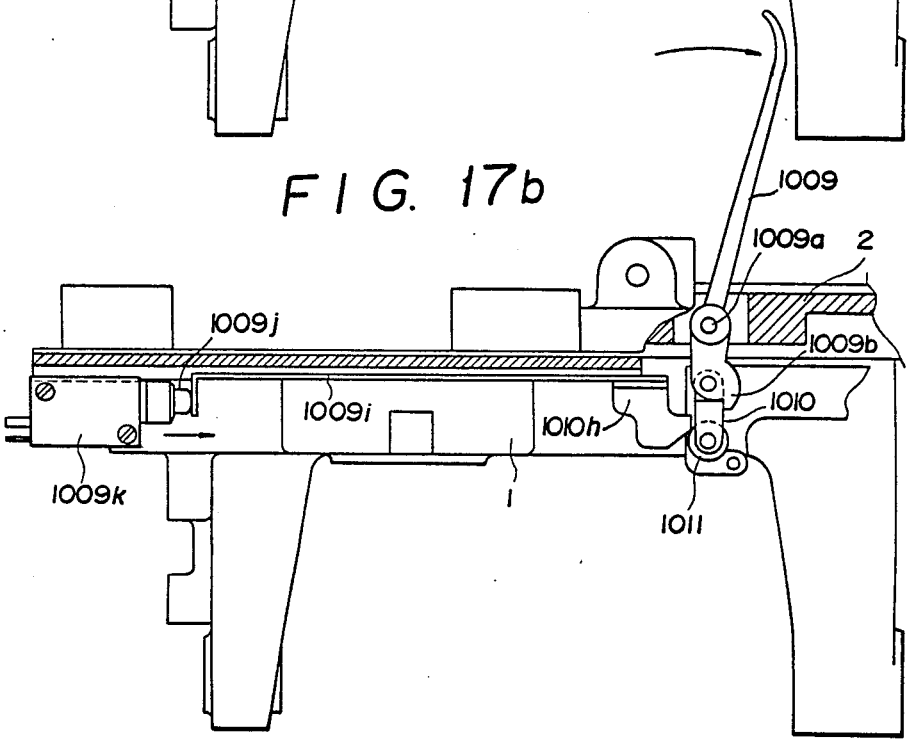

In FIG. 17*a*, the work clamping mechanism 1000 (see FIGS. 16 and 17) including the lever 1009 the link 1009*h* and the shaft 1011, is provided with a motor switch plate 1009*h* and a motor switch 1009*k*, the motor switch plate 1009*h* abuts on the outer circumference of the shaft 1011 so as to transfer its nation to an actuator 1009*j* of the motor switch 1009*k* through a motor switch rod 1009*g* abutting on the bed stand 1 and extending along a groove provided in the bed 2. When the lever 1009 is turned into the non-clamping position see FIG. 17*a*), the motor switch plate 1009*h* is pressed by the shaft 1011, so that the actuator 1009*j* is pressed by the rod 1009*i* and the motor switch is turned off. When the lever is turned to the clamping position (see FIG. 17*b*), the shaft 1011 is disengaged from the motor switch plate 1009*h*, so that the motor switch plate 1009*h* is returned by a spring (not shown) included in the motor switch 1009*k* and the motor switch turns on, so that the motor M is started.

Consequently, in replacing a cutting knife, in replacing a needle, or in taking a work or cloth in/out during stoppage of the machine, the motor is automatically turned off in response to movement of the lever to the non-clamping position, and the machine cannot be started even if the start lever 255 is pressed. This is desirable for the safety. Moreover, when the machine is not used, the motor is switched off. This is desirable for the sake of energy conservation.

Next, the sealing of the internal mechanical parts of the sewing machine will be explained.

In FIG. 12*a*, since the work clamp carrier 3 is moved laterally in forming an eyelet as described above, a space 2*m* should be formed between the work clump carrier 3 and the bed 2. For this, a space covering dust plate 2*n* is applied to the space 2*m* and held with a dust plate guide 2*r* by dust plate guide screws 2*q* The dust plate 2*n* slides in a guide groove 2*p* of the dust plate guide 2*r* when the work clamp carrier moves. Thus, chips of cloth, bits of broken needle, or the like are prevented from entering the internal mechanisms.

The sewing machine for buttonhole stitches operates as follows.

(Stop Condition )

Assume now that needle thread 848 (see FIGS. 2, 10 and 25), looper thread (see FIG. 11*a*), and core thread have been set within respective thread pathways, and the sewing machine is stopped. In the control cam mechanism 300 (see FIGS. 20*a* and 20*b*, the work clamp carrier cam follower 318 is at an angle of 0 degrees in the work clamp carrier groove cam 310, the work clamp carrier 3 at a rearmost position, and the feed across cam follower 901 at an angle of 90 degrees in the groove cam 324. The work clamp carrier 3 is in a condition of no lateral feed across, that is, in parallel with the arm shaft 22. The sector gear driving cam follower 358 is at an angle of 180 degrees in the groove cam 323, and the needle bar 20 and the looper 809 are in a condition that they can vibrate perpendicularly to the arm shaft 22.

(Preparation for Rapid Feed )

Figure 7A:
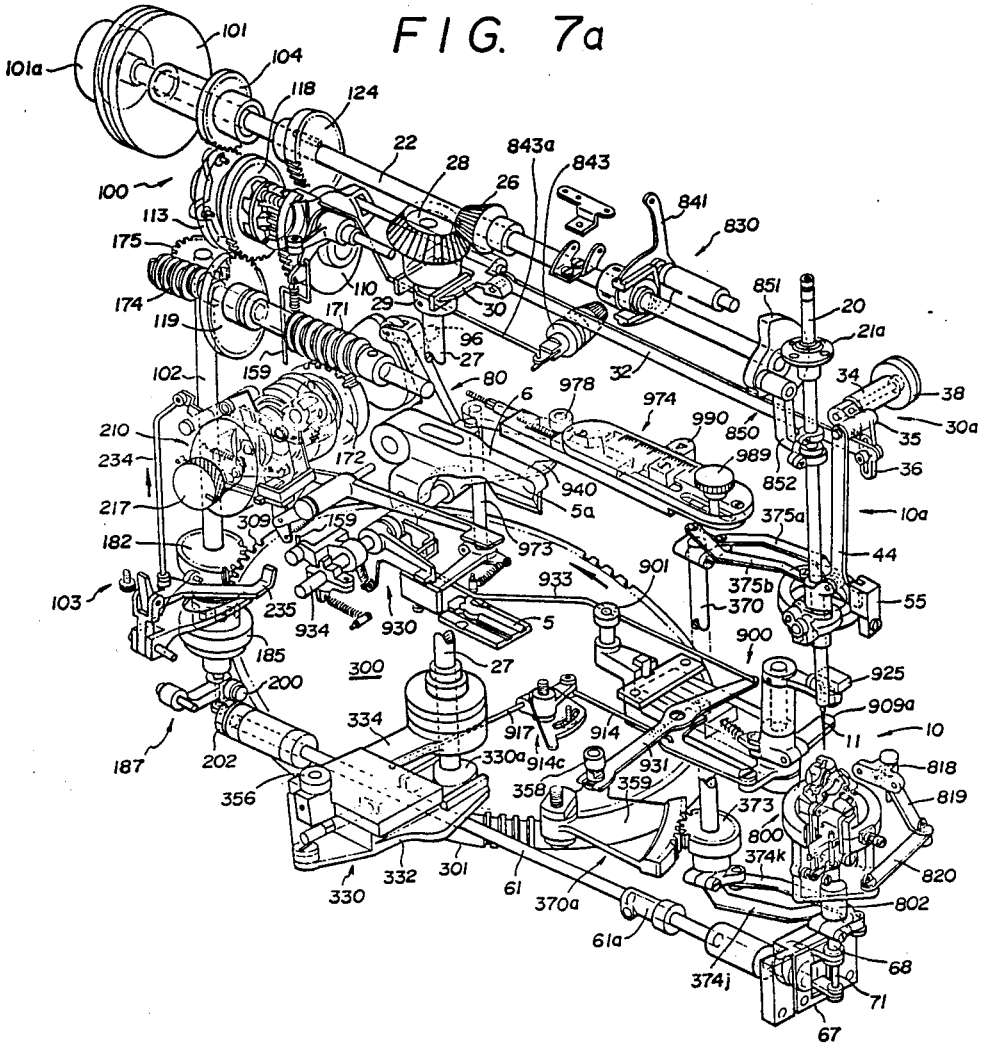
FIG. 7*a* is a schematic perspective view showing a main mechanism of the same sewing machine.
Figures 2, 7B:
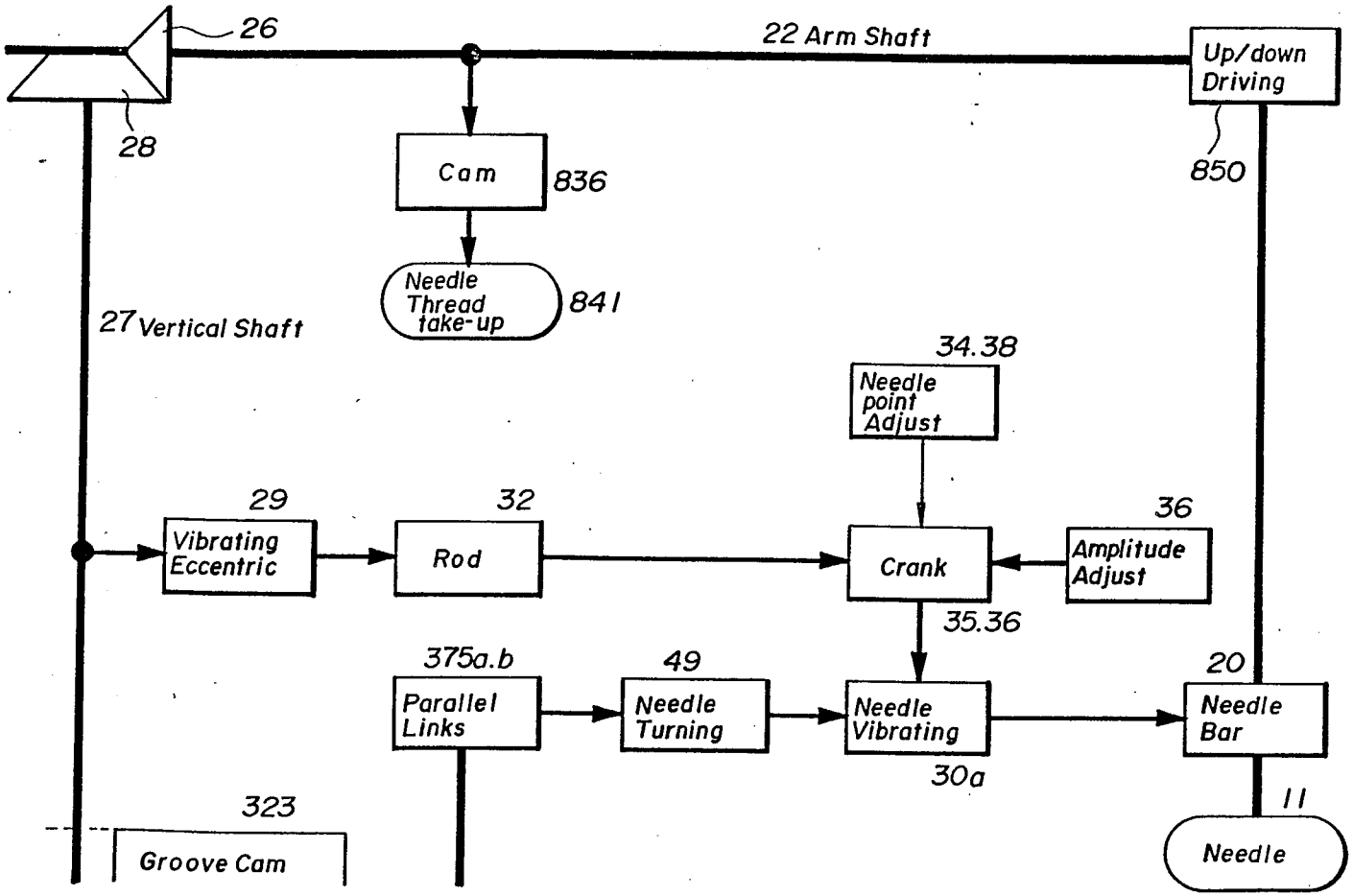
FIG. 7*b* is a operational block diagram of a main mechanism of the same sewing machine.
Figures 3, 7B:
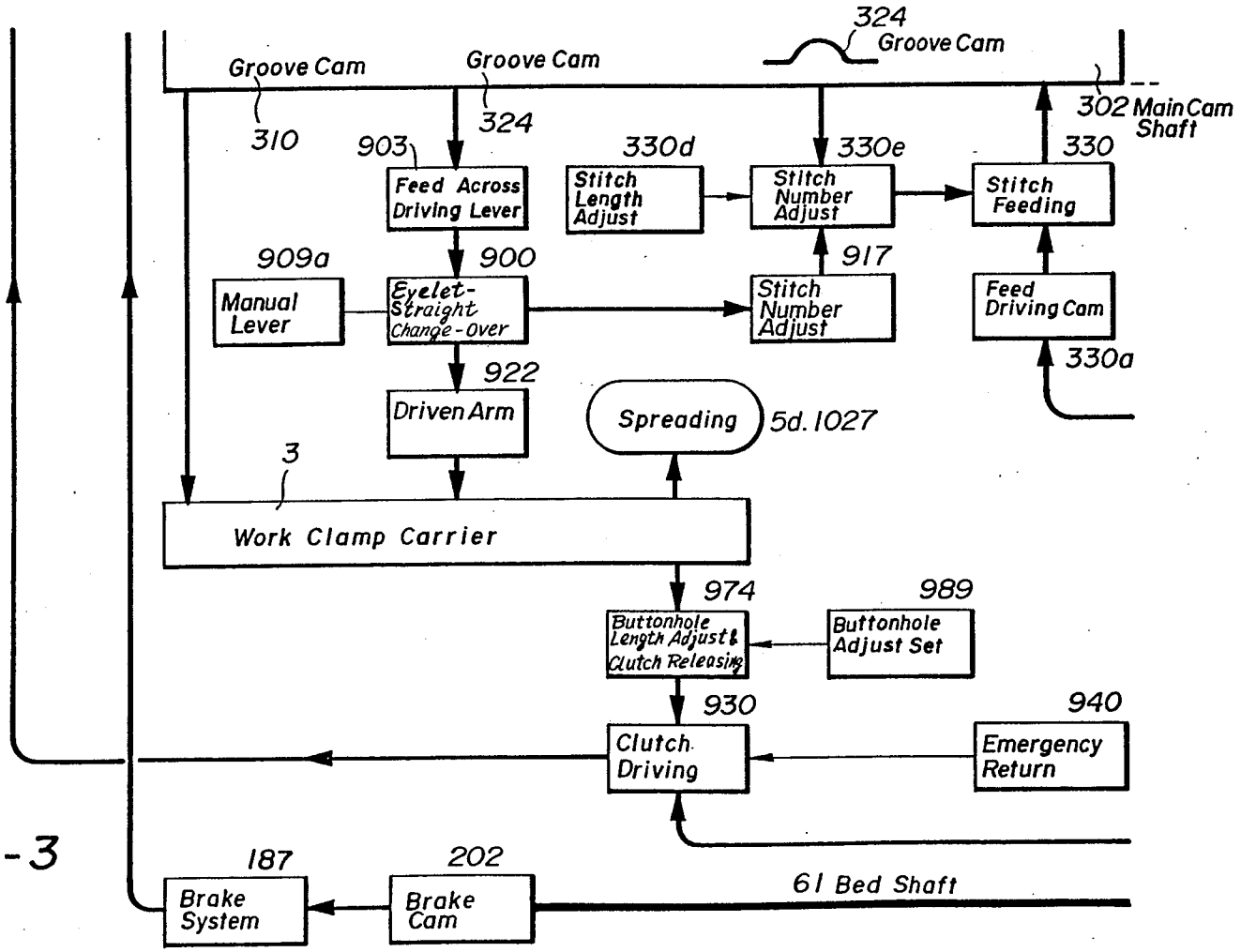
Figures 3, 7B:
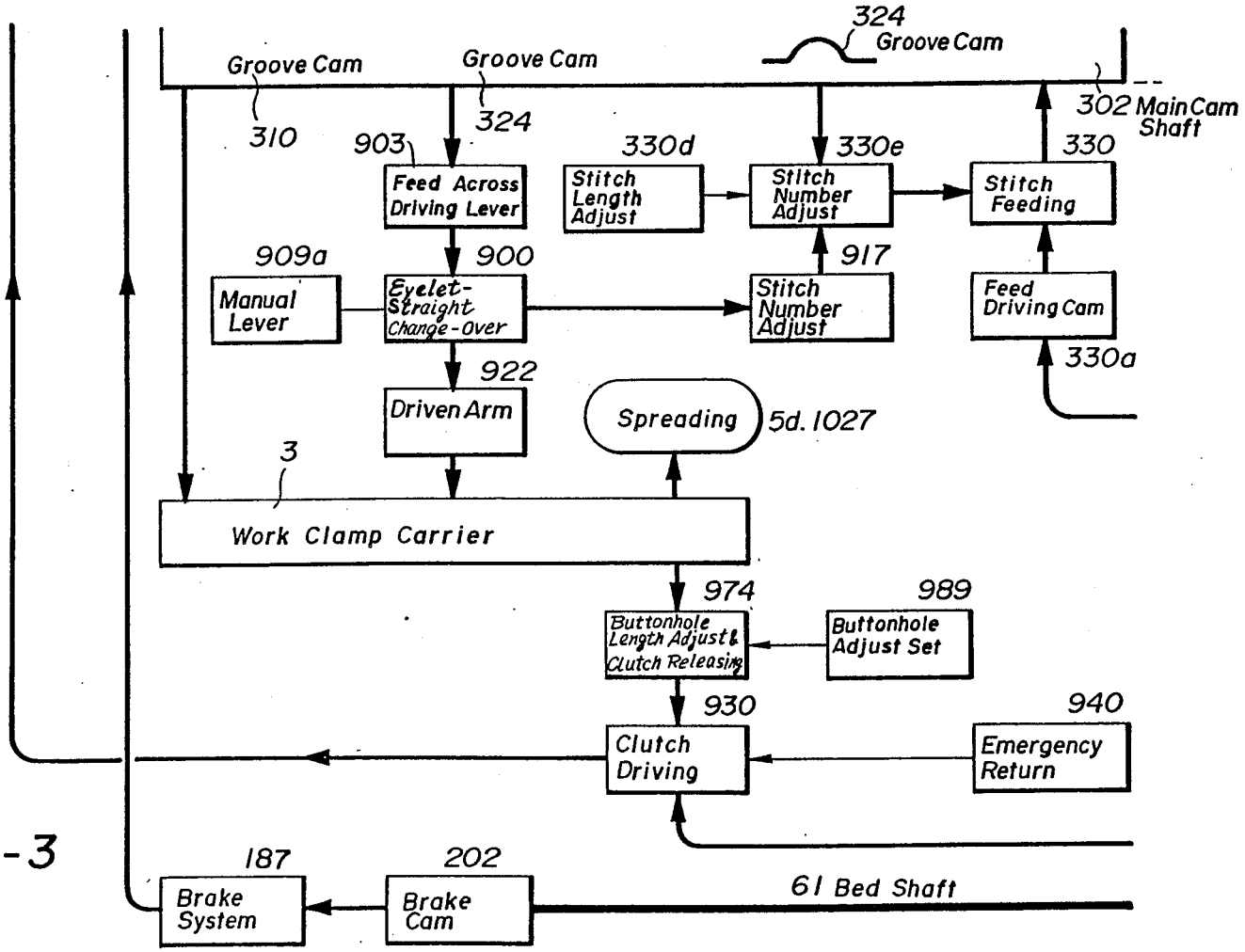
Figures 4, 7B:
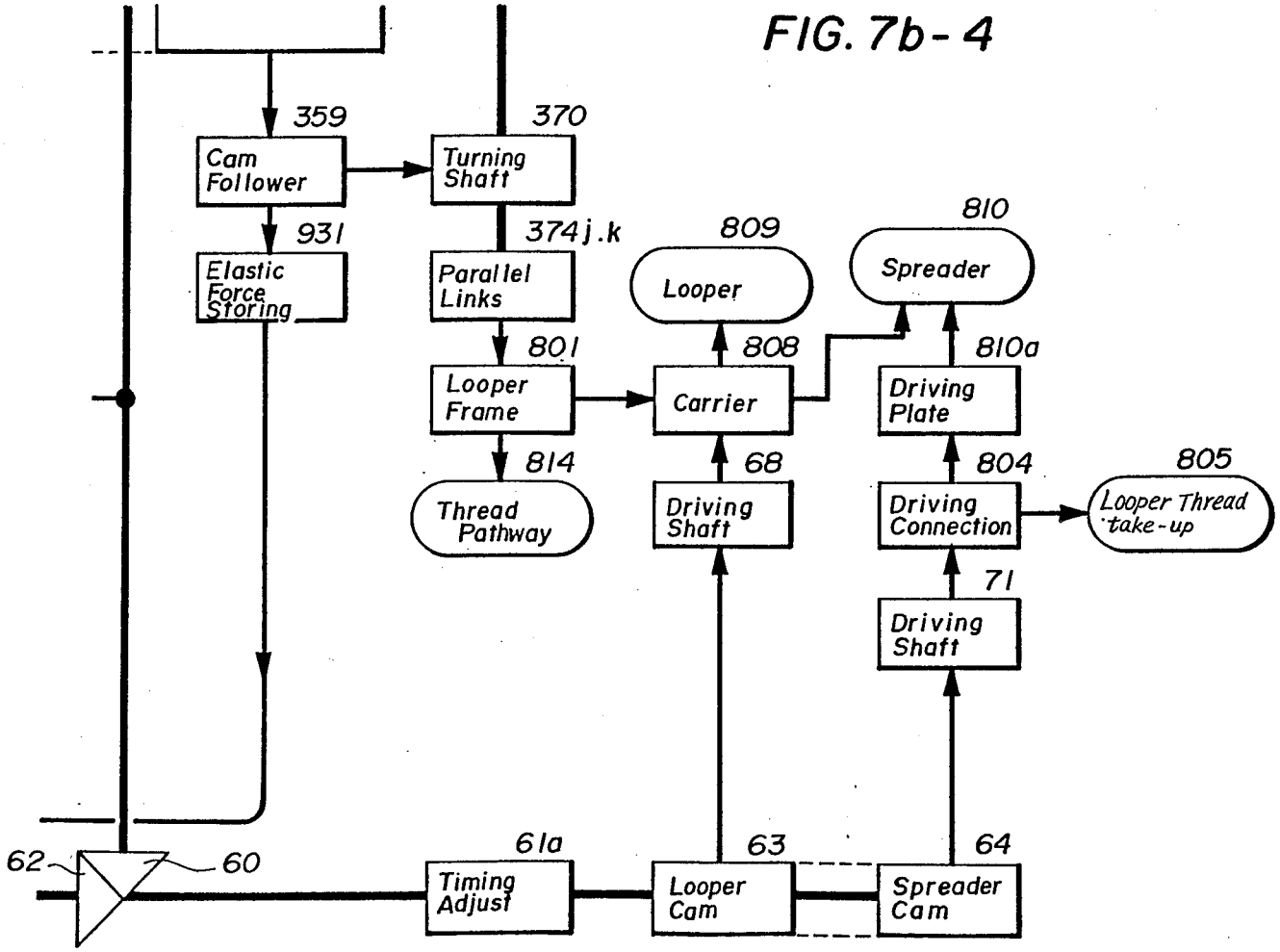

Here, description will be made as to the case where the before-cut mode see FIGS. 14*k* and 14*o*-1) is selected by turning the indicator 217*b* of the buttonhole cutting mode dial 217 of the mode change-over mechanism 210 (see FIGS. 7*b*, 14, 14*a*–14*k*, and 14*p*) upwards in the drawing and the eyelet stitch (see FIG. 8*a*) is formed by shifting the lever 909*a* of the eyelet-straight changeover mechanism 900 (see FIGS. 23) forward as shown in FIGS. 1 and 7*a*.

If the work clamp operating lever 1009 is pulled forward (that is, in the direction of the arrow b of FIG. 17) against the spring 1016 after a workpiece in which buttonhole stitches are to be made has been inserted between the work clamp plate 1022 and the work clamp for 1025 in the clamp mechanism 1000 (see FIGS. 6, 16*a* and 17), the hook 1023*a* of the work clamp arm 1023 is pulled down by the work clamp tension arm 1008, the work clamp frame 1002, and the lower clamp arm 1004; the workpiece is pressed against the work clamp plate 1022 by the work clamp feet 1025; and the stopper 1009*b* abuts on the one side of the link 1010 immediately after the work clamp link pin 1010*a* and the work clamp pressure shaft 1011 have slightly passed the position where they were in alignment (see FIG. 17*b*) so that the lever 1009 is locked to keep the clamping condition. The clamping force to clamp the work or cloth is due to the elastic flexibility of the work clamp frame 1002 and the work clamp tension arm 1008.

Since the base of the work clamp tension arm 1008 is fixed to the pivot point of the frame 1002 on the work clamp carrier the right and left work clamp feet 1025 are able to have mutually uniform clamping pressure through the lever 1009 and the pair of arms 1002*a* of the frame 1002. Therefore after buttonhole cutting the right part and the left part of the cloth can be spread with the same tension. That is, the width S1 of buttonhole stitches never lacks uniformity and attractive stitching is obtained.

When the work clamp condition is locked with the lever 1009 pulled forwards, the work clamp pressure shaft 1011 in the switching mechanism SW is disengaged from the motor switch plate 1009*h* so that the motor switch plate 1009*h* is returned by spring (not shown) included in the motor switch 1009*k* and the motor switch is turned on to cause the motor M (see FIG. 1) to start to thereby rotate the driving pulley 101 and the driving gear 104. The driving power is transmitted to the intermediate shaft gear 119 through the clutch driving gear 117, the splines 106, the clutch shaft 105, the clutch ring 123, and the rapid feed clutch gear 118, so that the intermediate shaft 101*i* is rotated. The direction of driving power transmission is converted through the rapid feed shaft driving worm 174 and the rapid feed shaft worm wheel 175 and the intermediate shaft 101*i* drives the intermediate shaft 102 of the rapid feed mechanism 103. The shaft 102 transmits the rotational torque to the the rapid feed driving section 185 (see FIG. 26) through the one-way clutch 186.

The diving portion of the mode switch mechanism 210 (see FIG. 4 , that is, the cutting shaft worm wheel 172 and the cutting shaft driving ratchet 173, linked with the rapid feed shaft 102 of the rapid feed mechanism 103 through the cutting shaft driving worm 171 is also rotated.

(Rapid Feed )

Figure 14K:
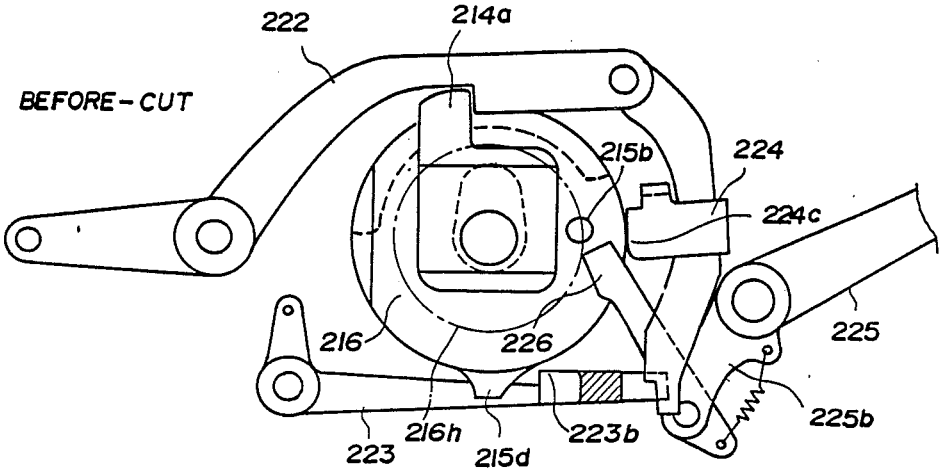
Figure 14L:
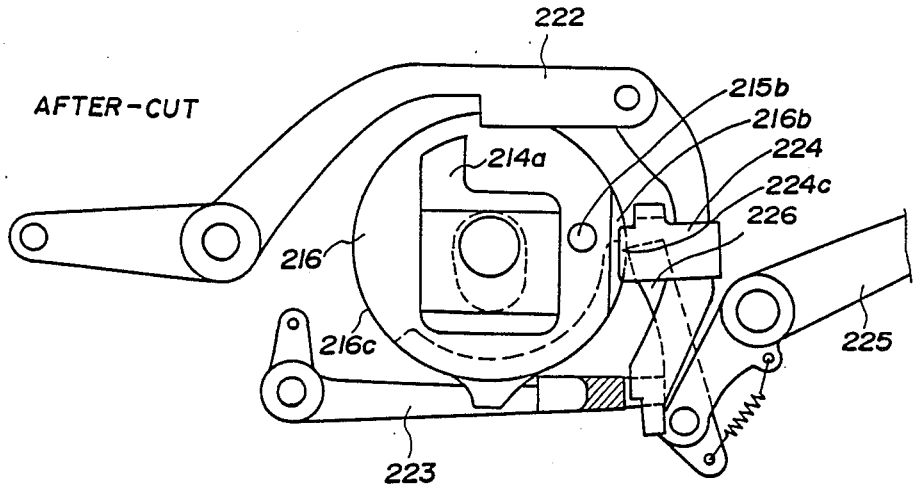
Figure 14M:
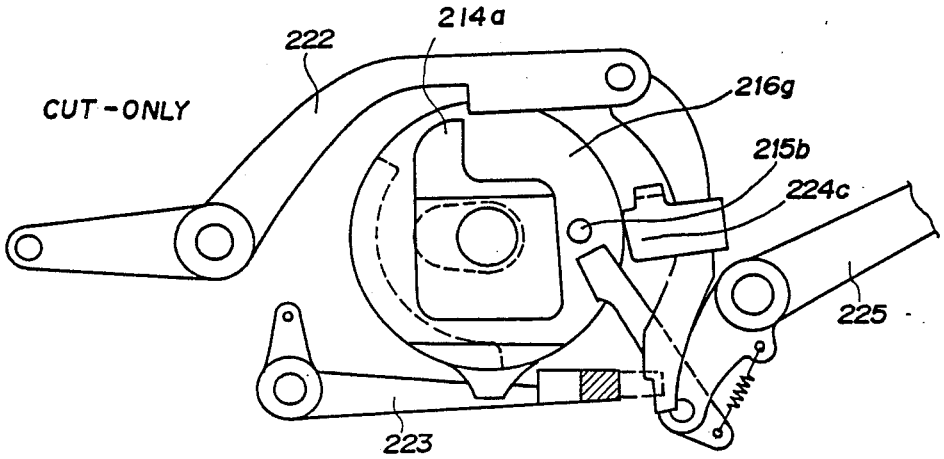
Figure 14N:
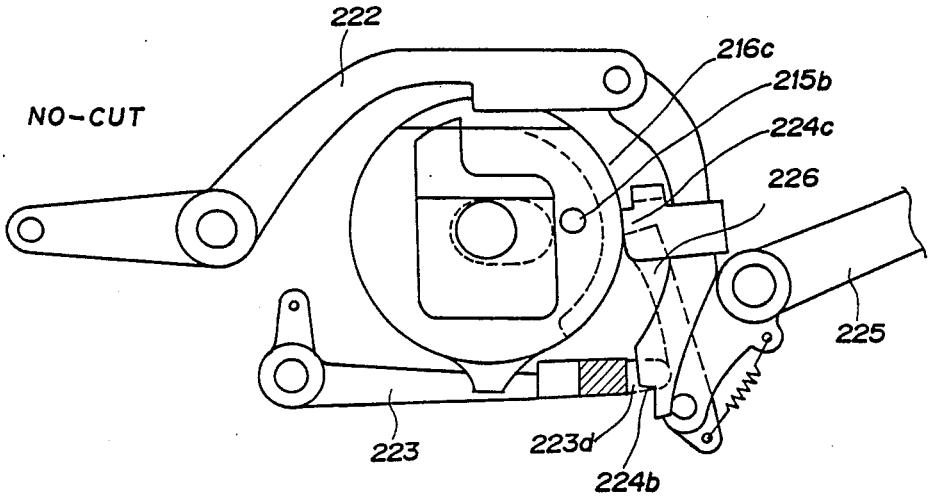
Figure 14P:
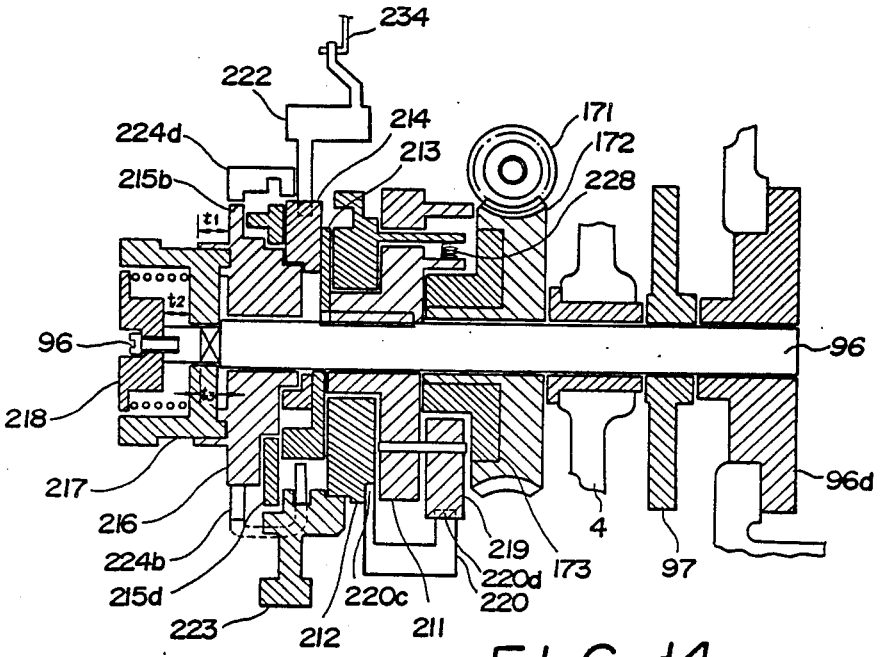
Figure 14O:
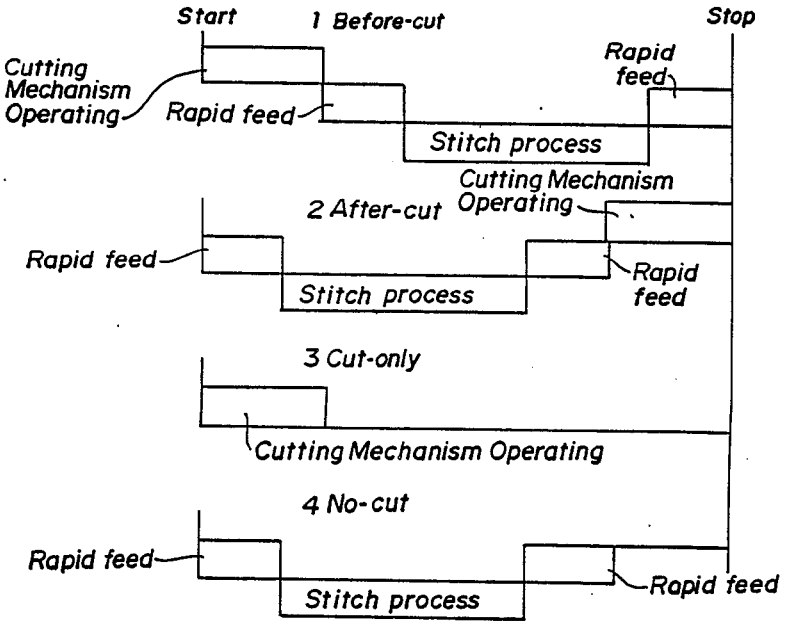

In the before-cut mode, the starting lever plate 226 does not abut the protrusion 216*g* of the buttonhole cutting mode cam 216 (see FIGS. 14 and 14*a*–14*o*) but it abuts on the outer circumference of the hub portion 218*h* (see FIG. 14*k*). The control plate driving stud 215*b* of the starting control plate 215 is positioned slightly above the starting lever plate 226. When the starting lever 225 of the mode change-over mechanism 210 is pushed down in this condition, the starting lever plate 226 pushes up the control plate driving stud 215*b* counterclockwise against the control plate counter spring 230. The cam 215*d* of the starting control plate 215 engages stopper arm shaft screw 233*b* of the cutting shaft stop arm 233, so that the plate 215 pushes down the cutting shaft stop arm 223 against the cutoff lever spring 229*c* and the hook 225*a* thereof is disconnected from the step 212*d* of the cutting control cam disc 212. The cutting control cam disc 212 is turned counterclockwise by the cutting control cam spring 228, so that the cam follower 220*c* of the cutting clutch cutoff lever 220 on the cam 212*c* is disconnected from the cam 212*c* and the hook 220*d* is disconnected from the hook portion 219*b* of the buttonhole cutting clutch hook 219. The hook portion 219*a* of the buttonhole cutting clutch hook 219 is caused to bite into the cutting shaft driving ratchet 173 of the driving portion of the cutting mechanism 80 by the clutch hook spring 227. Thus, the buttonhole cutting shaft 96 of the driven portion is rotated. In response to the rotation of the buttonhole cutting cam 97, the lever 88 is rotated about the pin 90 as a pivotal point through the buttonhole cutting cam follower 93, and the arm 6 is turned against the elastic force of the spring 81 through the screw and the receptacle 92 of the pressure adjusting means, so that the cutting block 5*a* is engaged with the cutting knife 5. Consequently, the work or cloth is cut and the buttonhole eyelet is formed.

The cutting pressure can be adjusted by the rotation of the screw 91 which is the pressure adjusting means. Since the pressure adjusting means is interposed between the lever 88 and the arm 6, the adjustment of pressure can be easily performed. In the case where a workpiece or cloth of abnormal thickness or a foreign matter (needle, pin, etc.) is inserted between the cutting knife and the cutting block so that the sewing machine is stopped and locked, the machine can be extremely easily set free by loosening the adjusting screw 91. In this case, as shown in FIGS. 15*a* and 15*b* the buttonhole cutting cam 97 moves up rapidly from the holdup portion A to the increased diameter portion B and passes through the transposition portion C in the time of T1, further passes through the shift portion D to reach the wide-angle portion E, in the time T2, where the stroke St of the cutting block arm 6 increases progressively, and then engages with the work or cloth of thickness t to cut the same (during the time T3). In the first half of the time T4, the cutting block arm continues its stroke beyond the thickness t of the work or cloth and due to the elastisity the cutting knife 5 and the cutting block 5*a* engage with each other firmly. In this case, since the rotational ratio of the motor M to the buttonhole cutting shaft 98 is set about 100 to 3 and the buttonhole cutting cam 97 is formed as described above, the work or cloth can be cut with low driving power and the mechanical sounds generated during the cutting operation can be minimized.

After the cloth ls cut off, the buttonhole cutting cam 97 passes through the shift portion F and the transposition portion G, and reaches the holdup portion A through the decreased diameter portion, in the time T5.

As described above, the whole circumference of the cam 97 is effectively utilized to lower the arm greatly till the cutting block 5*a* meets the cloth, and on the other hand, to lower the arm 6 gradually after the cutting block 5*a* has met the cloth.

When the arm 6 of the cutting mechanism 80 is rapidly raised, the cam portion 214*a* of the starting cam 214 pushes up the cam follower 222*i* of the main cam control arm 222 because it projects outward from the window 213*c* of the starting cam case 213, so that the main cam stop lever rod 234 (see FIGS. 2, 14 and 26) is pushed down about the main cam control arm shaft 222*c* as a pivotal point. The buttonhole cutting shaft 96 is further rotated and the hook 223*a* of the cutting shaft stop arm 223 is stopped on the step 212*d* (see FIG. 14*g*) of the cutting control cam disc 212. On the other hand, the buttonhole cutting clutch wheel 211 (serving as the clutch means) is rotated counterclockwise while extending the spring 228, by the continuous rotation of the buttonhole cutting cam 97. The top hook 221*a* of the cutting clutch wheel pawl lever 221 is fitted in the step 211*f* (see FIG. 14*h*) of the buttonhole cutting clutch wheel 211 so as to prevent the latter from reversely rotating, while the cam 212*c* of the cutting control cam disc 212 pushes up the cam follower 220*c* of the cutting clutch cutoff lever 220. The hook 220*d* engages with the hook portion 219*b* of the buttonhole cutting clutch hook 219 and as the buttonhole cutting clutch hook 219 rotates, the hook portion 219*a* is disconnected from the cutting shaft driving ratchet 173, so that the operation of the cutting mechanism 80 is stopped.

As described above, according to the mode change-over mechanism 210, the buttonhole cutting mode can be simply changed over by setting the mode switch dial, since the buttonhole cutting shaft of the driven portion is provided separately from the driving power system is with a clutch mechanism.

Next, when the main cam stop lever rod 234 is lowered, the one end portion 235*b* of the lever 235 of the rapid feed mechanism 103 (see FIGS. 26 and 28*a*–28*c*) is lowered to be disengaged from the the cam 325 of the control cam mechanism 300, and caused to slide on the cam face 325*a*. At the same time, the main cam stop lever link 237 (see FIG. 28*c*) is advanced left and rotated counterclockwise about the driving fork shaft 236*a* as a pivotal point. The rapid feed clutch driving blocks 236*c* of the rapid feed clutch driving fork 238 and the block 237*e* of the main cam stop lever link 237 lower the rapid feed clutch driving fork 238 through the driving fork shaft 238*a*, so that the rapid feed clutch ring 184 of the driving power transmission system is lowered and engaged with the rapid feed driving section 185 provided on the rotating rapid feed shaft 102 through the one-way clutch 186. Consequently, in the rapid feed mechanism 103, the change-over clutch 184 and the driven gears 183, 182 are rotated and the rapid feed gear 309 (see FIG. 20) provided on the main cam 301 of the control cam mechanism 300 is rotated, so that the work clamp carrier cam follower 316 comes into the uniform motion zone 310*h* of the cam groove 310 and the work clamp carrier is fed rapidly at a uniform speed.

As the sector gear driving cam follower 358 and the feed across cam follower 01 move in the uniform diameter portions of the cam grooves 323 and 324 respectively, offset of eyelet stitches and turning, which will be described later, does not occur at that time.

The base plate spreader cam followers 1027 of the work clamp mechanism 1000 are engaged with the cam 5*d* so that the work clamp base plates 1021 are spread right and left in parallel with each other against the elastic force of the base plate pressure spring 1032 through the base plate spreader stud screw 1033, the spreader Pin lever plates 1029, the base plate spreader levers 1030, the base plate pressure slides 1031 and the parallel guide pins 1031*c*. Thus, the work clamp carrier 3 is further forward fed rapidly under while the buttonhole portion cut in the work or cloth is spread. The amount of spread i.e. the width. So (see FIG. 8*a*) can be adjusted independently right or left by changing the lateral position of the adjusters 1026*b*. Since the adjusters are elastically urged so, apart outward by the spring 1028*c* in adjusting the amount of stretch, backlash between the work clamp base plates 1021 and the adjusters 1028*b* can be prevented, thereby facilitating the operation of adjustment.

(Safety in Mode Change-over )

In the above-mentioned mode change-over mechanism 210, various safeguard features are included. When the starting lever 225 is pushed down, the starting lever plate 226 pushes up the control plate driving stud 215*b*, the cam 215*d* pushes down the citting shaft stop arm 223 by engagement with the cam follower 223*b* of the arm 223, the cutting control cam disc 212 rotates since the step 212*d* thereof is disconnected from the hook 223*a* of the cutting shaft stop arm 233, and the misoperation-preventing pin 222*h* of the main cam control arm 222 comes in the circumference groove 212*e* of the the cutting control cam disc. Therefore, there is no risk that rapid feed might occur during the operation of the cutting mechanism 80, since the main cam control arm 222 is not lifted.

In starting, the stopper portion 225*b* of the starting lever 225 enters the recess portion 211*g* of the buttonhole cutting clutch wheel 211, the wheel 211 is rotated, and the lever 225 is rotated counterclockwise to return, and then the stopper portion 225*b* engages the outer circumference 211*b* of the wheel 211 so that the lever 225 is prevented form being pushed down. Thus, the starting lever 225 is prevented from being pushed down twice, thereby providing a fool-proof effect.

(Stitch Formation )

The length X (see FIG. 6*a*) of a buttonhole is set to a desired value in advance. To this end, in the buttonhole length adjusting mechanism 974 (see FIGS. 7*a*, 21, and 21*a*–21*c*), the buttonhole length set screw adjuster 989 may be loosed to adjust the buttonhole length indicator 990 of the buttonhole length adjusting block 982 to a suitable value on the scale 988*a* of the buttonhole length scale plate 988. By adjusting the stitch adjusting screw adjuster 986, it is possible to make the right and left starting ends of stitches agree with the terminal ends.

Figure 18:
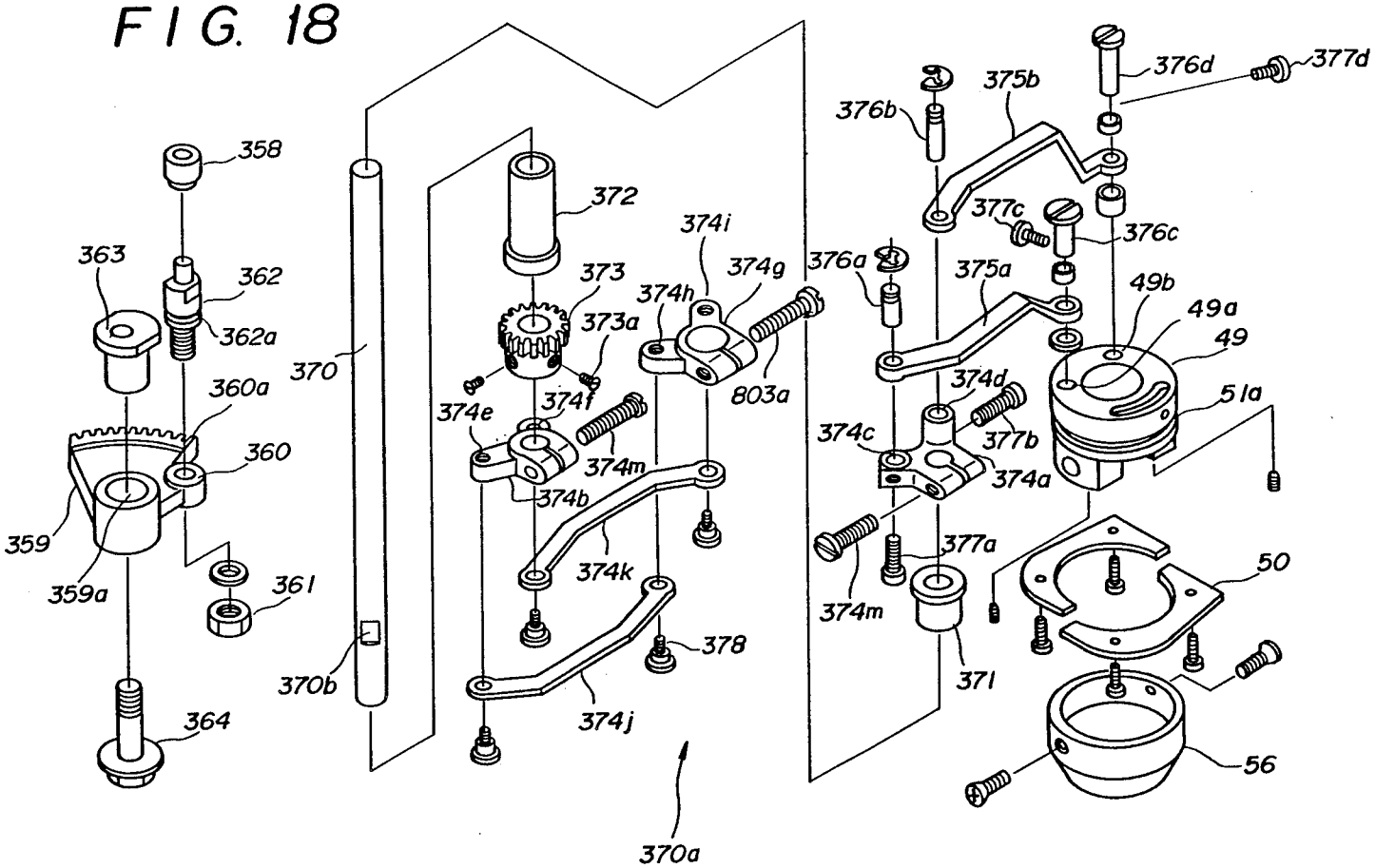
FIG. 18 is an exploded perspective view showing the turning mechanism for the needle bar, looper, and spreader of the same sewing machine.
Figure 19C:
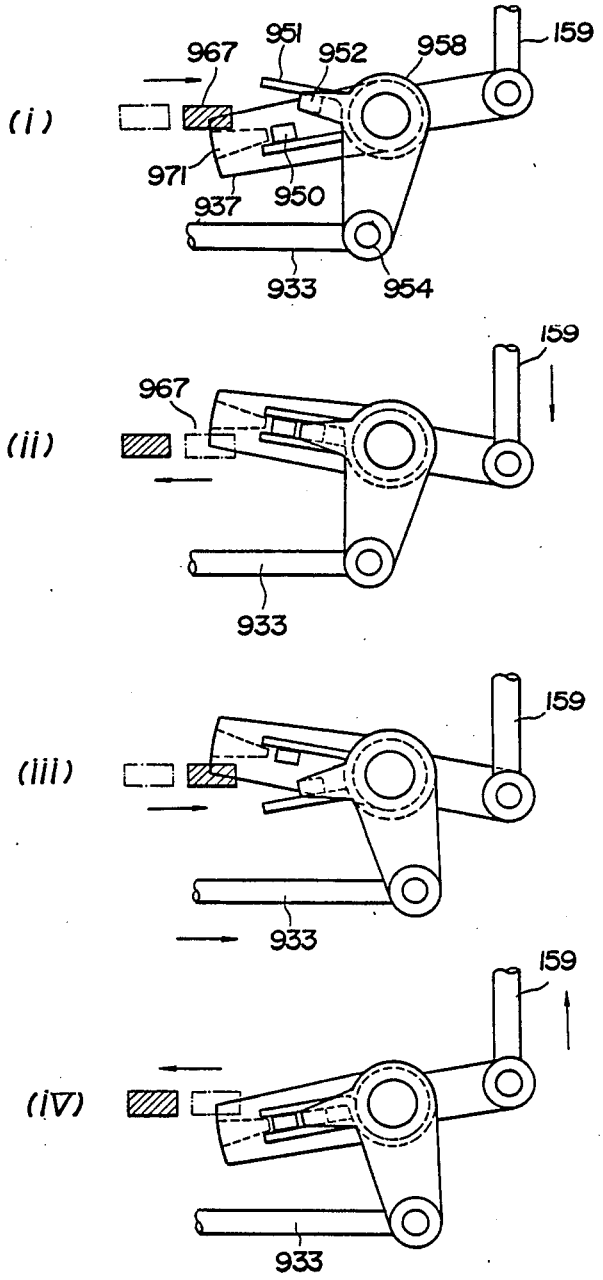
FIGS. 19*a*–19*c* are diagrams for explaining the operation of the same clutch driving device.
Figure 19A:
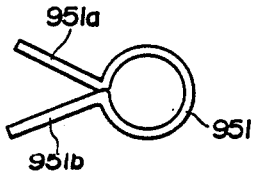
Figure 19B:
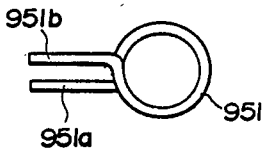

When the work clamp carrier 3 advances and the control cam 981 of the trigger movable member 980 engages the stitch trigger cam foi1ower 978 so that the buttonhole length X is detected, the switch trigger cam roller arm 976 is rotated and the switch trigger lever 966 of the clutch driving device 930 (see FIGS. 7*a*, 19 and 19*c*) is also rotated through the switch trigger lever shaft 973, so that the arm 967 (see FIG. 19*c*(*i*)) on the abutting portion 971 of the control switch arm 937 is caused to disengage therefrom (see FIG. 19*c*(*ii*)). Accordingly, the elastic force which has been stored in the control switch arm spring through the lever 931, the rod 933, the arm 938, and the turning mechanism 370*a* (see FIGS. 2, 7*a* and 18) by the control cam mechanism 300 in the period of rapid feed, is released by the arm 967 and the lower rod 159 is lowered. Thus, the driving power clutch mechanism 100 (see FIGS. 2, 7*a*, 13 and 13*a*) is changed over from the rapid feeding mode to the stitch feeding mode.

Figure 13:
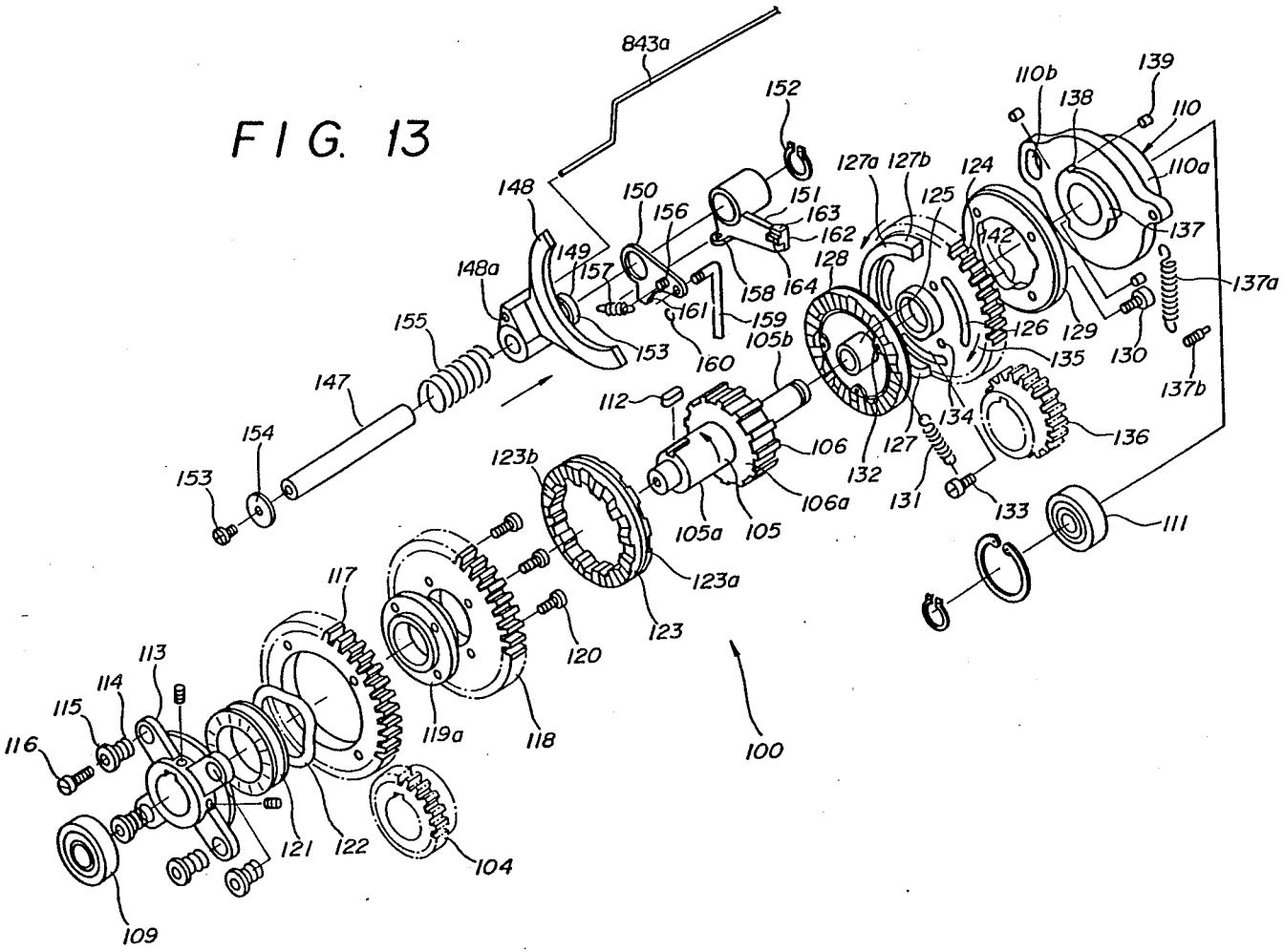
FIGS. 13 and 13*a*–13*b* are explanatory diagrams showing the power change-over mechanism of the same sewing machine.
Figure 13B:
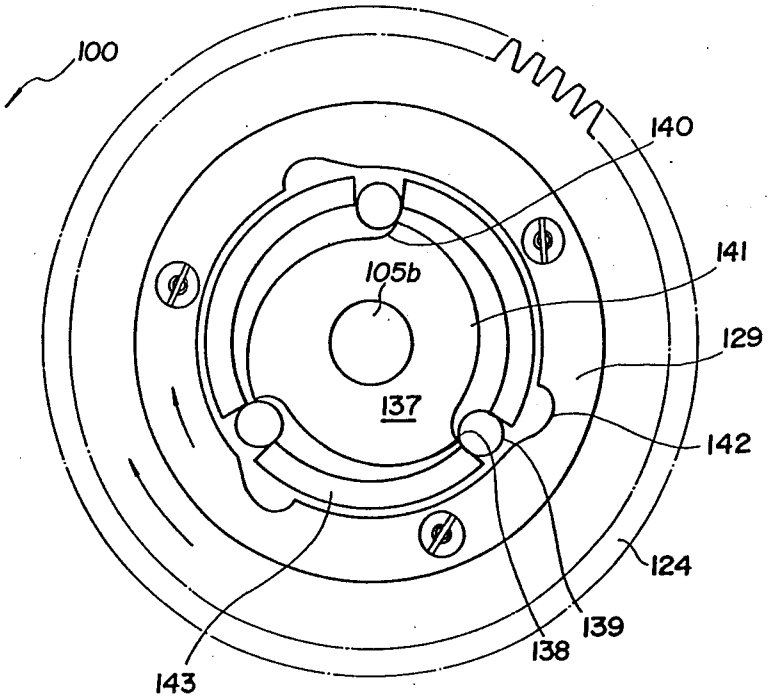
Figure 13A:
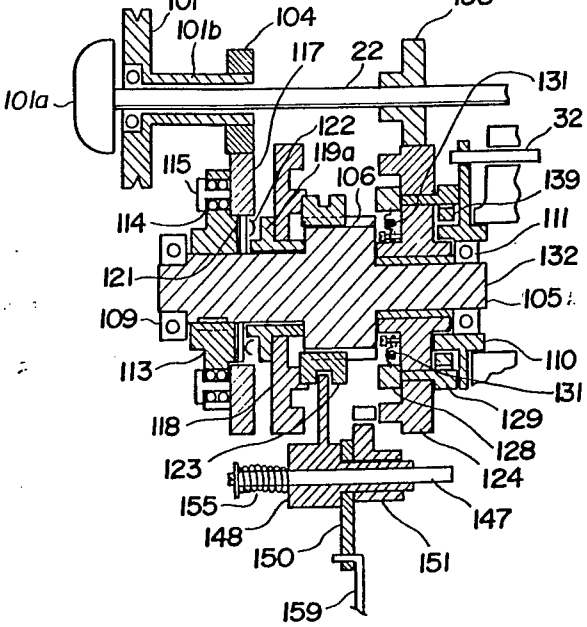

That is, the clutch driving link 150 in the clutch mechanism 100 is rotated clockwise in FIG. 13 against the spring 157, and the abutting portion 161 is caused to engage on the bracket 158 of the rapid feed clutch arm 51, so that the rapid feed arm 151 is rotated clockwise. Since the clutch shaft 105, that is, the arm shaft driving gear 124, has slowed in its speed to a half as compared with the arm shaft 22 driving the needle the abutting portion 162 is disengaged from the cam face 127*a* with a half revolution of the control cam 127 and the clutch actuator 148 is moved right in FIG. 13 by the spring 155. Thus, the clutch ring 125 is pushed right. The rapid feed clutch gear 118 is disconnected from the clutch ring 123 and the rapid feed shaft is stopped from rotating. On the other hand, the clutch ring 123 is engagement/locked on the engagement/locking portion 128 and the clutch shaft 105 is connected to the portion 128. The clutch shaft is rotated counterclockwise in FIG. 13 and the hollow 142 of the release cam 129 causes the arm shaft brake cam roller 139 to escape radially outward from the stop position cam 137, so that the arm shaft driving gear 124 and herefore the arm shaft gear 136 are rotated, the arm shaft is driven, and the vertical shaft 27 is also rotated through the bevel gears 26 and 28. When the clutch mechanism 100 is changed over to the stitch feeding mode, the thread tension releaser 843 (see FIGS. 5, 7*a* and 13) linked with the clutch actuator 148 through a thread tension releaser rod 843*a* received in the hole 148*a* gives tension to the needle thread.

As should be clear from the above, the clutch mechanism 100 can be operated within one pitch of stitch feeding so as to be surely changed over from the rapid feeding mode to be stitch feeding mode, within one pitch of stitch feeding, and further, the clutch mechanism makes it possible to greatly reduce shocks in change-over operation to thereby improve the durability of clutch.

(Vertical Motion of Needle Bar )

The needle bar crank 851 is rotated by the arm shaft 22 and the needle bar crank rod 852 is caused to trace such a focus as shown as the arc 857 (see FIGS. 10*a*–10*c*) through the needle bar crank pin 853, so that the other rod end 852*b* connected to the ball-and-socket joint 855 is reciprocated and the needle bar 20 is caused to move up/down.

In this case, as the transmission system from the arm shaft to the needle bar has only two connection, backlash can be minimized and mechanical bending can be reduced. Therefore, the needle bar can be driven with high accuracy and the adjustment of up/down motion of the needle bar can be performed easily.

On the other hand, in the needle thread take-up mechanism 830 (see FIGS. 7*a* and 25), the fork 841*a* is vibrated by the arm shaft 22 through the needle thread take-up eccentric 836 so that the needle thread 848 passing along the illustrated thread path is vibrated by the needle thread take-up 841.

(Needle Vibration )

When the vertical shaft 27 is rotated, the needle vibrating fork 30 is caused to move to-and-fro horizontally through the needle vibrating eccentric 29 (see FIGS. 7*a*, 24, 24*a* and 24*b*), so that the bell crank 35 is vibrated through the rod 32 with the index disc shaft 34 as a fulcrum point. Accordingly, the rod 44 is moved up and down and the sleeve 45 and the cut ring coupler 47 are driven up and down. Since the lever 50*c* pivoted in the hole 50*b* is pivotally attached on the needle turning frame 49 by the pins 51 fitted in the pivot hole 50*a*, the buttonhole cutting mode cam 218 pivoted onto the lever 50*c* by the hinges 53 is vibrated laterally, and consequently, the needle bar 20 is vibrated laterally. This condition is shown in (I) and (II) in FIG. 24*b*.

Timing is such that the needle is moved (vibrated) laterally when the needle 11 linked with the needle bar 20 is disengaged from the work or cloth due to the above-mentioned vertical motion of the needle bar.

The slide block section 37 provided on the needle vibrating crank 36 of the bell crank 35 functions as an amplitude adjuster which changes the amount of vibration of the lever 50*c* and adjusts the amplitude Sl of the needle bar 20 (see FIG. 6*a*).

The eccentric hole 39 formed in the needle point adjusting index disc 38 functions as a needle point adjuster which changes the pivot point of the bell crank 35 relative to the sewing machine body by turning the sewing machine and, accordingly, adjusts the width So (see FIG. 8*a*) of the slit s. Therefore, the constituent members such as bell crank 35, etc., can be disposed within the arm of the machine body, and this is desirable for the sake of appearance. Moreover, by exposing the needle point adjusting index disc 38 outside, it is possible to adjust the needle point in buttonhole stitching.

(Motion of Looper and Spreader)

Figure 11:
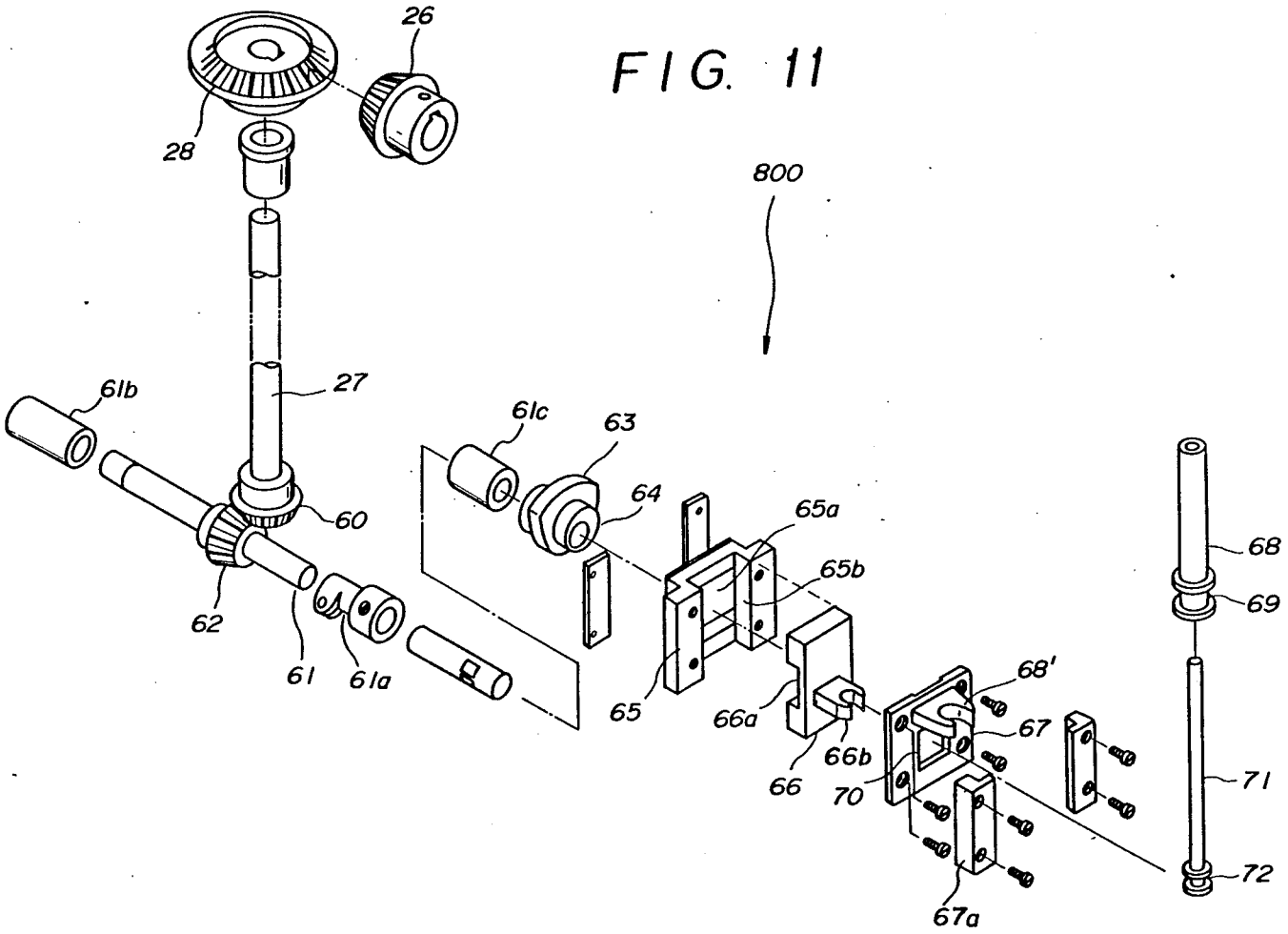
FIGS. 11 and 11*a* are explanatory diagrams showing the looper-spreader mechanism of the same sewing machine.
Figure 11A:
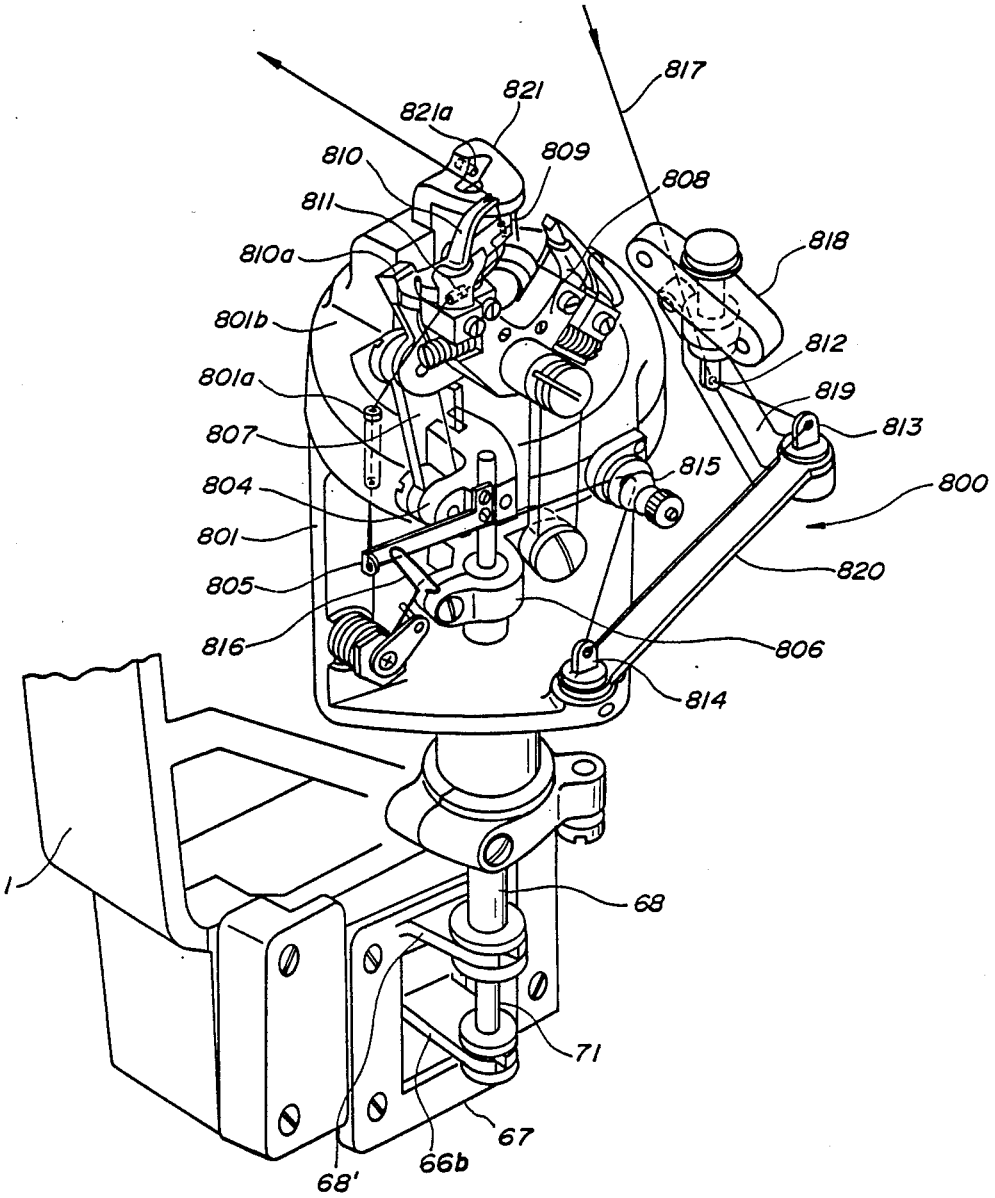

The driving power is transmitted to the bed shaft 61 through the level gears 60 and 62 from the vertical shaft 27 extending through the center of the disc-like main cam 301 in the control cam mechanism 300 (see FIGS. 11 and 11*a*). The looper cam follower 65 and the spreader cam follower 66 are moved up and down independently of each other by the looper driving cam 63 and the spreader eccentric cam 64 provided on the bed shaft 61, so that the looper connection rod 68 and the spreader connection rod 71 rotatably connected to these cam followers are moved up and down. Although the looper 809 and the spreader 910 are driven through those rods 68 and 71, the looper and spreader driving connections 806 and 804, the looper carrier 808, and the spreader driving plate 810*a*, these mechanisms and functions thereof are known and therefore the description thereabout is omitted here.

(Stitch Feeding)

In the stitch feeding, the work clamp carrier 3 is fed step by step by the feed driving portion 330*b* in the driving power transmission system 330*c* (see FIGS. 22, 22*a* and 22*b*) from the vertical shaft 27. By the feed driving cam 330*a* provided on the vertical shaft 27, the feed driving lever 332 is vibrated with the slider 354 as a pivotal point, and the main cam driven lever 334 is vibrated. The main cam driven lever 384 gives a stepping rotatory motion to the main cam shaft 302 through the main cam driving one-way clutch 305. The main cam shaft 302 supports the main cam concentrically, and the main cam shaft 302 and hence the main cam 301 steps forward one pitch corresponding to one revolution of the vertical shaft 27, so that the work clamp carrier 3 is caused to step forward one stitch after one stitch by the uniform motion zone 310*b* of the cam groove 310 (see FIG. 20*a*) and the work clamp carrier cam follower 316.

The stitch length adjusting block 344 is displaced by turning the stitch length adjusting screw 349 to change the position of the slider 354 to thereby adjust the number of stitches, that is, the pitch of stitches.

Thus, the main cam shaft 302 is driven directly step by step, and the irregularity of pitches in transmission system can be minimized. Further, since the stitch length adjusting screw 349 is a screw means, stitch pitches can be adjusted easily.

(Intermittent Brake)

During the period when the main cam 301 of the control cam mechanism 300 is rotating for stitch feeding, the rapid feed driving section 185 is rotated through the gear 309, the main cam driving gear 182 and the rapid feed clutch ring 184 by the main cam 301, while the rapid feed shaft 102 is prevented from rotating by the rapid feed driving section 185 (FIGS. 28, 28*a* and 26*b*).

On the other hand, with respect to the bed shaft 61, the brake control cam follower 200 (which is provided on the lever 191 pivoted to the bed stand 1 by the shaft 190) is driven up and down by the hit-up portion 204 (see FIG. 26*b*) of the brake cam 202 fixed on to the bed shaft 61, so that the main cam brake disc 193 is pressed against the brake lining member 187*a* of the rapid feed driving section 185. The brake lining member 187*a* of the rapid feed driving section 185 is caused to frictionally engage the main cam brake disc 193, and the brake control cam 202 is timed such that braking is made effective slightly before the position where the main cam 301, and hence the work clamp carrier 3, is to be stopped, in order that the needle 11 is made to engage the workpiece. As a matter of course, the main cam brake disc 193 is prevented from rotating by the brake disc pin 206, the brake control lever 191, and the brake control lever shaft 190.

In rapid feeding of the work clamp carrier 3, the bed shaft 61 is not rotated and the brake control cam follower 200 is located at a brake releasing portion (the position of the cam follower as indicated by the dotted line in FIG. 26*b*) of the brake control cam 202. On changing-over the mode into the stitch feeding, if the needle 11 comes down in a work or cloth during the motion of the work clamp carrier 3, there is a risk of needle breakage because of inertia of the work clamp carrier 3 which has been in rapid feeding. Accordingly, the main cam brake disc 193 is urged against the rapid feed clutch disc 185 (the brake lining member 187*a*) by the hit-up portion 205 of the brake control cam 202 to thereby apply braking once to the main cam 301, and hence the work clamp carrier 3, immediately before the needle is inserted into the workpiece in the stitch feeding.

In the conventional sewing machine for buttonhole stitching, the work clamp carrier has been controlled by winding a brake belt around the main cam to thereby absorb the backlash during operation. In the sewing machine according to the present invention, however, braking is applied to the work clamp carrier 3 through the main cam by the brake mechanism 187 only during the period where the needle is piercing a workpiece while the braking is released in stitch feeding so that it is possible to reduce the driving torque to enable a small-sized motor to be employed.

(Buttonhole Offset Formation )

As described above, present is concerned with the case where an eyelet buttonhole stitching mode has been selected. Accordingly, in the eyelet-straight change-over mechanism 900, the feed across driving lever 903 having the feed across cam follower 901 controlled by the main cam 301 included in the control cam mechanism, and the feed across driving arm 922 for vibrating/offsetting the work clamp carrier 3 laterally through the feed across driving arm block 925, are connected to each other by the feed across connection latch 911 which is now locked in the clutch groove 903*b* (see FIGS. 7*a* and 23).

After the feed across cam follower 901 has reached the transposition portion 324*a* ( point A in FIG. 20*b*) of the cam groove 324, the feed across cam follower 901 is rotated clockwise in the drawing through the feed across driving lever 903 about the feed across driving arm shaft 906 as a fulcrum. Accordingly, the feed across driving arm 922 is rotated clockwise through the feed across connection latch 911 and the work clamp carrier 3 begins to be offset left with respect to the needle bar 20 when viewed from the front by the feed across driving arm block 925 and the bed guide groove 3*c* (see FIG. 8) with the hole 314, that is, the shaft 311 (see FIG. 20) of the work clamp carrier roller 316, as an axis of rotation. This offset operation is continued till the feed across cam follower 901 reaches the point B in the transposition portion 324*a* of the eyelet-straight change-over groove cam 324. At that time, the sector gear driving cam follower 358 is positioned in the terminal point E of the uniform small diameter section 323*a* of the cam groove 323.

(Turning of Needle Bar, Looper and Spreader)

When the sector gear driving cam follower 358 has passed through the above-mentioned position and reaches the uniform large diameter section 323*b*, the stitch turning shaft 370 begins to be pivoted through the sector gear wheel 359 and the stitch turning shaft gear 373 (see FIGS. 7*a* and 18). The stitch turning shaft 370 turns the needle turning frame 49 and the looper frame 801 (see FIG. 11*a*) through the parallel links 375*a*–357*b* and 374*j*–374*k* respectively.

On the other hand, a portion 967 of the clutch driving device 930 has been returned to the lower portion of the abutting portion 971 of the arm 937 by the spring 989 (see FIG. 19) before the above-mentioned turning is initiated (the portion 967 is indicated by a dotted line in FIG. 19*c* (*ii*)). When the foregoing turning has been finished completely, an elastic force is stored in the control switch arm spring 951 as shown in FIG. 19*c*(*iii*). The elastic force is used in the change-over operation from the stitch feeding mode to the rapid feeding mode.

When the feed across cam follower 901 is at an angle of 270 degrees in the groove cam 324 of the main cam 301, the sector gear driving cam follower 358 is at an angle of 0 degree in the groove cam 323 and the work clamp carrier cam follower 316 is at an angle of 180 degrees. At this time, the work clamp carrier 3 is not fed across, but it is in alignment with the needle bar and located in the frontmost position. The feed across cam follower 901 is at an angle of 270 degrees in the transposition portion 324*a* of the cam groove 324, and, reversely, the work clamp carrier 3 is offset so as to move left with respect to the needle bar 20 when viewed from the front by the feed across cam follower 901 and the transposition portion 324*a* of the cam groove 324. When the sector gear driving cam follower 358 has reached the point F (see FIG. 20*b*), the feed across cam follower 901 is at the point C, and moreover, the feed across cam follower 901 is the point D, so that the offset is finished and the work clamp carrier 3 is returned to the center.

On the other hand, as described above, the lever 909*a* of the eyelet-straight change-over mechanism 900 is shifted so that the eyelet mode is selected. Therefore, the rod 914 is moved right in FIG. 23 by the change lever link 913, and the free end 917*a* of the stitch reduce rod 917 is shifted in the direction of the arrow 917*b* through the stitch reduce crank 916. Accordingly, the free end 917*a* abuts on the rear end portion 343*b* of the stitch length adjusting bracket 343 in the stitch number adjuster 330*e* (see FIG. 22) of the stitch forming mechanism 330. The stitch reduce cam follower 356 is provided with the spring 355 so that it can not go into the stitch number adjusting outer circumference cam 322 (see FIG. 20*b*). Thus, the point of action 347 (see FIG. 22) of the feed driving lever 332 is not changed during the turning operation, and accordingly, the vibration angle of the force point of the main cam driven lever 334 is not changed, that is, neither the pitch of the main cam 301 nor the feed of the work clamp carrier 3 is changed.

Figure 23:
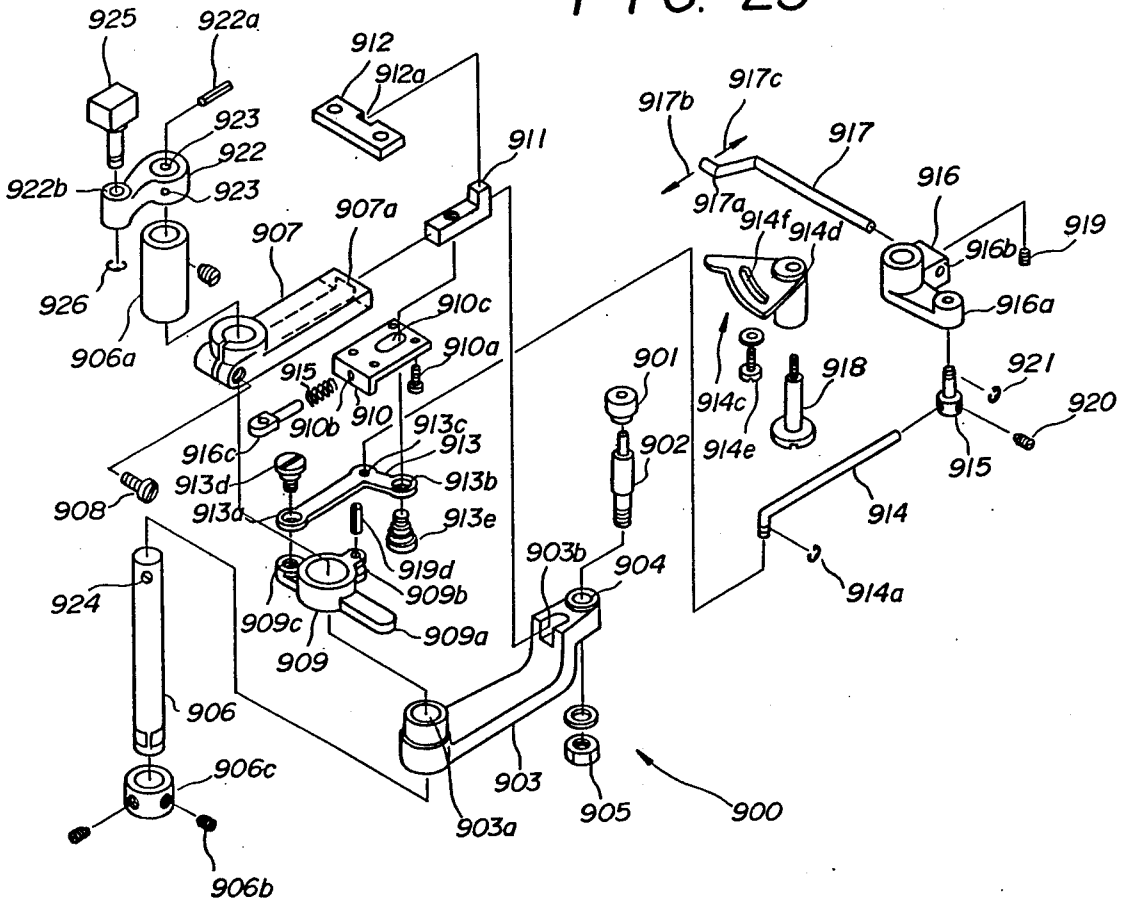
FIG. 23 is an exploded perspective view of the eyelet-straight change-over mechanism in the same sewing machine.
Figure 24:
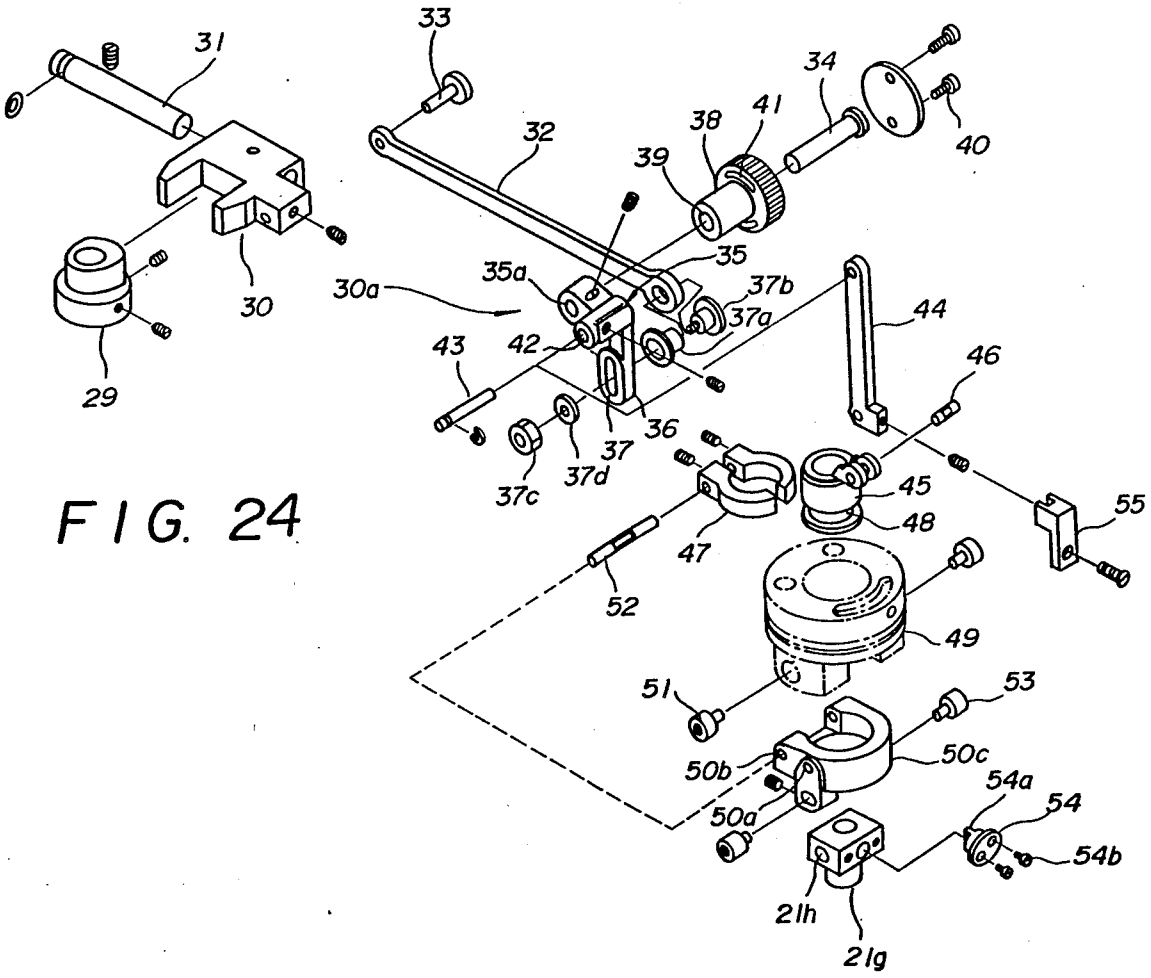
FIG. 24 is an exploded perspective view of the needle vibrating mechanism in the same sewing machine.
Figure 24A:
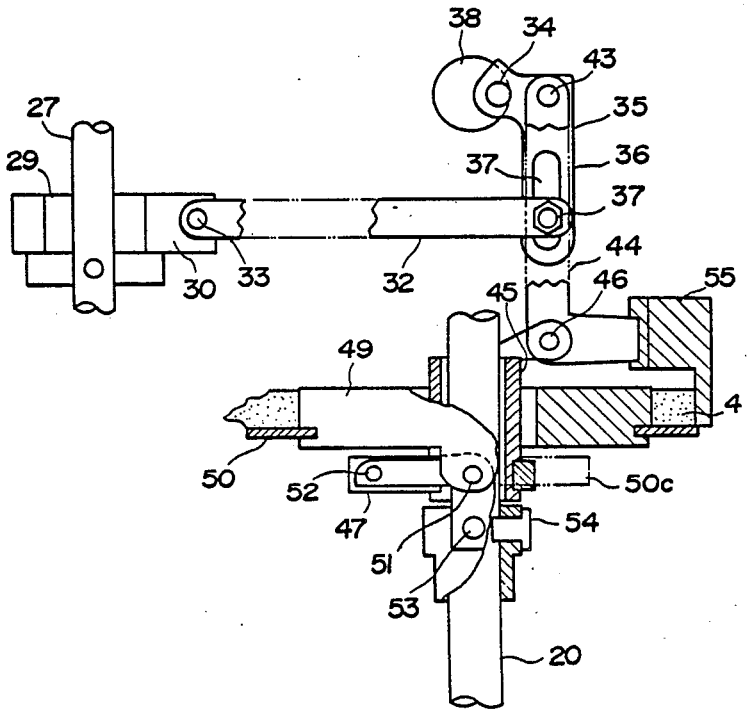
FIG. 24*a* is an explanatory diagram of a part of the same needle vibrating mechanism.
Figure 24B:
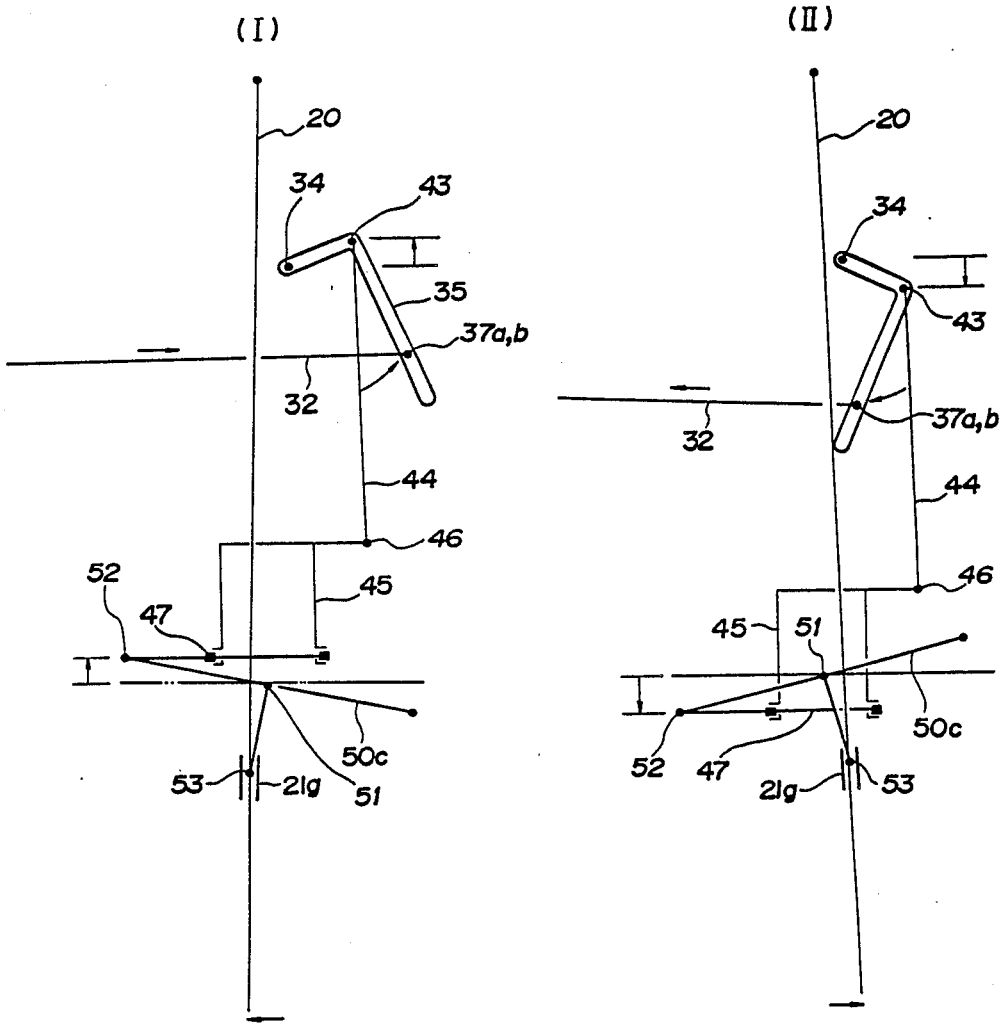
FIG. 24*b* is an explanatory diagram of the operation of the same needle vibrating mechanism.

If necessary, the number of stitches can be adjusted during the turning operation by rotating the adjusting portion 914*c* (see FIG. 23).

During the turning, one end of the link 819 of the thread pathway means is pivoted on the fixed thread guide 812 of the looper thread guide link bracket 818, one end of the guide link connection rod 820 is joined to the link 819 by the looper thread guide 813, and the other end is pivoted to the looper frame 801, thereby forming the turn thread guide 814. Therefore, with the turning of the looper frame, the distance between the fixed thread guide 812 and the turning thread guide 814 is constant, and the tension of the thread is hence constant. Therefore, it is possible to form stitches with the thread in good condition and which have a good appearance.

The work clamp carrier cam follower 316 advances along the work clamp carrier cam groove 310, while, reversely, the work clamp carrier 3 recedes, so as to stitch the slit s of a buttonhole.

Figure 21:
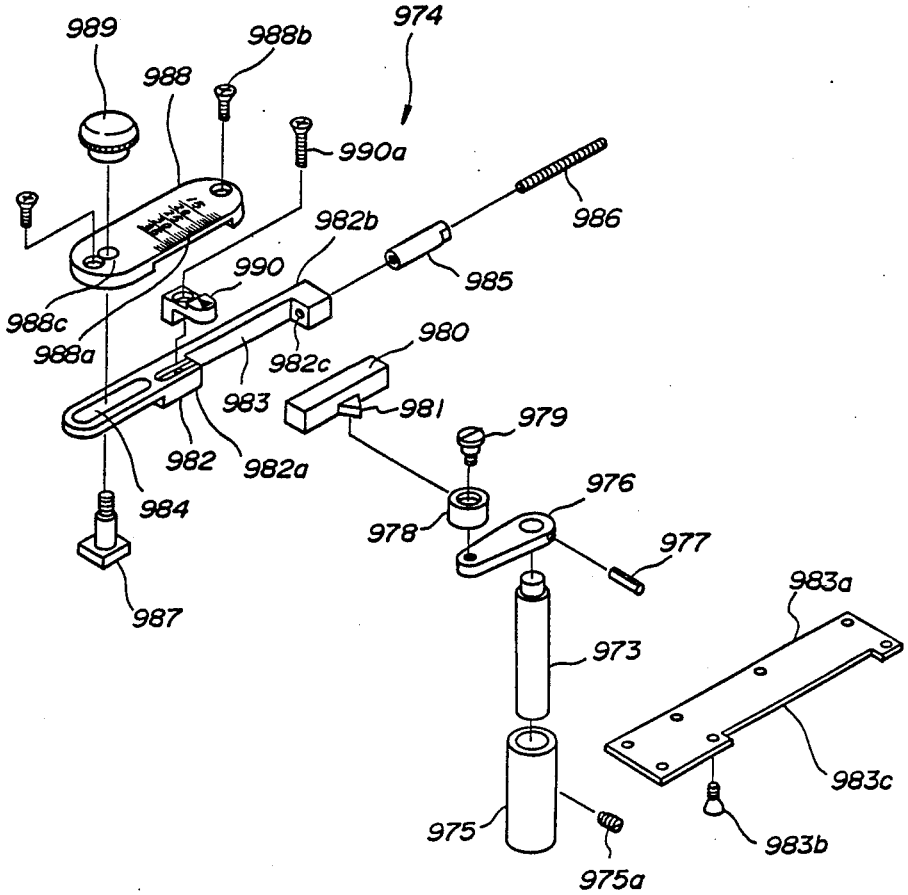
FIG. 21 is an exploded perspective view of the buttonhole length adjusting mechanism in the same sewing machine.
Figure 21A:
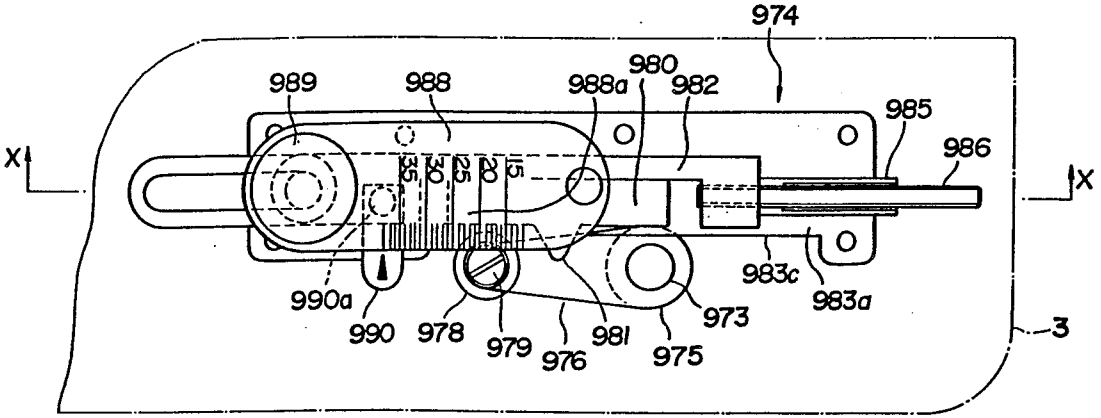
FIG. 21*a* is a plan view of the same buttonhole length adjusting mechanism.
Figure 21B:
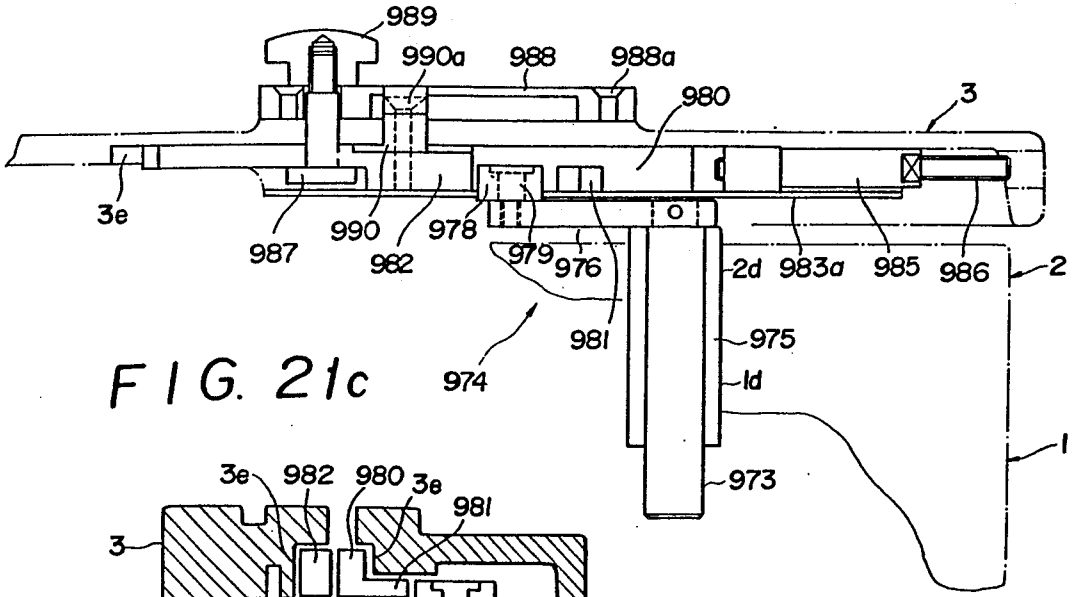
FIG. 21*b* is a sectional view along line X—X in FIG. 21*a;*
Figure 21C:
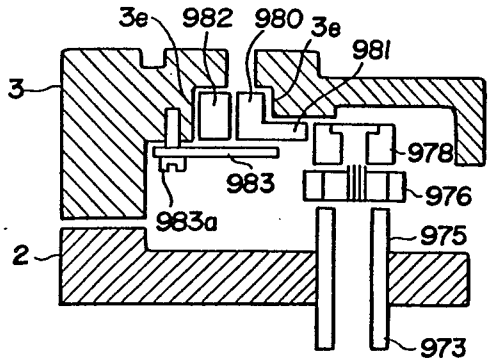

As the work clamp carrier recedes, the trigger movable cam member 980 is shifted from left to right in FIG. 21 upon completion of stitching over the buttonhole length X defined in advance as described above, and the control cam 981 causes the switch trigger cam follower 978 to swing as the result of detection of a buttonhole to thereby rotate the shaft 973 of the clutch driving device 930 to cause the arm 967 of the switch trigger lever 966 to come off from the abutting portion 971 of the control switch arm 937 (see FIG. 19*c*(*iv*). The clutch driving rod 159 is lifted up by the elastic force accumulated in the control switch arm spring 951 during the stitch feeding, the clutch driving link 150 of the motive power clutch mechanism 100 is turned, the rapid feed clutch arm 151 is turned counterclockwise in FIG. 13 through the spring 157, the abutting face 163 of the rapid feed clutch arm 151 is brought into contact with the outer circumference of the control cam 127*b*, and the spring is extended. When the rapid feed clutch arm 151 reaches the tooth-absence portion of the cam 127*b* the arm 151 is lifted up by the spring 157 and after a succeeding half turn of the clutch mechanism 100 the abutting face 162 is urged left in FIG. 13 by the control cam 127, so that the clutch ring shifter 123 is disengaged from the arm shaft engagement/locking portion 128 and shifted left.

The engagement/locking portion 128 is returned by the spring 131.

On the other hand, by the hollow 142 of the arm shaft brake cam 129 (see FIG. 13*b*) in the needle bar stop device, the arm shaft brake cam roller 139 is urged to escape toward the stop position cam 137. The arm shaft brake cam roller 139 enters into the recess portion 140 of the stop position cam 137, so that the arm shaft driving gear 124 is stopped. Therefore, the arm shaft driving gear 124 always stops at a predetermined position, and the needle bar 20 can be stopped at an upper dead point. Shocks on stoppage can be absorbed by the O-ring 144 (see FIG. 9) and the stop position cam spring 137*a*.

If the clutch ring shifter 123 is shifted left in FIG. 13 as described above, the thread tension releaser 843 loosens the tension of the needle thread through the fork 148 and the rod 843*a*, the rapid feed clutch gear 118 is connected to the clutch ring shifter 123, and the rapid feed shaft 102 is rotated by the intermediate shaft gear 119, the rapid feed shaft driving worm 174, and the rapid feed shaft worm wheel 175 of the rapid feed mechanism 103. The rapid feed intermediate shaft 102 transmits the rotational driving power to the rapid feed driving section 185 through the rapid feed shaft one-way clutch 186. As described above, the main cam 301 of the cam mechanism 300 is turned by the rapid feed clutch ring 184, the driven portion 183 and 182, and the gear 309.

Since the needle bar 20 is at the upper dead point, the brake control cam follower 200 is at the releasing position. One end portion 235*b* of the lever 235 of the rapid feed mechanism 103 comes into the cam 325 of the main cam 301 of the control cam mechanism 300, so that the work clamp carrier 3 is stopped. Since the work clamp carrier cam follower 316 is in the uniform diameter cam portion 310*a* of the work clamp carrier groove cam 310 in the main cam 301, the work clamp carrier 3 will not move. Since the needle bar 20 always stops at a defined position, the position of cutting is constant.

When the lever end portion 235*b* comes into the stop position cam 325, the rapid feed clutch driving fork 236 is raised and the rapid feed clutch ring 184 is raised, so that the driven portions 182 and 183 are stopped from rotating, and, accordingly, the main cam 301 is stopped. At this time, the work clamp carrier cam follower 316 is at an angle of 0 degree, so that the work clamp carrier 3 is stopped at the original position and returned to the stop condition of the sewing machine. When the work clamp operating lever 1009 is returned back and the work or cloth is released from the work clamp mechanism 1000, the motor is stopped by the switching mechanism SW. Thus, one cycle of the eyelet buttonhole stitching is completed.

(Straight Buttonhole Stitching)

When the straight buttonhole (see FIG. 6*b*) is stitched, the eyelet cutting knife 5 on the cutting knife base plate 5*c* (see FIG. 15) is replaced by the straight cutting knife 5-1.

The lever 909*a* of the eyelet-straight change-over mechanism 900 (see FIG. 23) is shifted back in FIGS. 1 and 7*a* so that the straight stitch is formed. That is, the change-over lever link 913 is rotated, and the feed across connection latch 911 is disconnected from the clutch groove 903*b* of the feed across driving lever 903 and goes into the groove 912*a* of the work clamp carrier settle plate 912 fixed to the bed stand 1. Thus, the feed across driving arm block 925 is never moved and no offset is generated in a buttonhole, since only the feed across driving lever 903 is swung even if the feed across cam follower 901 is swung by the main cam 301.

At the same time, the stitch reduce connection rod 914 is moved left in FIG. 23 in response to the rotation of the changeover lever link 913, and the free end 917*a* of the stitch reduce rod 917 is shifted in the direction of the arrow 917*c* through stitch reduce crank 916. Accordingly, the free end 917*a* is disengaged from the rear end portion 343*b* of the stitch length adjusting bracket 343 in the stitch number adjuster 330*e* (see FIG. 22) of the feed driving mechanism 330. The stitch reduce cam follower 356 is caused to enter the stitch number adjusting outer circumference cam 322 by the adjusting bracket spring 355 (see FIG. 20*b*). Thus, even if the stitch length adjusting block 344 and the feed driving fork pivot block 354 are in their stationary state, the pivotal points thereof are transposed by the sliding of the stitch length adjusting bracket 343. When the stitch reduce cam follower 356 comes into the external circumference cam 322, the point of action of the feed driving fork 332 is shifted right in FIG. 22, and the swinging angles of the point of action 336 and the point of swinging force 334*a* of the main cam driving lever become larger, so that the step of the main cam shaft 302, or the main cam, that is, the stitch pitch of the work clamp carrier 3, is increased through the main cam driving clutch bearing 305.

The stitch reduction, that is, the stitch pitch increase, is timed such that the stitch reduce cam follower 356 is made to fall into the outer circumference cam 322 when the sector gear driving cam follower 358 is in a position between the points E and F of the cam groove 323.

According to the eyelet-straight change-over mechanism 900, the change-over between the feed across and the stationary modes of the work clamp carrier can be linked with the switching of the stitch number adjusting portion by one step of operation of the change lever 909*a* (see FIG. 23). That is, solely by operation of the change-over lever 909*a*, the cross feed of the work clamp carrier can be stopped, and at the same time, the stitch pitch can be increased so that the stitch number of the turning portion (see FIG. 6*b*) in the stitch feeding mode can be changed over simply.

(After-cut)

If the buttonhole cutting mode dial 217 is pulled to the front, the groove 217*a* of the dial 217 is disengaged from the straight angle portion 96*e* of the shaft 96 due to the relationship of dimensions t1, t2 and t3, however, the dial 217 is prevented from coming out by the boss of the cap 218 and the hook 216*f* of the mode cam 216 and the groove 217*a* of the dial 217 are in the state where they are linked with each other.

The mode change-over cam 216 is turned through the dial 217 so that the indication 217*b* is directed down. The cam portion 214*a* of the starting cam 214 retreats from the window 213*c* of the starting cam case 213 by action of the 216*a* of the mode cam 216 (see FIGS. 14, 14*a*–14*k*, and 14*m*). When the starting lever 225 is pushed down, the starting lever plate 226 is caused to abut the external circumference 216*c* of the mode cam 216 and, at the same time, the joint portion 224*c* of the cutting starter lever 224 is caused to fall on the step 216*b* of the mode cam 216. Although the guide portion 224*a* of the lever 224 has been in the slit portion 223*c* of the cutting shaft stop arm 223, the guide portion 224*a* is caused to come to the axial center by the amount of the downward motion of the step 216*b*, so that the step 224*b* of the lever 224 rides on the abutting portion 223*d* of the cutting shaft stop arm 223. Thus, "after-cut mode" is set up.

The selection of the lever 909*a* in the eyelet-straight change-over mechanism 900 and its action are the same as described above in "before-cut mode".

Since the starting lever plate 226 is riding on the outer circumference 216*c* of the cam 216 and the stud 215*b* of the starting control plate 215 is hiding in the ring space 216*c* of the cam 216 after the starting lever 225 has been pushed, the arm 216 can not press the stud 215*b* of the starting control plate 215. Since the lever 224 has been moved to the axial center, the starting lever plate 226 can hit up the hit-up portion 224*d* of the lever 224. The member 222*a* at one side of the main cam control arm 222 is lowered, and the main cam stop lever rod 234 (see FIG. 14) and the main cam stop lever 235 of the rapid feed mechanism 103 (see FIG. 26) are lowered. The one end portion 235*b* of the lever 235 is disconnected from the cam 325 of the control cam mechanism 300 and held on the cam face 325*a* by the spring 237*c*.

(Safety in Mode Change-over)

Thus, the one end portion 235*b* of the lever 235 is not pressed up, and, accordingly, the main cam control arm 222 is kept in this state, so that the misoperation-preventing pin 222*h* of the arm 222 abuts a position 212*g* of the window 212*f* in the cutting control cam disc 212. Since the cutting control cam disc 212 can not be rotated even if the cutting shaft stop arm 223 is disengaged, the hook portion 219*a* of the buttonhole cutting clutch hook 219 is not stopped on the ratchet 173 of the driving portion and the cutting mechanism 80 is not operated.

Moreover, the after-cut mode setting is not changed even if the starting lever 225 is pushed twice.

(Rapid Feeding and Stitch Formation)

The work clamp carrier is advanced to perform the rapidly feeding and the buttonhole stitching is performed, and then the work clamp carrier retreats to perform the rapidly feeding and the stitch formation in the same manner as in the "before-cut" mode.

(Cutting Actuation)

When the end portion 235*b* of the lever 235 engages the stop cam 325, the main cam stop lever rod 234 is pressed up so that the backward rapid feed is stopped by the rapid feed clutch ring 184. At the same time, the main cam control arm 222 is lowered so that the misoperation-preventing pin 222*h* of the main cam control arm 222 is caused to enter the circumference groove 212*e* of the cutting control cam disc 212, and the step 224*b* of the cutting starter arm 224 and the the abutting portion 223*d* of the cutting shaft stop arm 223 are lowered. Thus, the hook portion 223*a* is disconnected from the step 212*d* of the cutting control cam disc 212. The cutting control cam disc 212 is rotated by the spring 228, so that the cam follower 220*c* of the cutting clutch cutoff lever 220 lying on the cam 212*c* is disconnected from the cam 212*c* and the hook 220*d* is disconnected from the hook portion 219*a* of the buttonhole cutting clutch hook 219. The hook portion 219*a* of the buttonhole cutting clutch hook 219 is bitten in the ratchet 173 of the driving portion of the cutting mechanism 80 by the spring 227. Thus, the buttonhole cutting shaft 96 acting as the driven portion is rotated. Upon the rotation of the buttonhole cutting cam 97, the buttonhole cutting mode cam 216 is rotated, the joint portion 224*c* of the cutting starter lever 224 is caused to ride on the outer circumference 216*c* including the step 216*b* of the cam 218, the cutting starter lever 224 is pressed outward, the joint portion 223*d* of the cutting shaft stop arm 223 and the step 224*b* of the cutting starter lever 224 are disconnected from each other, and the cutting shaft stop arm 223 is returned by the cutoff lever spring 229*c*. After a buttonhole is cut with one turn of the buttonhole cutting cam 97 in the the same manner as in the "before-cut" mode, the hook 223*a* of the cutting shaft stop arm 223 is brought into contact with the step 212*d* of the cutting control cam disc 212 and locked thereat. Thus, the cutting knife is returned to the initial state and the operation of the cutting mechanism 80 is finished.

(No-Cut)

The dial 217 is turned so that the indication 217*b* is set to the right side.

The stud 215*b* of the starting control plate 215 is hiding in the ring space 216*e* of the buttonhole cutting mode cam 216 in the same manner as in the "after-out" mode, except that the joint portion 224*e* of the cutting starter lever 224 abuts on the outer circumference 216*c*. When the starter lever 225 is pushed, the rapid feeding and the stitch formation are made in the same manner as in the "after-cut" mode. After the backward rapid feeding, the end portion 235*b* of the lever 236 engages the stop cam 325 to stop the work clamp carrier 3, the main cam stop lever rod 234 is raised, and the main cam control arm 222 is lowered. However, the step 224*b*, of the cutting starter lever 224 can not press down the joint portion 223*d* of the cutting shaft stop arm 223. Accordingly, the cutting mechanism 80 does not operate.

Even in the case where stitches were not properly formed in buttonhole stitching, a proper buttonhole can be formed at a predetermined position with no failure in such a manner that after the work or cloth which has been one stitched is taken out and the thread is undone, buttonhole stitching may be repeated in the "no-cut" mode by using the buttonhole pattern formed by the needle and the cut after the thread has been undone.

(Cut-only)

"Cut-only" mode is used for the inspection of the condition of a cutting knife, for replacing a cutting knife, for testing cutting quality and for revision of cutting in the "before-cut" mode.

First, the buttonhole cutting mode cam 216 is turned with the dial 217 so that the indication 217*b* is directed left. In this state, the joint portion 224*c* of the cutting starter lever 224 is riding on the outer circumference 216*c* of the buttonhole cutting mode cam 216. Since the starting cam 214 has been withdrawn from the window 213*c* of the starting cam case 213 by the eccentric 216*a* of the buttonhole cutting mode cam 216, the main cam control arm 222 is never raised. Since the starting lever plate 226 lies on the step 216*b* of the buttonhole cutting mode cam 216, the control plate driving stud 215*b* is in the state to be hit up. When the starting lever 225 is pushed, the stud 215*b*, is pressed up in the same manner as in the "before-cut" mode, the starting control plate 215 turns, and the cam 215*d* thereof presses down the cam follower 223*b* of the cutting shaft stop arm 223. The hook portion 223*a* thereof is disengaged from the step 212 of the cutting control cam disc 212, the cutting control cam disc 212 is turned by the spring 228, the cam follower 220*c* of the cutting clutch cutoff lever 220 riding on the cam 212*c* is disengaged therefrom, the hook 220*d* is disengaged from the hook portion 219*b* of the buttonhole cutting clutch hook, and the hook portion 219*a* is caused to bite in the ratchet 173 of the driving portion of the cutting mechanism 80 by the spring 227. Thus, the buttonhole cutting shaft 96 and the buttonhole cutting cam 97 are rotated, and a buttonhole is cut by the cutting knife and the cutting block. Safety in mode change-over is similar to that in the "before-cut" mode.

(Emergency Returning)

In the case of breakage of the needle 11, stoppage of stitch formation, mis-set of a work or cloth, or the like, in the abovementioned various modes, the quick return lever 940 (see FIG. 19) is used for causing the machine to rapidly come back to the starting position, that is, the stop position. Assuming that such a case arises, if the lever 940 in the clutch driving device 930 is pressed, the seat portion 942 of the lever 935 lifts the bracket 948 of the lever 936 through the shaft 934 and presses up the clutch driving rod 159 so as to shift it to the rapid feed state. Consequently, the clutch mechanism 100 is changed over to the rapid feed mode, so that the needle bar is topped at a predetermined position and the work clamp carrier 3 is immediately fed rapidly to return to the stop position.

As described above, according to the present invention, there is provided a sewing machine for performing buttonhole stitching, which is provided with a clutch means for transmitting motor torque to a rapid feed shaft in rapid feeding in order to rapidly feed the work clam carrier through a rapid feed mechanism and for transmitting motor torque to a selected one of a arm shaft, a vertical shaft, and a bed shaft in stitch feeding in order to perform stitch formation through a stitch feed mechanism by a stitch-forming device, and which provides ease of operation attractive buttonhole stitches, portability.

Thus, there is provided in accordance with the present invention a buttonhole stitching sewing machine which has the advantages discussed above. The embodiments above are intended to be merely exemplary and those skilled in the art will be able to make variations and modifications in them without departing from the spirit and scope of the invention. All such modifications and variations are contemplated as falling within the scope of the claims.

What is claimed is:

1. A button-hole sewing machine comprising:

an electric motor for driving said sewing machine;

a machine body including a bed for holding a work in cooperation with a work clamping means;

a stitch forming device for stitching button-holes in said work and including:

a needle bar driving mechanism for driving a needle bar for supporting a needle, a looper-spreader mechanism for driving a looper and a spreader, and a turning mechanism for turning said needle bar, said looper and said spreader, said needle bar driving mechanism being provided with an up/down moving mechanism and a needle vibrating mechanism;

an arm shaft for driving said up/down moving mechanism;

a bed shaft for driving said looper-spreader mechanism;

a cutting mechanism for cutting button-holes in said work;

a control cam mechanism including a rapid feed mechanism for rapidly feeding said bed, a stitch feeding mechanism and a main control cam for controlling operation of said stitch feeding mechanism and said rapid feed mechanism;

a vertical shaft linked with said arm shaft for driving said needle vibrating mechanism, said bed shaft, and said stitch feeding mechanism;

a mode change-over mechanism including a driving section which receives torque from said rapid feeding mechanism, a driven section for operating said cutting mechanism, and means for operatively connecting and disconnecting said driving section and said driven section.

2. The button-hole sewing machine of claim 1 further comprising:

means for adjusting the timing of said connecting and disconnecting responsive to operation of said main control cam.

3. The button-hole sewing machine of claim 1 wherein:

said main control cam is a disc-like member having a central opening through which said vertical shaft extends;

said rapid feeding mechanism includes an intermediate shaft and power transmission means mounted on said intermediate shaft to engage and drive the outer periphery of said main control cam; and said stitch feeding mechanism includes stepping drive means for turning said main control cam in stepped increments responsive to rotation of said vertical shaft.

4. A button-hole sewing machine according to claim 3 in which said stepping drive means includes a stitch number adjusting mechanism for varying the number of stitches within different portions of a given button-hole.

5. A button-hole sewing machine according to claim 4 in which said main control cam includes a peripheral for controlling said number of stitches stitch number selection camming surface.

6. A button-hole sewing machine according to claim 4 in which said stitch number adjusting mechanism includes an eyelet-straight change-over mechanism for changing over between an eyelet-stitching mode while feeding said bed feed across and a straight-stitching mode without said bed feeding, in sewing a given button hole.

7. A button-hole sewing machine according to claim 4, in which said connecting means includes an adjusting section for adjusting an amount of increase/decrease in the number of stitches.

8. A button-hole sewing machine according to claim 3, in which said main cam carries a stop cam for controlling operation of said mode change-over mechanism and for cutting off said power transmission means of said rapid feeding mechanism.

9. A button-hole sewing machine according to claim 8, in which said main control cam includes a cam groove having a straight portion for stopping the feeding of said bed over a predetermined range including the stop position determined by said stop cam.

10. A button-hole sewing machine according to claim 8, further comprising recovery means including a lever, adapted to come into sliding contact with said stop cam of said main control cam, for controlling said mode change-over mechanism as well as said power transmission means of said rapid feeding mechanism, said lever being arranged such that after said lever is engaged/-locked by said stop cam to cut off the mode change-over operation of said mode change-over mechanism and the power transmission means of said rapid feeding mechanism, said lever is separated from said stop cam by further rotation of said main control cam.

11. A button-hole sewing machine comprising:

an electric motor for driving said sewing machine;

a machine body including a bed for holding a work in cooperation with a work clamping means;

a stitch forming device for stitching button-holes in said work and including:

a needle bar driving mechanism for driving a needle bar for supporting a needle, a looper-spreader mechanism for driving a looper and a spreader and a turning mechanism for turning said needle bar, said looper and said spreader, said needle bar driving mechanism being provided with an up/down moving mechanism and a needle vibrating mechanism;

an arm shaft for driving said up/down moving mechanism;

a bed shaft for driving said looper-spreader mechanism;

a cutting mechanism for cutting button-holes in said work;

a control cam mechanism including a rapid feed mechanism for rapidly feeding said bed, a stitch feeding mechanism and a main control cam for controlling said rapid feed mechanism and said stitch feeding mechanism;

a vertical shaft linked with said arm shaft for driving said needle vibrating mechanism, said bed shaft, and said stitch feeding mechanism;

a mode change-over means including a driving section for transmitting power from said rapid feed mechanism; a driven section for operating said cutting mechanism, cutting clutch means, provided between said driving section and said driven section, for connecting/separating said driving section to/from said driven section, and a mode change-over control unit including a buttonhole cutting mode cam for controlling the operations and operational sequences of said cutting mechanism; and dial means for selectively positioning said button-hole cutting mode cam relative to said driven section, whereby said cutting mechanism is actuated in accordance with the one mode corresponding to the selected position of said dial.

12. A button-hole sewing machine comprising:

an electric motor for driving said sewing machine;

a machine body including a bed for holding a work in cooperation with a work clamping means;

a stitch forming device for stitching button-holes in said work and including:

a needle bar driving mechanism for driving a needle bar for supporting a needle, a looper-spreader mechanism for driving a looper and a spreader, and a turning mechanism for turning said needle bar, said looper and said spreader.

said needle bar driving mechanism being provided with an up/down moving mechanism and a needle vibrating mechanism;

an arm shaft for driving said up/down moving mechanism;

a bed shaft for driving said looper-spreader mechanism;

a cutting mechanism for cutting button-holes in said work;

a control cam mechanism including a rapid feed mechanism for rapidly feeding said bed, a stitch feeding mechanism and a main control cam for controlling said rapid feed mechanism and said stitch feeding mechanism;

a vertical shaft linked with said arm shaft for driving said needle vibrating mechanism, said bed shaft, and said stitch feeding mechanism;

a driving section for transmitting power from said rapid feed mechanism said driving section including a rachet;

a driven section including a driven shaft for operating said cutting mechanism;

a clutch wheel fixedly mounted on said driven shaft;

a cutting control cam disc mounted on said clutch wheel and rotatable within a predetermined range;

a first spring provided between said clutch wheel and said cutting control cam disc;

a pawl pivotally mounted on said clutch wheel for connecting/separating said clutch wheel to/from said driving section;

a second spring for urging said pawl into engagement with said rachet thereby connecting said clutch wheel and said driving section;

a cutting shaft stop arm for temporarily holding said cutting control cam disc against rotation;

a mode change-over cam on said driven shaft;

a control plate mounted on said driven shaft and carrying (1) a projecting pin for engaging said mode change-over cam and (2) a protrusion for engaging said cutting shaft stop arm to pivot said shaft stop arm, disengaging said shaft stop arm from said control cam disc and allowing said control cam disc to rotate;

a third spring urging said cutting control cam disc to a position where said control cam disc is disengaged from said cutting shaft stop arm;

a mode change-over knob for selectively positioning said mode change-over cam relative to said driven section; and lever means for operating said cutting shaft stop arm responsive to said main control cam.

13. A button-hole sewing machine according to claim 12, in which said driving section and said clutch are constituted by a ratchet and a hook respectively, said hook being pivotally attached on said clutch casing.

14. A button-hole sewing machine according to claim 12 further comprising:

a cam case mounted on said driven shaft and a starting cam slidably received in said cam case and loosely mounted on said driven shaft to allow for radial sliding movement within said case responsive to said mode change-over cam between radially inward and radially outward positions;

and wherein:

said lever means includes an after-cutting actuation arm, a starting lever plate for engaging said mode change-over cam and a manual lever for pivoting said starting lever plate;

with said cutting mode cam positioned for a precut mode, said projecting pin is engaged by starting lever plate, said after-cutting actuation arm is disengaged from said cutting shaft stop arm and said starting cam is in said radially outward position;

with said mode control cam positioned in an after-cutting mode, said projecting pin is disengaged from said starting lever plate, said starting lever plate and said shaft stop arm are engaged by said after-cutting actuation arm and said starting cam is in said radially inward position.

15. A button-hole sewing machine according to claim 14 wherein:

with said mode control cam positioned in a cutting only mode, said projecting pin abuts said starting lever plate, said before-cutting cam is in said radially inward position and said after-cutting actuation arm is disengaged from said cutting shaft stop arm.

16. A button-hole sewing machine according to claim 12 wherein:

with said mode control cam positioned in a non-cutting mode, said starting lever plate is disengaged from said projecting pin, said after-cutting actuation arm is disengaged from said cutting shaft stop arm and said before-cutting cam is in radially inward position.

17. A button-hole sewing machine comprising:

an electric motor for driving said sewing machine;

a machine body including a bed for holding a work in cooperation with a work clamping means;

a stitch forming device for stitching button-holes in said work and including:

a needle bar driving mechanism for driving a needle bar for supporting a needle, a looper-spreader mechanism for driving a looper and a spreader, and a turning mechanism for turning said needle bar, said looper and said spreader, said needle bar driving mechanism being provided with an up/down moving mechanism and a needle vibrating mechanism;

an arm shaft for driving said up/down moving mechanism;

a bed shaft for driving said looper-spreader mechanism;

a cutting mechanism for cutting button-holes in said work;

a control cam mechanism including a rapid feed mechanism for rapidly feeding said bed, a stitch feeding mechanism and a main control cam for controlling operation of said rapid feed mechanism and said stitch feeding mechanism;

a vertical shaft linked with said arm shaft for driving said needle vibrating mechanism, said bed shaft, and said stitch feeding mechanism; and:

an eyelet-straight change-over mechanism including a driving lever having a cam follower controlled by said main cam, a driven lever actuated by said driving lever through a clutch to make said bed feed across, and a manually operated lever for actuating said clutch.

18. A button-hole sewing machine according to claim 17, in which said stitch feeding mechanism includes a power transmission system in which said main cam is driven by said vertical shaft through a stepping drive mechanism, said stepping drive mechanism including stitch number selection means, responsive to said manually operated lever, for increasing/decreasing the number of stitches in a part of a button-hole.

19. A button-hole sewing machine comprising:

an electric motor for driving said sewing machine;

a machine body including a bed for holding a work in cooperation with a work clamping means;

a stitch forming device for stitching button-holes in said work and including:

a needle bar driving mechanism for driving a needle bar for supporting a needle, a looper-spreader mechanism for driving a looper and a spreader, and a turning mechanism for turning said needle bar, said looper and said spreader, said needle bar driving mechanism being provided with an up/down moving mechanism and a needle vibrating mechanism;

an arm shaft for driving said up/down moving mechanism;

a bed shaft for driving said looper-spreader mechanism;

a cutting mechanism for cutting button-holes in said work;

a control cam mechanism including a rapid feed mechanism for rapidly feeding said bed, a stitch feeding mechanism and a main cam for controlling operation of said rapid feed mechanism and said stitch feeding mechanism;

a vertical shaft extending through the center of said main cam and linked with said arm shaft for driving said needle vibrating mechanism, said bed shaft, and said stitch feeding mechanism;

said stitch feeding mechanism including:

a feeding cam fixed on said vertical shaft, a driving lever having a slider slidably mounted thereon, said driving lever being engaged and pivotally driven by said feeding cam with said slider as a pivot point, a driven lever pivotally connected to and pivotally driven by said driving lever for driving said main cam in stepped increments through a one-way clutch, and an adjuster for varying the position of said slider.

20. A button-hole sewing machine comprising:

an electric motor for driving said sewing machine;

a machine body including a bed for holding a work in cooperation with a work clamping means;

a stitch forming device for stitching button-holes in said work and including:

a needle bar driving mechanism for driving a needle bar for supporting a needle, a looper-spreader mechanism for driving a looper and a spreader, and a turning mechanism for turning said needle bar, said looper and said spreader, said needle bar driving mechanism being provided with an up/down moving mechanism and a needle vibrating mechanism;

an arm shaft for driving said up/down moving mechanism;

a bed shaft for driving said looper-spreader mechanism;

a cutting mechanism for cutting button-holes in said work;

a control cam mechanism including a rapid feed mechanism for rapidly feeding said bed, a stitch feeding mechanism and a main control cam for controlling operation of said rapid feed mechanism and said stitch feeding mechanism;

a vertical shaft extending through the center of said main cam and linked with said arm shaft for driving said needle vibrating mechanism, said bed shaft, and said stitch feeding mechanism;

said stitch feeding mechanism including:

a feeding cam fixed on said vertical shaft, a driving lever having a slider slidably mounted thereon, said driving lever being engaged and pivotally driven by said feeding cam with said slidably mounted slider as a pivot point, and a driven lever pivotally connected to and pivotally driven by said driving lever for driving said main cam in stepped increments through a one-way clutch, said slider being coupled to a cam follower in slidably contact with an outer peripheral camming surface on said main cam for increasing/decreasing the number of stitches in a part of a button-hole.

21. A button-hole sewing machine comprising:

an electric motor for driving said sewing machine;

a machine body including a bed for holding a work in cooperation with a work clamping means;

a stitch forming device for stitching button-holes in said work and including:

a needle bar driving mechanism for driving a needle bar for supporting a needle, a looper-spreader mechanism for driving a looper and a spreader, and a turning mechanism for turning said needle bar, said looper and said spreader, said needle bar driving mechanism being provided with an up/down moving mechanism and a needle vibrating mechanism;

an arm shaft for driving said up/down moving mechanism;

a bed shaft for driving said looper-spreader mechanism;

a cutting mechanism for cutting button-holes in said work;

a control cam mechanism including a rapid feed mechanism for rapidly feeding said bed, a stitch feeding mechanism and a main control cam for controlling operation of said rapid feed mechanism and said stitch feeding mechanism;

a vertical shaft linked with said arm shaft for driving said needle vibrating mechanism, said bed shaft, and said stitch feeding mechanism;

said rapid feed mechanism including an intermediate shaft;

power switching clutch means for transmitting the torque of said motor, in a rapid feeding mode, to said intermediate shaft, to cause said rapid feeding mechanism to feed said bed rapidly and, in a stitch feeding mode, to a given one of said arm shaft, said vertical shaft, and said bed shaft to operate said stitch forming device; and a clutch driving device including a bidirectionally urging spring for storing elastic force and a release means responsive to the detection of button-hole length for releasing said stored elastic force to drive said clutch means to change between the rapid feeding and the stitch feeding modes.

* * * * *

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

Col. 1, line 26, delete "a".

Col. 2, line 3, after "encountered" insert --further--;

line 5, delete "for different" and before "stitching" insert

--for different--;

line 37, after "mechanism" insert a comma --,--; and line 43, "beed" should read --feed--.

Col. 4, line 18, "fed" should read --bed--; and line 31, "egageable" should read --engageable--.

Col. 5, line 53, "lever;" should read --lever,--.

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

Col. 6, line 21, after "a", first instance, insert --cutting-- and "chiding" should read --cutting--.

Col. 8, line 37, "plane" should read --plate--.

Col. 11, line 9, after "Thus" insert a comma --,--;

line 55, after "rod" insert --pin 43--.

Col. 12, line 40, delete "with";

line 47, "25" should read --65--;

line 48, "84" should read --64--; and line 32, "belt" should read --bell--.

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

line 21, after "to" insert a comma --,-- and after "succession" insert a comma --,--.

Col. 14, line 4, "tive" should read --tively--.

Col. 15, line 4, after "knife" insert --5--.

Col. 16, line 32, delete "the"; and line 50, "Kear" should read --gear--.

Col. 17, line 8, "138" should read --136--; and line 11, "106" should read --105--.

Col. 18, line 9, after "an" insert --axially-- and after

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

"extending" insert --face--; and line 59, after "938" insert --are-- and after "shown" insert --successively--.

Col. 19, line 55, after "1b" insert a comma --,--; and line 68, "S" should read --3--.

Col. 20, line 20, delete "the", first instance; and line 47, "103" should read --103a--.

Col. 21, line 43, "188" should read --186--;

line 45, after "26c" insert --a--; and line 62, "238b" should read --236b--.

Col. 22, line 19, "102" should read --192--;

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

Figure 22:
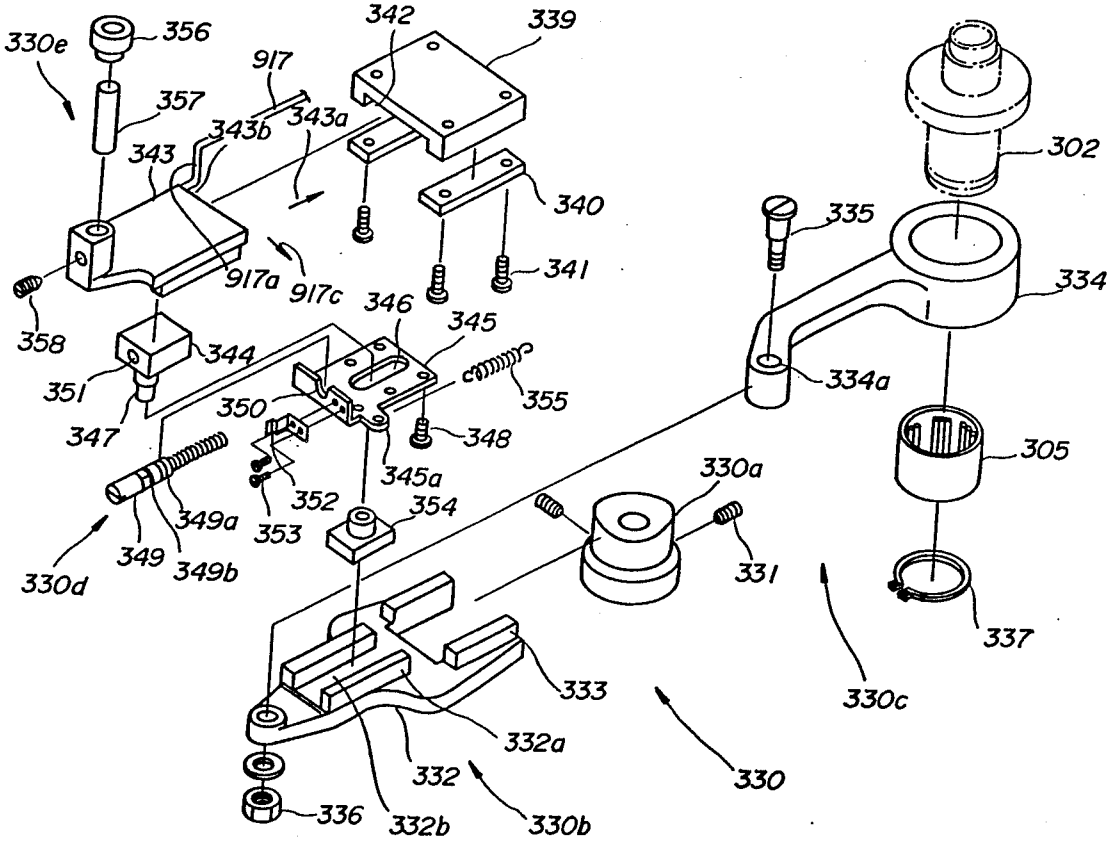
FIG. 22 is an exploded perspective view of the stitch feeding mechanism in the same sewing machine.
Figure 22A:
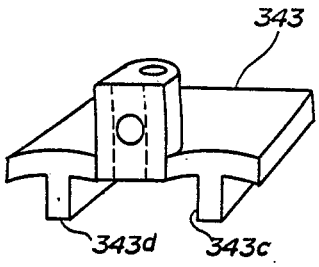
FIG. 22*a* is a perspective view of a part of the same stitch feeding mechanism.
Figure 22B:
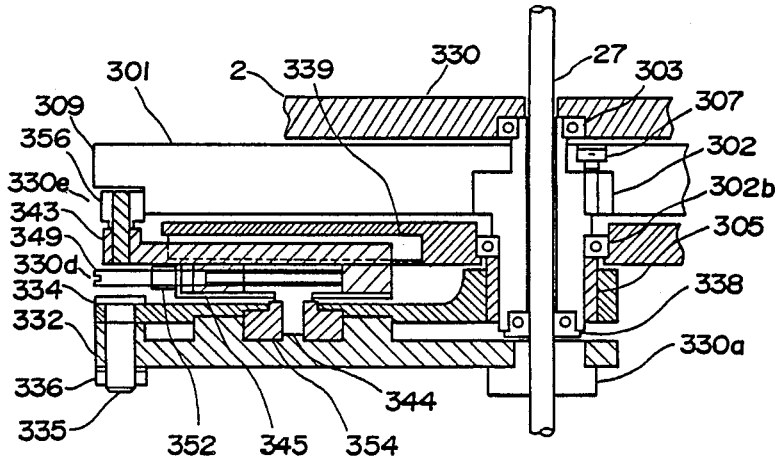
FIG. 22*b* is a sectional view of a part of the same stitch feeding mechanism.

It is certified that error appears in the above-identified patent and that said Letters Patent is hereby corrected as shown below:

line 22, "198" should read --196--;

line 55, delete "The" and insert --Referring to Fig. 22, the--; and line 62, "830a" should read --330a--.

Col. 23, line 1, "mom" should read --cam--;

line 13, after "numeral" insert --338--;

line 25, "348" should read --346--;

line 36, "lcck" should read --lock-- and "on" should be deleted;

line 46, delete "is" and insert --and is connected--;

line 50, delete "its" and insert --to--.

line 58, "359d" should read --330d--.

Col. 24, line 26, "if" should read --1f--;

line 28, "to" should read --in--;

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

line 42, "10b" should read --910b--;

line 61, "003" should read --903--; and line 66, "14a" should read --914a--.

Col. 25, line 13, "see" should read --(see--;

line 15, delete "is";

line 16, "843" should read --343--;

line 21, after "917c" insert --it--;

line 25, delete "908" and insert --906--;

line 49, "988" should read --966--; and line 64, "882" should read --982--.

Col. 26, line 1, "988" should read --986--;

line 3, after "is", first instance, insert a comma --,--;

line 6, "988" should read --986--;

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

line 8, "stuck" should read --fixed--;

line 21, "978" should read --976--;

line 29, "989" should read --969--;

line 30, delete "is";

line 34, "1s" should read --is--; and line 40, "cutting" should read --(cutting--.

Col. 27, line 8, "an" should read --the--;

line 19, delete "clutch"; and line 52, delete "on".

Col. 28, line 4, "98" should read --96--;

line 6, "98b" should read --96b--; and line 68, "98" should read --96--.

Col. 29, line 3, "98" should read --96--;

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

line 4, "218" should read --216-- and "Prevents" should read --prevents--;

line 22, "220h" should read --220b--;

line 33, "225" should read --223--;

line 38, "228 " should read --229b--;

line 43, delete "of";

line 47, "he" should read --be--;

line 56, "225b" should read --223b--;

line 61, delete "onto" and insert --about--;

line 67, "218c" should read --216c--; and line 68, "218" should read --216-- and "215b" should read --216b,--.

Col. 30, line 6, after "214." insert --As shown in Figs. 14 and 14g, a partial cut-out, extending into groove 212e, is provided in the circumference of cam disk 212.-- line 9, "tained-therein" should read --tained

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

therein--;

line 11, "28" should read --26--;

line 12, "28c" should read --26c--;

line 18, delete "on";

line 22, "228" should read --226--; and line 38, "Portion" should read --portion--.

Col. 31, line 3, "leust" should read --least--;

line 19, "clamp" should read --clamp open--;

line 25, "clamps", both instances, should read --clamp--;

line 29, "see" should read --(see--;

line 31, "of" should read --in--;

line 35, delete "provided"; and line 46, delete "of", first instance.

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

Col. 32, line 4, "1025b" should read --1026b--;

line 6, "1026c" should read --1021c--;

line 9, "plate" should read --plates--;

line 15, "1025" should read --1026--;

line 17, "1025" should read --1026--;

line 19, "8a" should read --6a--;

line 27, "18" should read --16--;

line 29, "of" should read --or--;

line 31, "1020" should read --1029--;

line 36, after "carrier" insert --3--;

line 42, "1091a" should read --1031a--;

line 48, "of" should read --to--;

line 55, after "work" insert --clamp--; and line 57, delete "an".

Col. 33, line 5, delete "at a side end" and insert --projecting

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

from the side--;

line 8, "100" should read --1006--;

line 29, after "17)" insert --carries a shaft 1009a which is pivotally mounted--;

line 31, "1000g" should read --1009g--;

line 32, "ing" should read --ed--;

line 37, "1018" should read --1016--;

line 42, delete "on";

line 45, "100g" should read --1009g--;

line 51, "swiiching" should read --switching--;

line 57, "1009h" should read --1010--;

line 59, delete "on";

line 60, "nation" should read --motion--;

line 62, "1009g" should read --1009i-- and "abutting" should read --resting--;

line 64, "see" should read --(see--; and line 46, after "lever" insert --1009--.

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

Col. 34, line 12, delete "the", first instance;

line 19, "clump" should read --clamp--;

line 21, delete "to" and insert --across--;

line 22, after "2q" insert a period --.--;

line 30, "848" should read --846--;

line 32, delete "within" and insert --in their--;

line 34, "20b," should read --20b),--;

line 35, "318" should read --316--;

line 52, "8a" should read --6a--;

line 54, "FIGS." should read --FIG.--;

line 58, after "1016" insert a comma --,--;

line 61, "for" should read --foot--.

Col. 35, line 3, delete "the clamping condition" and insert --for clamping--;

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

line 4, delete "due to" and insert --dependent upon--;

line 12, after "Therefore" insert a comma --,-- and after "cutting" insert a comma --,--;

line 17, delete "condition";

line 21, after "by" insert --a--;

line 24, delete "thereby";

line 37, "diving" should read --driving--;

line 38, "4" should read --14)--;

line 41, after "171" insert a comma --,--;

line 46, "14o" should read --14c--;

line 48, "218h" should read --216h--;

line 59, "225a" should read --223a--.

Col. 36, line 8, "after "screw" insert --91--;

line 17, delete "or cloth";

line 23, delete "up";

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

line 31, after "arm" insert --6--;

line 33, "elastisity" should read --elasticity--;

line 36, "98" should read --96--;

line 41, "1s" should read --is--;

line 46, delete "greatly" and insert --rapidly until--;

line 47, delete "till".

Col. 37, line 11, after "shaft" insert --96--;

line 20, "28c" should read --26c--;

line 23, "238" should read --236--;

line 25, "238" should read --236--;

line 26, "238a" should read --236a--;

line 36, "310h" should read --310b--;

line 39, "01" should read --901--;

line 49, "Pin" should read --pin--;

line 52, delete "under";

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

line 54, after "spread" insert a comma --,--; and delete "So (FIG. 8a)" and insert --So (see FIG. 6a),--;

line 57, delete "so," and delete "outward";

line 58, "1028c" should read --1026c--;

line 60, "1028b" should read --1026b--;

line 67, "citting" should read --cutting--; and line 58, delete "stretch" delete the comma "," and insert --spread So,--.

Col. 38, line 2, "223a" should read --233a--;

line 32, "foilower" should read --follower--;

line 46, after "2," insert --3,--;

line 52, delete "on";

line 53, "51" should read --151--;

line 60, "125" should read --123--.

Col. 39, line 2, delete "herefore" insert "therefore";

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

line 14, delete "be" and insert --the--;

line 36, after "836" insert a comma --,-- and "848" should read --846--;

line 50, "218" should read --216--;

line 61, "S1" should read --sl--;

line 68, "8a" should read --6a--; and
line 28, "connection" should read --connections--.

Col. 40, line 8, "level" should read --bevel--;

line 32, "384" should read --334--;

line 59, "28, 28a" should read --26, 26a--.

Col. 41, line 40, delete "present" and insert --the present description--.

Col. 42, line 16, "989" should read --969--.

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

Col. 46, line 59, "out" should read --cut--; and line 65, "236" should read --235--.

Col. 47, line 61, "topped" should read --stopped--.

Col. 48, line 1, "clam" should read --clamp--;

line 7, before "portability" insert --and--;

line 11, after "ments" insert --described--.

Col. 49, line 9, before "for" insert --stitch number selection camming surface-- and after "stitches" delete "stitch number" and insert a period --.--;

UNITED STATES PATENT AND TRADEMARK OFFICE

CERTIFICATE OF CORRECTION

PATENT NO. : 4,903,619

DATED : February 27, 1990

INVENTOR(S) : Kouichi SAKUMA

It is certified that error appears in the above-identified patent and that said Letters Patent is hereby corrected as shown below:

line 10, delete entire line.

Signed and Sealed this

Second Day of February, 1993

*Attest:*

STEPHEN G. KUNIN

*Attesting Officer*

*Acting Commissioner of Patents and Trademarks*